US006742722B2

(12) United States Patent
Hosoda et al.

(10) Patent No.: US 6,742,722 B2
(45) Date of Patent: Jun. 1, 2004

(54) CARTRIDGE TYPE COATING SYSTEM

(75) Inventors: Toshio Hosoda, Fujieda (JP); Hidetsugu Matsuda, Fujieda (JP); Osamu Yoshida, Tokyo (JP)

(73) Assignee: ABB K.K., Tokyo (JP)

( * ) Notice: Subject to any disclaimer, the term of this patent is extended or adjusted under 35 U.S.C. 154(b) by 261 days.

(21) Appl. No.: 10/018,873

(22) PCT Filed: Apr. 19, 2001

(86) PCT No.: PCT/JP01/03363

§ 371 (c)(1),
(2), (4) Date: Dec. 26, 2001

(87) PCT Pub. No.: WO01/81005

PCT Pub. Date: Nov. 1, 2001

(65) Prior Publication Data

US 2002/0158148 A1 Oct. 31, 2002

(30) Foreign Application Priority Data

Apr. 25, 2000 (JP) ..... 2000-124940

(51) Int. Cl.[7] ..... A62C 31/00

(52) U.S. Cl. ..... 239/305; 239/322; 239/329; 239/569; 239/703; 239/708; 239/223; 222/148; 222/326; 222/389; 901/43; 141/20.5

(58) Field of Search ..... 239/305, 304, 239/104, 112, 113, 223, 569, 700, 703, 106, 320, 322, 323, 329, 290, 708, 600, DIG. 14, 583; 222/148, 325, 326, 327, 386, 389; 118/323, 629; 141/20.5, 2, 9, 25; 901/43

(56) References Cited

U.S. PATENT DOCUMENTS

| | | | | |
|---|---|---|---|---|
| 6,164,561 A | * | 12/2000 | Yoshida et al. | 239/223 |
| 6,179,217 B1 | * | 1/2001 | Yoshida et al. | 239/305 |
| 6,612,345 B1 | * | 9/2003 | Hosoda | 141/20.5 |

FOREIGN PATENT DOCUMENTS

| | | |
|---|---|---|
| EP | 967016 | 12/1999 |
| EP | 1004360 | 5/2000 |
| JP | 8-229446 | 9/1996 |
| JP | 2000-61371 | 2/2000 |

* cited by examiner

*Primary Examiner*—Dinh Q. Nguyen
(74) *Attorney, Agent, or Firm*—Oblon, Spivak, McClelland, Maier & Neustadt, P.C.

(57) ABSTRACT

A paint cartridge is provided with a wash fluid passage in communication with a paint chamber, along with a wash fluid valve adapted to open and close the wash fluid passage. Provided on the side of a replenishing stool are a replenishing valve which supplies or discharges paint to or from the paint chamber, an extruding thinner feed/discharge valve which supplies or discharges paint-extruding thinner to or from an extruding thinner chamber, and a wash fluid supply valve which supplies a wash fluid to the paint chamber through the wash fluid passage. Accordingly, upon opening the replenishing valve, wash fluid supply valve and wash fluid valve, a wash fluid from the wash fluid supply valve is allowed to flow into the paint chamber through the wash fluid passage and discharged through a feed tube to wash away deposited paint therefrom.

13 Claims, 31 Drawing Sheets

CARTRIDGE TYPE COATING SYSTEM

TECHNICAL FIELD

This invention relates to a cartridge type coating system employing a plural number of paint cartridges, for example, a plural number of paint cartridges of different colors, which are adapted to be replaceably attached to a sprayer unit of the coating system.

BACKGROUND ART

Generally, coating systems which are in use for coating automotive vehicle bodies or the like are largely constituted by a coating action mechanism like a coating robot, and a sprayer unit which is mounted on the coating action mechanism. Coating systems of this sort can perform coating operations automatically, as paint is sprayed by a sprayer unit which is operated according to programed operational procedures. In this connection, the coating systems of this class are required to be able to cope with a larger number of paint colors and at the same time to meet demands for reductions in the amount of paint which has be discarded at the time of changing the paint color and also in the amount of thinner which is consumed in cartridge washing operations.

As well known in the art, in an attempt to meet the requirement or demands for reductions of the amounts of paint discard and thinner consumption and for capability of handling a larger number of colors, there have thus far been developed a number of cartridge type coating systems (e.g. as disclosed in Japanese Laid-Open Patent No. H8-229446). Cartridge type coating systems of this sort employ a number of paint cartridges which are filled with paint of different colors and adapted to be replaceably mounted or loaded on a sprayer unit.

For instance, a cartridge type coating system is largely constituted by a housing which is provided with a sprayer mount portion on the front side and a cartridge mount portion on the rear side thereof, and a sprayer unit which is mounted on the sprayer mount portion of the housing and comprised of an air motor with a rotational shaft and a rotary atomizing head which is mounted on a front end portion of the rotational shaft of the air motor. Further, formed axially and internally of the rotational shaft of the sprayer unit is a feed tube passage hole having fore and rear ends thereof opened into the sprayer unit and cartridge mount portion of the housing, respectively.

Further, in the case of above-mentioned Japanese Laid-Open Patent No. H8-229446, the cartridge type coating system is arranged to replaceably mount on the housing a number of separate paint cartridges of different colors. Each paint cartridge is constituted by a casing having a container which is internally filled with paint, and a feed tube which is extended axially forward from a fore end of the container. The container of the paint cartridge is replaceably set on the cartridge mount portion of the housing, with the feed tube passed into the above-mentioned feed tube passage hole on the side of the housing.

Further, in the cartridge type coating system according to the above-mentioned Japanese Laid-Open Patent No. H8-229446, the casing of the cartridge is provided with a movable partition wall which divides the container into a paint chamber in communication with the feed tube and a paint-extruding air chamber, and an air passage on the side of the paint cartridge, which supplies extruding air to the extruding air chamber. Further, an extruding air passage is provided on the part of the housing for communication with the extruding air passage on the side of the paint cartridge. Thus, extruding air is circulated to the extruding air chamber through the extruding air passage on the side of the housing and the extruding air passage on the side of the paint cartridge to displace the movable partition wall in a direction of extruding paint in the paint chamber toward the feed tube and the rotary atomizing head.

With the cartridge type coating system which is arranged in the manner as described above, one paint cartridge to be used in a coating operation is selected from a plural number of paint cartridges of different colors, and set in position on the cartridge mount portion of the housing. Then, air is supplied to the extruding air chamber of the cartridge at a suitable rate to discharge paint in the paint chamber of the cartridge toward the rotary atomizing head through the feed tube. Consequently, paint is sprayed toward a work piece by the rotary atomizing head.

The paint color can be changed simply by replacing the paint cartridge by another paint cartridge which is filled with paint of a desired color, without necessitating to discard paint and thinner on each color change.

On the other hand, the paint cartridge, which has been consumed in a previous coating operation and removed from the housing by the color changing operation, is returned to a cartridge holder table for paint replenishment.

The cartridge type coating system by the above-described prior art, employing a plural number of paint cartridges of different colors, has made it possible to change the paint color simply by replacing the paint cartridge on the housing by a cartridge of a different color, without requiring to wash interior portions of the paint cartridge or feed tube.

However, in the case of a cartridge type coating system as described above, sometimes the whole system is put at rest for a long period of time for the sake of maintenance and serve or for carrying out repairing work. On such an occasion, it has been necessary to wash interiors of paint cartridges and feed tubes to prevent separation or solidification of paint.

In the case of the cartridge type coating system of the above-described prior art without cartridge washing functions, paint cartridges have to be washed manually despite the fact that the cartridge washing job is troublesome and time consuming.

DISCLOSURE OF THE INVENTION

In view of the above-discussed problems with the prior art, it is an object of the present invention to provide a cartridge type coating system, which can wash away deposited paint from paint cartridges within a shortened period of time in such a manner as to improve the efficiency of cartridge washing operations to a considerable degree.

In order to solve the above-discussed problems with the prior art, the present invention contemplates to provide improvements in a cartridge type coating system which basically includes: a paint sprayer unit, a plural number of paint cartridges each detachably connectable to the sprayer unit to supply paint thereto from an internal paint source, and a paint replenisher detachably connectable to an empty paint cartridge for replenishing paint thereinto.

According a feature of the present invention, there is provided a cartridge type coating system which comprises: a plural number of paint cartridges each constituted by a casing having a container and a feed tube extended forward from a fore end portion of the container, a movable partition wall provided in the container and dividing same into a paint chamber in communication with the feed tube and a paint-extruding liquid chamber, a normally closed paint valve provided in the casing and adapted to be opened at the time of supplying paint from the paint chamber to the sprayer unit through a paint passage in the feed tube or at the time of replenishing paint into the paint chamber, an extruding liquid passage for circulating the extruding liquid to and from the extruding liquid chamber, a wash fluid passage for supplying a wash fluid to the paint chamber, and a normally closed wash fluid valve provided in the wash fluid passage and adapted to be opened at the time of supplying the wash fluid to the paint chamber; and a paint replenisher constituted by a replenishing stool on which the paint cartridge is set at the time of replenishing paint into the paint chamber, a replenishing valve connected to the replenishing stool and adapted to replenish paint into the paint chamber of the paint cartridge through the paint passage in the feed tube while the paint valve is in an open state, an extruding liquid feed/discharge valve connected to the replenishing stool and adapted to feed or discharge the extruding liquid to or from the extruding liquid chamber of the paint cartridge through the extruding liquid passage while the paint valve is in an open state, and a wash fluid supply valve connected to the replenishing stool and adapted to supply the wash fluid to the paint chamber through the wash fluid passage while the wash fluid valve is in an open state.

With the arrangements just described, before starting a coating operation, a paint cartridge which has been replenished with paint on a replenishing stool of the paint replenisher is picked up therefrom and attached to the sprayer unit of the coating system. In that state, a paint-extruding liquid is supplied to the extruding liquid chamber of the cartridge, causing the movable partition wall to move forward toward the feed tube. Whereupon, paint in the paint chamber of the cartridge is spurted toward the sprayer unit from the feed tube and sprayed by the sprayer unit.

In this case, during a coating operation, paint in the paint chamber of the cartridge may tend to flow out through the wash fluid passage on the side of the paint cartridge. However, since the wash fluid valve is normally closed to block the wash fluid passage, it can prevent paint leaks through the wash fluid passage.

Next, in the case of replenishing paint into a paint cartridge, a consumed paint cartridge is detached from the sprayer unit, and set on and connected to a replenishing stool of the paint replenisher. In this state, extruding liquid in the extruding liquid chamber of the cartridge is discharged through the extruding liquid feed/discharge valve. Then, the feed tube of the cartridge is brought into communication with a paint supply side by the replenishing valve. Whereupon, paint is sucked into the paint chamber of the cartridge through the paint passage in the feed tube.

In a case where there is still some time before a replenished paint cartridge is used in a next coating operation, the replenished paint cartridge is left on the replenishing stool in the connected state, holding the feed tube of the cartridge in communication with the paint supply side through the replenishing valve. In this state, an extruding liquid is supplied to the extruding liquid chamber of the cartridge, pushing out paint in the paint chamber through the movable partition wall by the extruding liquid feed/discharge valve for return to the paint supply side. In a next phase, the extruding liquid in the extruding liquid chamber of the cartridge is discharged by the extruding liquid feed/discharge valve to suck paint into the paint chamber again. In this standby state, the paint inhaling and exhaling actions to and from the paint chamber (respiratory paint circulation) are repeated to prevent separation and sedimentation of pigment components of the paint.

Further, in order to wash the paint chamber and interior passages of a paint cartridge, the cartridge is detached from the sprayer unit and set on a replenishing stool of the paint replenisher. In this state, a wash fluid is supplied to the paint chamber by the wash fluid supply valve and circulated through the feed tube to wash away paint from the paint chamber and feed tube of the cartridge.

According to a preferred form of the present invention, the replenishing valve of the paint replenisher is constituted by a paint feed/discharge valve adapted to be opened at the time of supplying paint from a paint supply source to the paint chamber of the cartridge or at the time of returning paint in the paint chamber to the paint supply source, and a waste liquid discharge valve adapted to be opened at the time of supplying the wash fluid to the paint chamber of the cartridge.

With the arrangements just described, a paint cartridge to be replenished with paint is set on a replenishing stool of the paint replenisher. In that state, the paint feed/discharge valve is opened in order to supply paint to the paint chamber of the cartridge from a paint supply source or in order to discharge paint from the paint chamber of the cartridge for return to the paint supply source. On the other hand, when the waste liquid discharge valve is opened for washing the paint cartridge, the wash fluid which has been supplied to the paint chamber of the cartridge is discharged through the paint passage in the feed tube along with discard paint.

According to the present invention, the above-mentioned extruding liquid feed/discharge valve of the paint replenisher is constituted by an extruding liquid supply valve adapted to be opened at the time of supplying the extruding liquid to the extruding liquid chamber of the cartridge, and an extruding liquid discharge valve adapted to be opened at the time of discharging the extruding liquid from the extruding liquid chamber of the cartridge.

With the arrangements just described, in a case where there is still some time before a replenished paint cartridge is used in a next coating operation, the paint cartridge is left on the replenishing stool in a connected state. In this state, the extruding liquid supply valve is opened and an extruding liquid is supplied to the extruding liquid chamber of the paint cartridge, pushing out paint in the paint chamber through the movable partition wall. On the other hand, when the extruding liquid discharge valve is opened, the extruding liquid is discharged from the extruding liquid chamber of the cartridge, and as a consequence paint is sucked into the paint chamber of the cartridge from the paint supply source in step with the discharge of the extruding liquid.

According to the present invention, the wash fluid supply valve of the paint replenisher is constituted at least by a wash thinner supply valve adapted to supply wash thinner to the paint chamber of the cartridge or by a wash air supply valve adapted to supply wash air to the paint chamber of the cartridge.

In a case where one paint cartridge is used commonly for paint of different kinds or colors, for instance, it becomes necessary to wash the paint cartridge before putting a coating line at rest for a long period of time. For this purpose, the paint cartridge is set on and connected to a replenishing stool of the paint replenisher. In this state, the wash air supply valve is opened, whereupon wash air is supplied to the paint chamber of the cartridge to push out and discharge paint residues from the paint chamber and feed tube of the cartridge. On the other hand, when the wash thinner supply valve is opened, wash thinner is supplied to the paint chamber of the cartridge to wash away deposited paint from the paint chamber and feed tube.

According to the present invention, the extruding liquid passage and the wash fluid passage of the paint cartridge are separately provided in the casing.

With the arrangements just described, the wash fluid running through the wash fluid passage can be prevented from mixing into the extruding liquid flowing through the extruding liquid passage.

According to the present invention, the extruding liquid passage and the wash fluid passage of the paint cartridge are provided with a common inlet port, and the wash fluid valve is arranged in the form of a change-over valve adapted to switch the common inlet port either to the extruding liquid passage or the wash fluid passage.

With the arrangements just described, a paint cartridge to be refilled with paint is set on and connected to a replenishing stool of the paint replenisher. In this state, the common inlet port is switched to the side of the extruding liquid passage by the change-over valve and communicated with the extruding liquid chamber of the cartridge through the extruding liquid passage. Therefore, the extruding liquid allowed to flow into or out of the extruding liquid chamber. On the other hand, when the common inlet port is switched to the side of the wash fluid passage by the change-over valve, it is brought into communication with the paint chamber of the paint cartridge through the wash fluid passage to feed the extruding liquid to the paint chamber as a wash fluid thereby to wash away deposited paint from the paint chamber and feed tube of the cartridge.

According to the present invention, the wash fluid valve of the cartridge is arranged in the form of a check valve adapted to be opened when the wash fluid is circulated toward the paint chamber through the wash fluid passage and closed when paint is flowing toward the feed tube from the paint chamber.

With the arrangements just described, after a paint cartridge is set on and connected to a replenishing stool of the paint replenisher, the check valve is opened when a wash fluid is circulated through the wash fluid passage in the direction toward the paint chamber. In this case, the wash fluid is introduced into the paint chamber to wash away deposited paint therefrom. On the other hand, at the time of delivering paint in the paint chamber through the feed tube, the check valve is closed to block reverse paint flow toward the wash fluid passage from the paint chamber. As a result, paint leaks through the wash fluid passage can be prevented by the check valve.

According to the present invention, the paint chamber of the cartridge is formed as a space of a substantially circular shape in cross-section, and the wash fluid passage of the cartridge is opened tangentially toward inner periphery of the paint chamber.

With the arrangements just described, the wash fluid from the wash fluid passage is introduced into the paint chamber in a tangential direction with respect to the inner periphery of the paint chamber. Therefore, thanks to the vortices of the wash fluid which are formed within the paint chamber, paint in the paint chamber can be washed off effectively in a more efficient manner.

According to the present invention, a spacer member or members are provided on a bottom surface of the paint chamber or on the movable partition wall to leave a gap space for circulation of the wash fluid between the bottom surface of the paint chamber and the movable partition wall when the latter is moved toward the feed tube.

With the arrangements just described, the breadth of the washing space of the paint chamber can be reduced by a displacement of the movable partition wall toward the feed tube. On such an occasion, a gap space suitable for circulation of a wash fluid is secured by the spacer member between a bottom surface of the paint chamber and the movable partition wall to ensure an efficient washing operation.

According to the present invention, the sprayer unit is mounted on a coating action mechanism at the time of performing a coating operation, and an extruding liquid passage is provided in the coating action mechanism for communication with the extruding liquid passage on the side of the paint cartridge, the extruding liquid passage on the side of the coating action mechanism being connected to an extruding liquid feeder to send an extruding liquid to the paint cartridge attached to the sprayer unit.

With the arrangements just described, a replenished paint cartridge is attached to the sprayer unit prior to a coating operation. Then, the extruding liquid from the extruding liquid feeder is supplied to the extruding liquid chamber of the cartridge through the extruding liquid passage on the side of the coating action mechanism and the extruding liquid passage on the side of the paint cartridge, thereby displacing the movable partition wall forward to push paint in the paint chamber forward and spurt the paint to the rotary atomizing head of the sprayer unit through the feed tube. In the meantime, the coating action mechanism is put in action to perform a predetermined coating operation.

According to the present invention, there is provided a cartridge type coating system which is characterized in that: the paint cartridges are each provided with a common inlet port opened in an outer peripheral portion of the container, an extruding liquid passage connecting the common inlet port with the extruding liquid chamber, a wash fluid passage connecting the common inlet port with the paint chamber, and a change-over valve adapted to switch the common inlet port either to the extruding liquid passage or to the wash fluid passage; and the paint replenisher is provided with a selector valve having the inlet side thereof connected to the extruding liquid feed/discharge valve and the wash air supply valve and the outlet side thereof connected to the replenishing stool and adapted to connect either the extruding liquid feed/discharge valve or the wash air supply valve selectively to the common inlet port of the cartridge.

With the arrangements just described, a paint cartridge to be refilled with paint is set on and connected to a replenishing stool of the paint replenisher. In this state, if the change-over valve is switched to the side of the extruding liquid passage, the common inlet port is communicated with the extruding liquid chamber of the cartridge through the extruding liquid passage, and the extruding liquid from the extruding liquid feed/discharge valve is allowed to flow into or out of the extruding liquid chamber.

On the other hand, when the change-over valve is switched to the side of the wash fluid passage, the common inlet port is communicated with the paint chamber of the cartridge through the wash fluid passage, whereupon wash air from the wash air supply valve is introduced into the paint chamber to purge paint from the paint chamber and the feed tube. Further, by supplying extruding liquid from the extruding liquid feed/discharge valve to the paint chamber as a wash fluid, deposited paint in the paint chamber and the feed tube can be washed away by the supplied extruding liquid.

According to the present invention, there is provided a cartridge type coating system which is characterized in that the cartridge gripper mechanism is provided with a gripper for gripping the paint cartridge, and a wash fluid passage formed in the gripper and adapted to be connected to the wash fluid passage on the side of the cartridge when the latter is gripped on the gripper, an upstream end of the wash fluid passage in the gripper being connected to a wash fluid supply valve which supplies a wash fluid to the paint chamber of the cartridge.

With the arrangements just described, by means of the cartridge gripper mechanism, a paint cartridge which is attached to the sprayer unit can be gripped and removed therefrom and then set on a replenishing stool of the paint replenisher. In a case where the paint chamber of the cartridge is to be washed, the paint cartridge is left in the gripped state, with the wash fluid passage on the side of the gripper connected with the wash fluid passage on the side of the paint cartridge. In this state, wash fluid from the wash fluid supply valve can be introduced to the paint chamber through the wash fluid passage on the side of the gripper and the wash fluid passage on the side of the paint cartridges to wash away deposited paint from the paint chamber and feed tube of the cartridge.

According to the present invention, there is provided a cartridge type coating system which is characterized by the provision of a cartridge gripper mechanism for gripping and transferring a paint cartridge to and from the sprayer unit and the paint replenisher, the cartridge gripper mechanism being provided with a pilot air passage for supply pilot air to the wash fluid valve when the cartridge is gripped on the cartridge gripper mechanism.

With the arrangements just described, by means of the cartridge gripper mechanism, a paint cartridge which is attached to the sprayer unit can be gripped and removed therefrom, and then set on a replenishing stool of the paint replenisher. In a case where the paint chamber of the cartridge is to be washed, the paint cartridge is left in the gripped state. In this state, as soon as pilot air is supplied to the wash fluid valve of the cartridge through the pilot air passage on the side of the cartridge gripper mechanism, the wash fluid valve is opened, supplying a wash fluid to the paint chamber and thereby washing away deposited paint from the paint chamber and the feed tube of the cartridge.

BEST MODE FOR CARRYING OUT THE INVENTION

Figure 1:
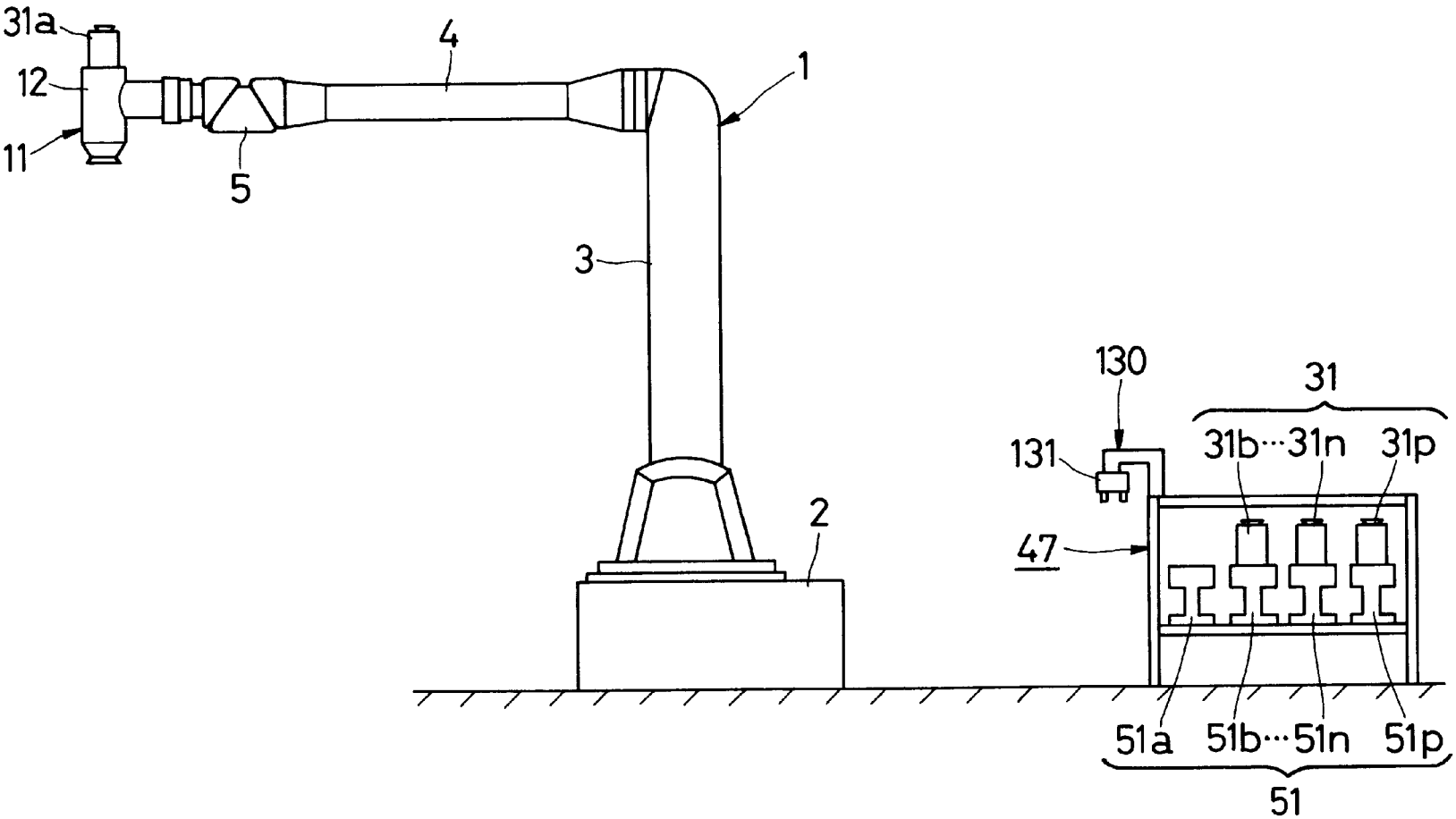
FIG. 1 is a front view of a cartridge type coating system according to a first embodiment of the present invention.

Hereafter, the cartridge type coating system according to the present invention is described more particularly by way of its preferred embodiments employing a coating robot and a rotary atomizing head type sprayer unit.

Referring first to FIGS. 1 through 16, there is shown a first embodiment of the present invention. In these figures, indicated at 1 is a coating robot serving as a coating action mechanism which carries and puts in action a rotary atomizing head type coating machine 11, which will be described hereinlater, to perform a predetermined coating operation. The coating robot 1 is largely constituted by a base 2, a vertical arm 3 which is pivotally supported on the base 2, a horizontal arm 4 which is pivotally connected to an upper end portion of the vertical arm 3, and a wrist portion 5 which is provided at the distal end of the horizontal arm 4.

Figure 2:
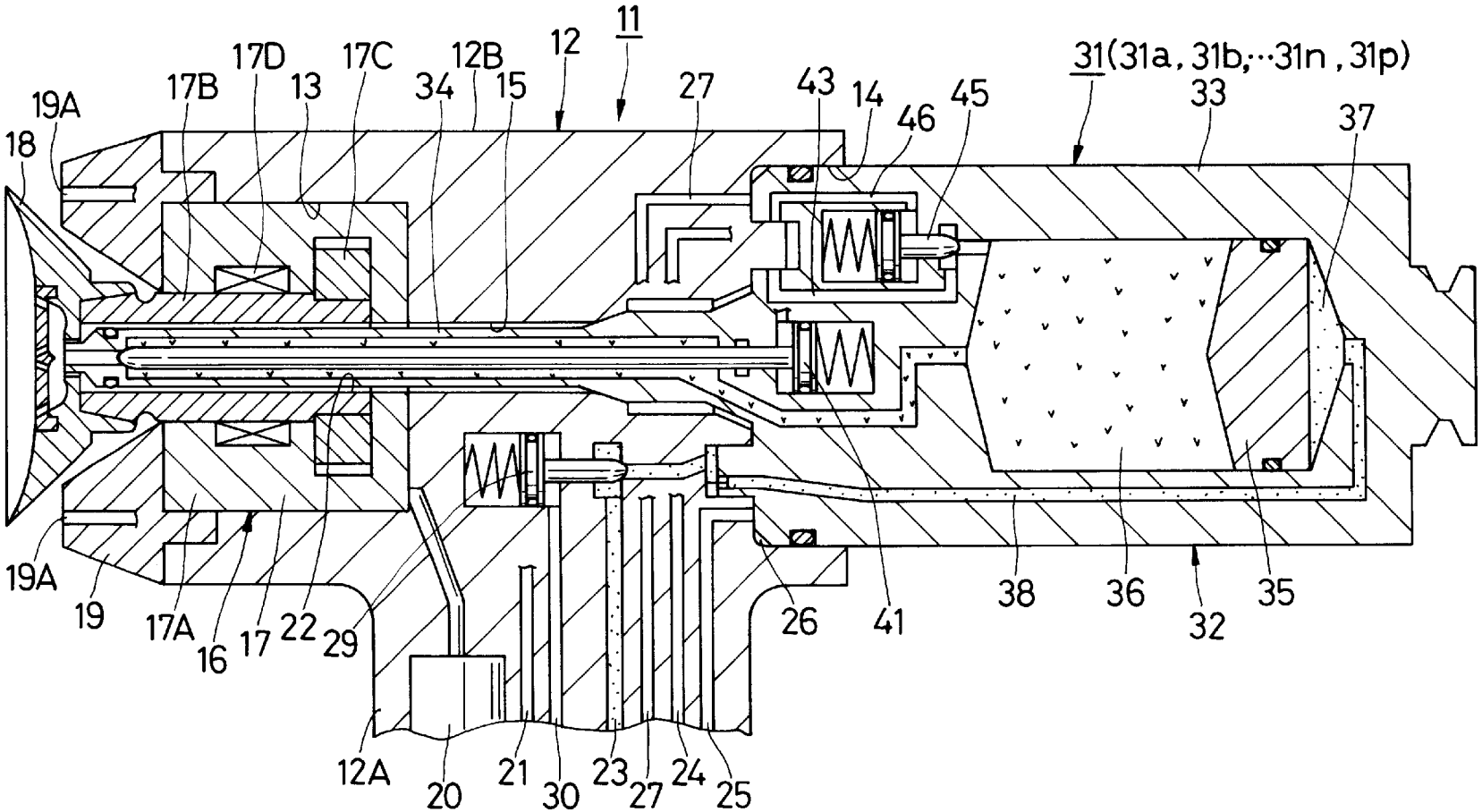
FIG. 2 is a longitudinal sectional view on an enlarged scale, showing a rotary atomizing head in FIG. 1.

Indicated at 11 is the rotary atomizing head type coating machine (hereinafter referred to simply as "coating machine" for brevity) which is mounted on the coating robot 1. As shown in FIG. 2, the coating machine 11 is largely constituted by a housing 12, feed tube passage holes 15 and 22, a sprayer unit 16 and a paint cartridge 31.

The housing 12 is formed of, for example, engineering plastics such as PTFE, PEEK, PEI, POM, PI and PET, and attached to a distal end of the wrist portion 5. This housing 12 is largely constituted by a neck portion 12A which is detachably attached to a distal end of the wrist portion 5, and a head portion 12B which is formed integrally and contiguously at a fore end of the neck portion 12A.

Figure 4:
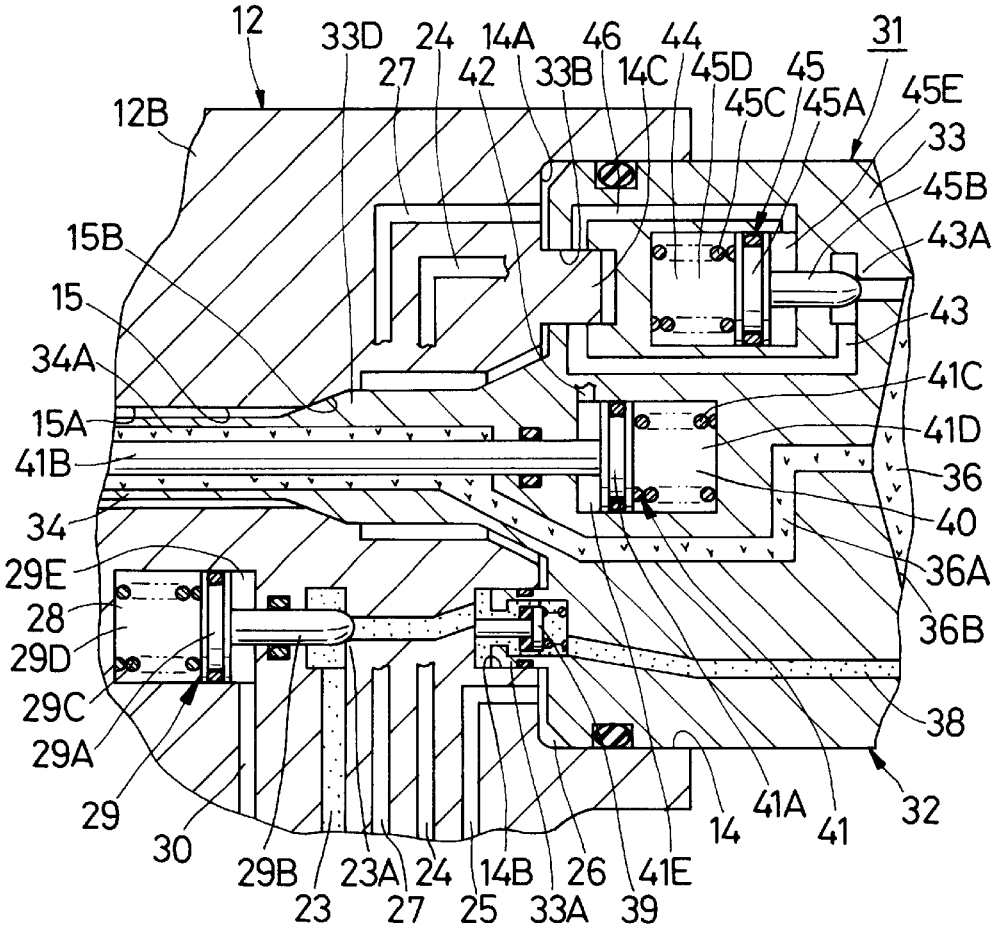
FIG. 4 is a fragmentary longitudinal sectional view on an enlarged scale, showing major component parts such as a paint valve, a thinner valve and a quick joint in FIG. 2.

In this instance, a sprayer unit mount portion 13 in the form of a cylindrical cavity is provided on the front side of the head portion 12B, while a cartridge mount portion 14 similarly in the form of a cylindrical cavity is provided on the rear side of the neck portion 12B. Further, as shown in FIG. 4, a female coupling portion 14B and a projection 14C are separately provided at the bottom 14A of the cartridge mount portion 14 for fitting engagement with a male coupling portion 33A and a female coupling portion 33B on the side of a cartridge casing 33 which will be described hereinafter. The female coupling portion 14B and projection 14C on the cartridge mount portion 14 serve to orient a cartridge casing 33 into position in the circumferential direction as the cartridge casing 33 is set in the cartridge mount portion 14.

Indicated at 15 is a feed tube passage hole on the side of the housing, which is provided between and in communication with the sprayer unit mount portion 13 and the cartridge mount portion 14 of the housing 12. This feed tube passage hole 15 on the side of the housing 12 includes a feed tube passage portion 15A of a small diameter, which is provided on the front side, and a forwardly converging conical bore portion 15B which is provided on the rear side thereof. In this instance, the feed tube passage portion 15A is formed in coaxial relation with a feed tube passage hole 22 on the side of the sprayer unit, which will be described hereinlater. Further, the conical bore portion 15B is brought into fitting engagement with a conical projection 33D on a cartridge casing 33, which will be described later, for orienting the cartridge casing 33 into position in axial and radial directions.

Indicated at 16 is a sprayer unit which is set in the sprayer unit mount portion 13 of the head portion 12B. As shown in FIG. 2, the sprayer unit 16 is largely constituted by an air motor 17 including a motor case 17A, a rotational shaft 17B, an air turbine 17C and an air bearing 17D, a rotary atomizing head 18 which is rotated by the air motor to centrifugally atomize supplied paint and spray finely atomized paint particles toward a work piece, and a shaping air ring 19 which is provided on the front side of the air motor 17. The shaping air ring 19 is bored with a multitude of forwardly opened, shaping air outlet holes 19A (only two shaping air outlet holes shown in the drawing) in and around its outer peripheral portions. Through these shaping air outlet holes 19A, shaping air is spurted toward paint releasing edges of the rotary atomizing head 18 to shape a spray pattern of paint particles which are released from the rotary atomizing head 18.

Indicated at 20 is a high voltage generator which is provided in the neck portion 12A of the housing 12. This high voltage generator 20 is constituted, for example, by a Cockcroft circuit which is adapted to elevate a source voltage from a power source (not shown), for example, to a level of from −60 kv to −120 kv. The output side of the high voltage generator 20 electrically connected to the air motor 17, so that high voltage is applied from the high voltage generator 20 to the rotary atomizing head 18 through the rotational shaft 17B of the air motor 17 for directly charging paint particles.

Designated at 21 are a plural number of air passages which are provided in the neck portion 12A of the housing 12 and connected to a control air source (not shown). These air passages 21 supply turbine air for controlling the air motor 17, bearing air, braking air, and shaping air for shaping the paint spray pattern. However, in the case of the present embodiment, only one air passage is shown to represent all of other air passages as mentioned above.

Indicated at 22 is a feed tube passage hole on the side of the sprayer unit, which is provided axially through the rotational shaft 17B of the air motor 17. This feed tube passage hole 22 on the side of the sprayer unit has its base end opened into the feed tube passage portion 15A of the feed tube passage hole 15 on the side of the housing 12, and has its fore end opened into the rotary atomizing head 18. Further, the feed tube passage hole 22 on the side of the sprayer unit is formed in coaxial relation with the feed tube passage portion 15A of the feed tube passage hole 15 on the side of the housing. A feed tube 34 of a paint cartridge 31 is extractably passed into and received in these feed tube passage holes 15 and 22.

Indicated at 23 is a thinner passage which is provided in the housing 12, that is, an extruding thinner passage which is provided on the side of the housing as an extruding liquid passage on the side of the coating action mechanism. This extruding thinner passage 23 is extended axially through the neck portion 12A and bent rearward in L-shape at a position on the front side of the female coupling portion 14B. One end of the extruding thinner passage 23 is connected to an extruding thinner feeder (not shown) which supplies extruding thinner toward the paint cartridge 31, while the other end is opened into the bottom of the female coupling portion 14B of the cartridge mount portion 14. The bent portion of the extruding thinner passage 23 on the side of the housing is formed into a valve seat portion 23A for a valve member 29B of a thinner valve 29, which will be described hereinlater.

Denoted at 24 is a pilot air passage which is provided in the housing 12. This pilot air passage 24 on the side of the housing has its one end connected to a paint valve pilot air source through pilot air piping (both not shown). The other end of the pilot air passage 24 is opened into another male coupling portion (not shown) which is provided at the bottom 14A of the cartridge mount portion 14 at a corresponding position with respect to a pilot air passage 42, which will be described hereinlater.

Indicated at 25 is an air suction passage which is provided in the housing 12 and opened at the bottom portion 14A of the cartridge mount portion 14. This air suction passage 25 is connected to a vacuum generator through vacuum piping (both not shown). The air suction passage 25 functions to suck air out of a vacuum space 26 (shown in FIG. 4) which is defined at a depth of the cartridge mount portion 14 and on the inner side of a casing 33 of a paint cartridge 31, thereby to grip the paint cartridge firmly in the cartridge mount portion 14 by suction force.

Further, denoted at 27 is an ejection air passage which is provided in the housing 12 and opened at the bottom 14A of the cartridge mount portion 14. This ejection air passage 27 is connected to an ejection air source through air piping (both not shown). The ejection air passage 27 functions to supply air to the above-mentioned vacuum space 26 to cancel the suction grip on the paint cartridge 31, permitting to remove or unload same from the cartridge mount portion 14.

Indicated at 28 is a thinner valve receptacle portion which is provided in the head portion 12B of the housing 12. This thinner valve receptacle portion 28 is located at a position on the outer side of the feed tube passage hole 15 on the side of the housing.

Indicated at 29 is a thinner valve which is provided in the thinner valve receptacle portion 28. This thinner valve 29 is arranged as a normally closed valve, and constituted by a piston member 29A which is slidably received in the thinner valve receptacle portion 28, an elongated valve member 29B which is connected the piston member 29A at its base end and extended through the extruding thinner passage 23 on the side of its fore end to be seated on and off the valve seat portion 23A, a valve spring 29C which is adapted to urge the valve member 29B to seat on the valve seat portion 23A through the piston member 29A. Further, by the piston member 29A, the thinner valve receptacle portion 28 is divided into a spring chamber 29D which accommodates the valve spring 29C and a pressure receiving chamber 29E which receives pilot air.

Normally, under the influence of the biasing action of the valve spring 29C, the valve member 29B of the thinner valve 29 is seated on the valve seat portion 23A of the extruding thinner passage 23 on the side of the housing, blocking the extruding thinner passage 23 to suspend thinner supply to an extruding thinner chamber 37 in a paint cartridge 31, which will be described hereinafter. On the other hand, as soon as pilot air is supplied to the pressure receiving chamber 29E from a thinner valve pilot air source through pilot air piping (both not shown) and pilot air passage 30, the valve member 29B is unseated from the valve seat portion 23A against the action of the valve spring 29C to supply thinner to the extruding thinner chamber 37. In this instance, one end of the pilot air passage 30 is connected to the thinner valve pilot air source through pilot air piping, while the other end is connected to the pressure receiving chamber 29E of the thinner valve 29.

Figure 3:
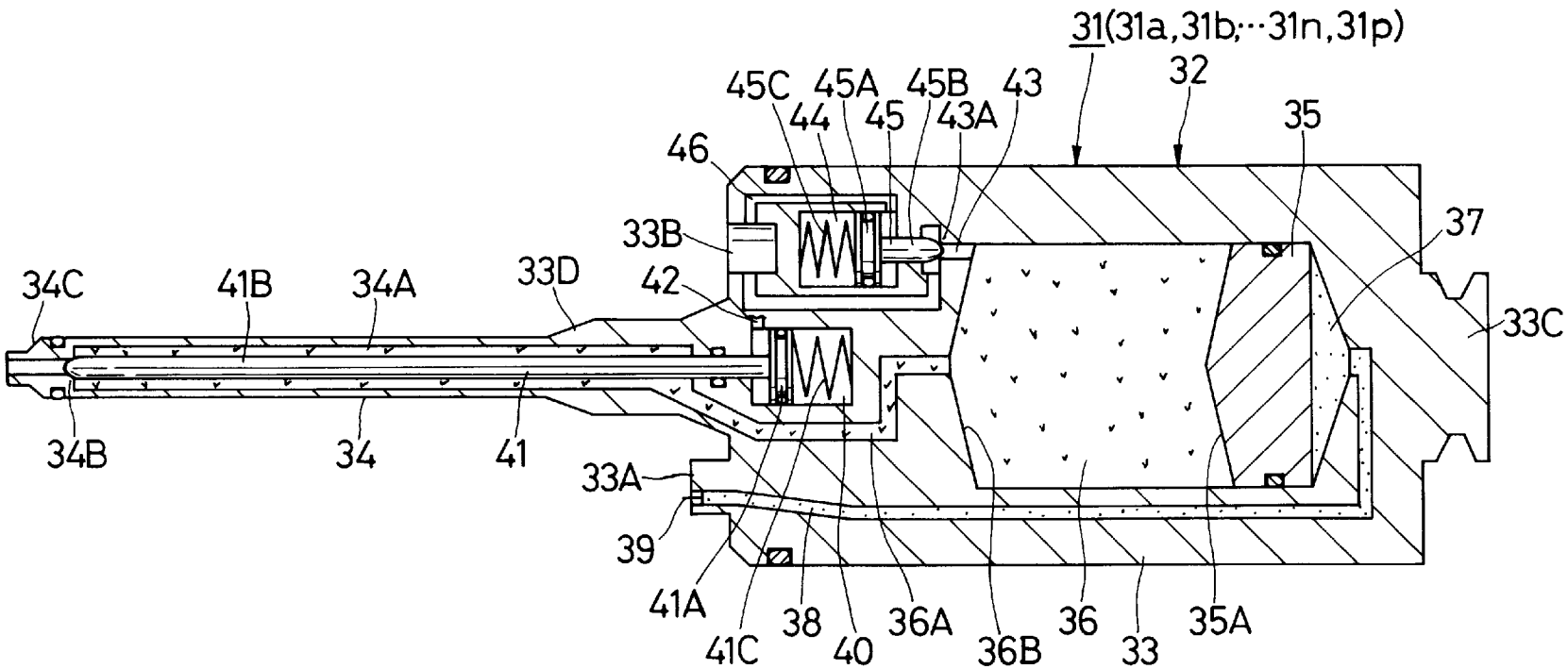
FIG. 3 is a longitudinal sectional view on an enlarged scale, showing a paint cartridge in FIG. 1 as a separate unit.

Indicated at 31*a*, 31*b*, . . . 31*n* and at 31*p* are paint cartridges which are filled with different paint colors a, b, . . . n and other paint colors, (hereinafter collectively referred to as "paint cartridges 31" for brevity), for supply to the rotary atomizing head 18. As shown in FIG. 3, these paint cartridges 31 are each largely constituted by a casing 32, piston 35, an extruding thinner passage 38 on the side of the cartridge, and a wash fluid valve 45, which will be described hereinlater.

In this instance, the paint colors a, b, . . . n are exclusive colors which are used relatively at a high frequency, and exclusively have paint cartridges 31*a*, 31*b*, . . . 31*n*, respectively. On the other hand, paint colors r, s, . . . z are colors which are used at a relatively low frequency, and have one common paint cartridge 31*p*.

Indicated at 32 is the cartridge casing which determines the outer shape of each paint cartridge 31. Similarly to the housing, the casing 32 is formed of an engineering plastics, and is largely constituted by a container 33 and a feed tube 34, which will be described later.

Denoted at 33 is the container which forms a main part of the casing 32. More specifically, the container 33 is in the shape of a cylinder of a diameter which can be fitted into and out of the cartridge mount portion 14 of the housing. Provided at the front end of the container 33 are a male coupling portion 33A and a female coupling portion 33B, which are located in corresponding positions with respect to the female coupling portion 14A and the projection 14C on the side of the cartridge mount portion 14. Further, provided at the rear end of the container 33 is a grip portion 33C to be gripped at the time of replacing the paint cartridge 31. Further, a conical projection 33D is provided centrally at the front end of the container 33.

In this instance, the male coupling portion 33A and female coupling portion 33B are provided for orienting the container 33 into position in the circumferential or radial direction when setting same in the cartridge mount portion 14 of the housing 12. Likewise, the male coupling portion 33A and female coupling portion 33B serve to orient the container 33 into position in the radial direction at the time of mounting same on a container support portion 57 of a paint replenisher 51 or 119, which will be described hereinafter.

On the other hand, the conical projection 33D serves to orient the container 33 into position in the axial direction within the cartridge mount portion 14 of the housing 12 by fitting engagement with the conically converging cavity 15B. Similarly, the conical projection 33D serves to orient the container 33 of the paint cartridge 31 into position in the axial and radial directions on the container support portion 57 of the paint replenisher 51 or 119 by fitting engagement with a conically converging cavity portion 56A of a feed tube passage hole 56 on the side of the paint replenisher, which will be described hereinafter.

Further, indicated at 34 is the feed tube which is extended forward from a fore distal end of the conical projection 33D of the container 33. A paint passage 34A is formed coaxially and internally of the feed tube 34. The base or rear end of the paint passage 34A is connected to a paint chamber 36, which will be described hereinlater, while its fore end is opened toward the rotary atomizing head 18. Further, the paint passage 34A is provided with a valve seat portion 34B in the fore end portion of the feed tube 34, and the valve seat portion 34B is formed by partly reducing the diameter of the inner periphery of its fore end portion. As described hereinlater, a valve member 41B of a paint valve 41 is seated on and off the valve seat portion 34A of the paint passage 34. Further, the feed tube 34 is provided with a forwardly converging conical surface 34C around the outer periphery of its fore end portion. This conical surface 34C serves to orient the fore end of the feed tube 34 into a center position within a connector member 59 by fitting engagement with a conical surface 59C on the side of the connector member 59, which will be described hereinafter. The feed tube 34 is arranged in such a length that its fore end is extended into the rotary atomizing head 18 when the paint cartridge 31 is set in the cartridge mount portion 14 of the housing 12.

In this instance, the feed tube 34 serves to circulate paint, which is supplied from the paint chamber 36, through its paint passage 34A, and to spout the paint toward the rotary atomizing head 18. In addition, at the time of replenishing paint into the paint chamber 36, the fore end of the feed tube 34 is connected to the connector member 59 to serve as a replenishing port.

On the other hand, indicated at 35 is a piston which is slidably fitted in the container 33. The piston 35 divides the container 33 into a paint chamber 36 which is in communication with the paint supply passage 34A of the feed tube 34 through a communication passage 36A, and an extruding thinner chamber 37 which holds thinner therein as a paint-extruding liquid.

In this instance, on the side of the feed tube 34, the paint chamber 36 is provided with a bottom surface 36B which is gradually deepened toward its center. The afore-mentioned communication passage 36A is opened in the bottom surface 36B, while a wash fluid passage 43 is opened in an outer peripheral portion of the bottom surface 36B, as described hereinafter. Further, the piston 35 is provided with a gradually converging end face 35A on the side of the feed tube 34 correspondingly to the gradually deepened bottom surface 36B of the paint chamber 36.

Indicated at 38 is an extruding thinner passage on the side of the paint cartridge. This extruding thinner passage 38 is extended axially through an outer peripheral portion of the container 33, and has one end thereof opened in a fore distal end face of the male coupling portion 33A of the container 33 and the other end communicated with the extruding thinner chamber 37. The extruding thinner passage 38 on the side of the paint cartridge serves to supply thinner to the extruding thinner chamber 37 thereby to push the piston 35 toward the feed tube 34 to extrude paint in the paint chamber 36 toward the rotary atomizing head 18.

Thinner to be used as an extruding liquid should be of an insulating type or a high electrical resistance type in order to prevent leaks through thinner of high voltage which is applied from the high voltage generator 20. The use of thinner as an extruding liquid contributes to prevent paint from drying up and solidifying on inner wall surfaces of the container 33 as the piston 35 is displaced therealong, that is to say, contributes to keep inner wall surfaces of the container 33 always in a wet state, stabilizing the frictional resistance between the piston 35 and inner wall surfaces of the container 33 and as a result ensuring smooth movements of the piston 35. It also contributes to enhance the tightness of the seal between the piston 35 and inner wall surface of the container 33.

Figure 5:
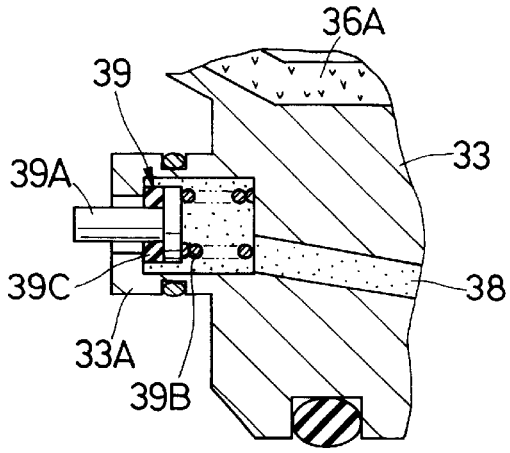
FIG. 5 is a fragmentary longitudinal sectional view on an enlarged scale, showing the quick joint of FIG. 4 in a closed state.

Indicated at 39 is a quick joint on the side of the paint cartridge, which is provided in the male coupling portion 33A of the container 33, more specifically, within an outer open end of the thinner passage 38. This quick joint 39 is arranged as a check valve including the afore-mentioned male coupling portion 33A of the container 33. As shown in FIG. 5, the quick joint 39 is largely constituted by the male coupling portion 33A, a valve member 39A of a stepped cylindrical shape having a fore end portion projected forward from the male coupling portion 33A, a coil spring 39B which is adapted to urge the valve member 39A in a projecting direction, and a resilient ring 39C of rubber or the like which is fitted on the outer periphery of the valve member 39 for sealing a gap between the male coupling portion 33A and the valve member 39A.

Further, as a paint cartridge 31 is set in the cartridge mount portion 14 bringing the male coupling portion 33A into fitting engagement with the female coupling portion 14B as shown in FIG. 4, the valve member 39A of the quick joint 39 is abutted against a bottom portion of the female coupling portion 14B and opened, and as a result the extruding thinner passage 38 on the side of the paint cartridge and the extruding thinner passage 23 on the side of the housing are communicated with each other to permit circulation of thinner.

On the other hand, when the cartridge container 33 is removed from the cartridge mount portion 14 disengaging the male coupling portion 33A from the male coupling portion 14B as shown in FIG. 5, the valve member 39A is pressed against the resilient ring 39C by the action of the coil spring 39B to close the extruding thinner passage 38 on the side of the paint cartridge, preventing thinner from flowing out from the extruding thinner passage 38. The quick joint 39 is also put in similar opening or closing actions at the time when the paint cartridge 31 is mounted on or dismantle from a container support portion 57 of a paint replenishing stool 52 which will be described hereinafter.

Indicated at 40 is a paint valve receptacle cavity portion which is provided in the container 33. The paint valve receptacle portion 40 is located in a position on a center axis of the container 33 between the feed tube 34 and the paint chamber 36.

Denoted at 41 is a paint valve which is provided in the paint valve receptacle portion 40. Similarly to the above-described thinner valve 29, this paint valve 41 is arranged as a normally closed valve, and constituted by a piston member 41A which is slidably fitted in the paint valve receptacle portion 40, an elongated valve member 41B which is connected the piston member 41A at its base end and extended through the paint passage 34A of the feed tube 34 on the side of its fore end for seating on and off the valve seat portion 34B, a valve spring 41C which is adapted to urge the valve member 41B to seat on the valve seat portion 34B through the piston member 41A. Further, by the piston member 41A, the paint valve receptacle portion 40 is divided into a spring chamber 41D which accommodates the valve spring 41C and a pressure receiving chamber 41E which receives pilot air.

Normally, the valve member 41B of the paint valve 41 is seated on the valve seat portion 34B in the feed tube 34 under the influence of the biasing action of the valve spring 41C, blocking the paint passage 34A to suspend paint supply to the rotary atomizing head 18. On the other hand, as soon as pilot air is supplied to the pressure receiving chamber 41E from a paint valve pilot air source through pilot air piping (both not shown) through the pilot air passage 24 on the side of the housing and the pilot air passage 42 on the side of the paint cartridge, the valve member 41B is unseated from the valve seat portion 34B against the action of the valve spring 41C to supply paint in the paint chamber 36 toward the rotary atomizing head 18. In this instance, one end of the pilot air passage 42 is opened in an inner peripheral surface of another female coupling portion (not shown) which is provided separately from the female coupling portion 33B of the cartridge container 33, while the other end of the pilot air passage 42 is communicated with the pressure receiving chamber 41E of the paint valve 41.

Indicated at 43 is a wash fluid passage on the side of the paint cartridge, more specifically, which is provided in the container 33 of the paint cartridge 31. One end of this wash fluid passage 43 is opened in an inner peripheral surface of the female coupling portion 33B, while the other end is communicated with the paint chamber 36 through an outer peripheral portion of the bottom surface 36B. In this instance, provided at the other end of the wash fluid passage 43 on the side of the paint cartridge is a valve seat portion 43A to be seated on and off by a valve member 45B of a wash fluid valve 45, which will be described hereinafter.

Denoted at 44 is a valve receptacle portion which is provided in the container 33. This valve receptacle portion 44 is located on the outer side of the paint valve receptacle portion 40.

Indicated at 45 is a wash fluid valve which is provided in the valve receptacle portion 44. Similarly to the above-described thinner valve 29, this wash fluid valve 45 is arranged as a normally closed valve, and constituted by a piston 45A which is slidably received in the valve receptacle portion 44, a valve member 45B which is connected to the piston 45A at one end and extended into the wash fluid passage 43 on the side of the paint cartridge at its fore end for seating on and off a valve seat portion 43A, and a valve spring 45C biasing the valve member 45B to seat on the valve seat portion 43A through the piston 45A. Further, by the piston 45A, the valve receptacle portion 44 is divided into a spring chamber 45D which accommodates the valve spring 45C, and a pressure receiving chamber 45E which receives pilot air.

Normally, the valve member 45B of the wash fluid valve 45 is seated on the valve seat portion 43A of the wash fluid passage 43 on the side of the paint cartridge, blocking the wash fluid passage 43 to prevent paint in the paint chamber 36 from leaking out through the wash fluid passage 43. On the other hand, when a paint cartridge 31 is set on a paint replenisher 51 or 119, which will be described hereinafter, and pilot air is supplied to the pressure receiving chamber 45E from a wash fluid valve pilot air source 118 through pilot air piping 117 and pilot air passage 46 on the side of the paint cartridge, the valve member 45B is opened against the action of the valve spring 45C to permit circulation of thinner and air to the paint chamber 36 of the cartridge.

In this instance, one end of the pilot air passage 46 on the side of the paint cartridge is connected to the wash fluid valve pilot air source 118 through a pilot air passage 116 on the side of a paint replenishing stool and pilot air piping 117, while the other end is communicated with the pressure receiving chamber 45E of the wash fluid valve 45.

On the other hand, indicated at 47 is a cartridge changer, which is provided in a coating booth, at a position in the vicinity of the coating robot 1 (see FIG. 1). In this instance, the cartridge changer 47 is largely constituted by paint replenishers 51 and 119 which serve to refill a paint chamber 36 of a paint cartridge 31 which has been consumed by a coating operation, and a cartridge gripper mechanism 130 which serves to grip and transfer a paint cartridge 31 between the cartridge mount portion 14 on the housing 12 and the paint replenisher 51 or 119. Further, a rotary atomizing head washer (not shown), which washes deposited paint off a rotary atomizing head 18, is located in the vicinity of a paint cartridge pickup position of the cartridge gripper mechanism 130.

Now, referring to FIGS. 6 to 13, there is shown a paint replenisher which constitutes part of the cartridge changer 47 as described below.

Indicated at 51*a*, 51*b*, . . . 51*n* are paint replenishers for different paint colors a, b, . . . n (hereinafter collectively referred to as "paint replenishers 51" for brevity) which are provided on the cartridge changer 47. These paint replenishers 51 serve to replenish frequently used exclusive colors a, b, . . . n into corresponding paint cartridges 31. Each one of paint replenishers 51 is largely constituted by a replenishing stool 52, feed tube passage hole 56 on the side of the replenishing stool, a connector member 59, a replenishing valve 61, an extruding thinner feed/discharge valve 86 and a wash fluid feed valve 101, which will be described hereinafter.

Denoted at 52*a*, 52*b*, . . . 52*n* are replenishing stools (hereinafter collectively referred to as "replenishing stools 52" for brevity) which constitute the paint replenishers 51*a*, 51*b*, . . . 51*n*, respectively. In this instance, each one of replenishing stool 52 is largely constituted by a foot portion 53 which is securely bolted on a transverse rack plate 47A of the cartridge changer 47, a column portion 54 which rises upward from the foot portion 53, and a seat portion 55 which is formed by bulging radially outward an upper end portion of the column portion 54. In addition to the replenishing stools 52*a*, 52*b*, . . . 52*n* which are allotted to exclusive colors, the replenishing stool 52 includes a paint replenisher unit 119 with a replenishing stool 52*p* (see FIG. 13) which is allotted to less frequently used paint colors.

Indicated at 56 is the feed tube passage hole which is provided vertically through the column portion 54 of each replenishing stool 52. The feed tube 34 of a paint cartridge 31 is passed and fitted into the feed tube passage hole 56 when set on the seat portion 55. An upper portion of the feed tube passage hole 56 on the side of the replenishing stool 52 is formed into a conically converging bore portion 56A, which is brought into fitting engagement with the conical projection 33D on the side of the container 33 for orienting same into position in both axial and radial directions.

Figure 8:
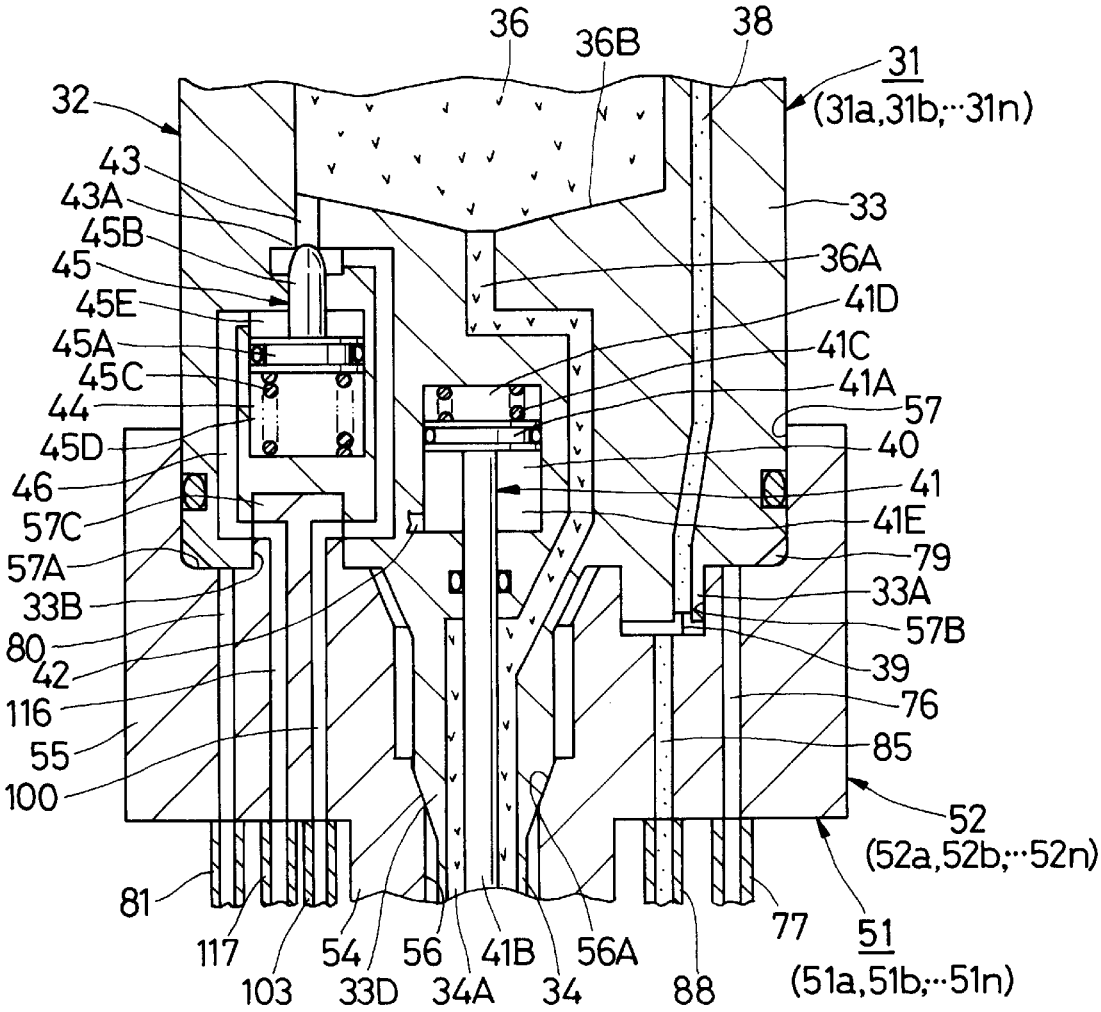
FIG. 8 is a vertical sectional view on an enlarged scale, showing details of the paint cartridge and a paint replenishing stool in FIG. 6.
Figure 9:
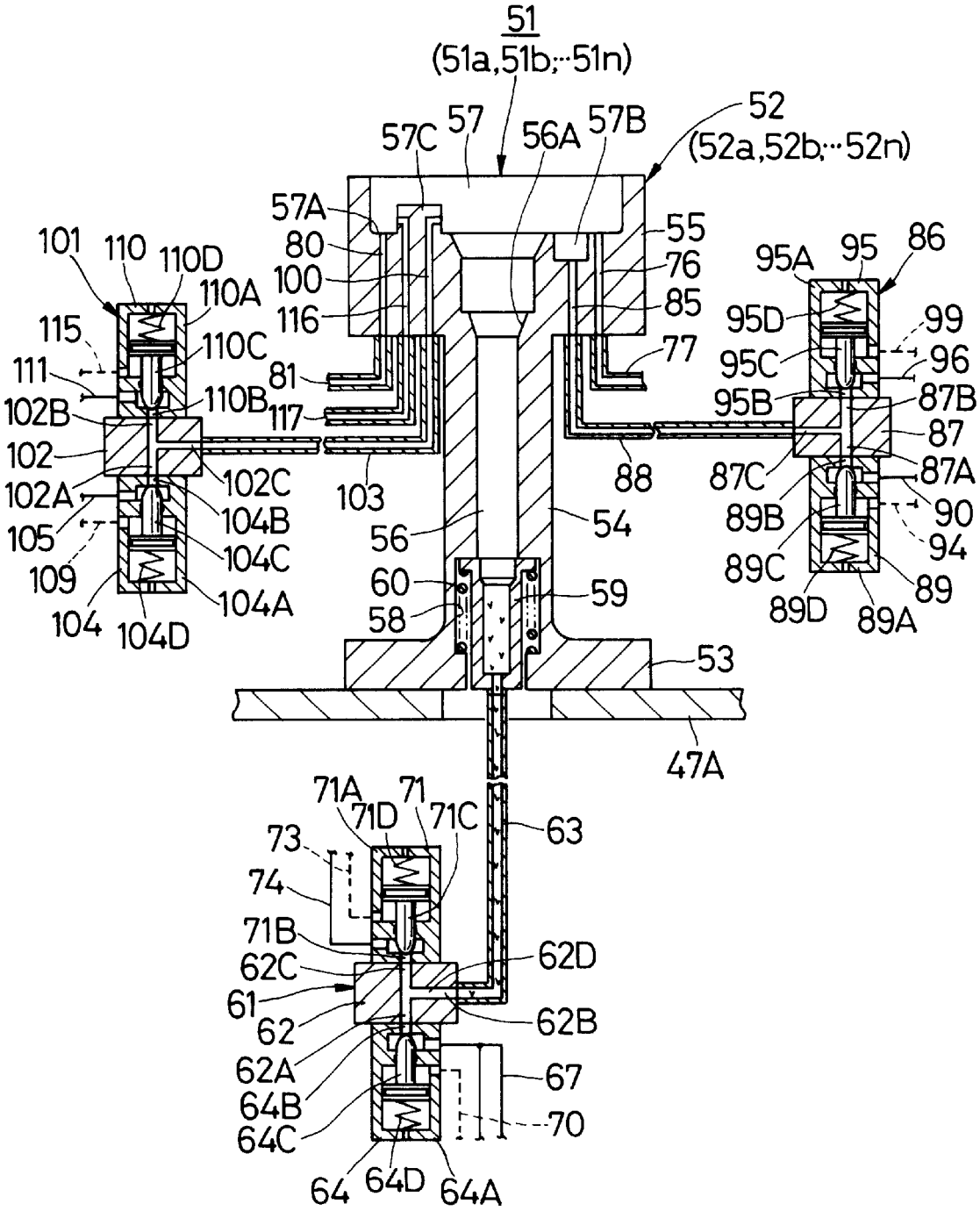
FIG. 9 is a vertical sectional view on an enlarged scale, showing the paint replenisher of FIG. 6 in an operational stage before mounting a paint cartridge thereon.

Indicated at 57 is a container support portion which is provided at one axial end (on the upper side) of the seat portion 55 of the replenishing stool 52. For receiving a container 33, the container support portion 57 is generally in the form of a cylindrical cavity which is dug into the upper side of the seat portion 55 in communication with the upper open end of the feed tube passage hole 56. Further, as shown in FIGS. 8 and 9, female and male coupling portions 57B and 57C are provided separately at the bottom 57A of the container support portion 57, for fitting engagement with the male and female coupling portions 33A and 33B on the side of the container 33, respectively. These female and male coupling portions 57B and 57C serve to orient the container 33 in the circumferential or radial directions when the latter is set on the container support portion 57.

Designated at 58 is a connector receptacle bore which is formed axially within the replenishing stool 52, at a deeper position than the feed tube passage hole 56. This connector receptacle bore 58 is formed in the shape of a cylindrical bore by widening a lower end portion of the feed tube passage hole 56. Through a stepped portion 58A, a lower end portion of the connector receptacle bore 58 is reduced in diameter to provide a smaller diameter portion which is extended downward through the foot portion of the stool 52.

Figure 7:
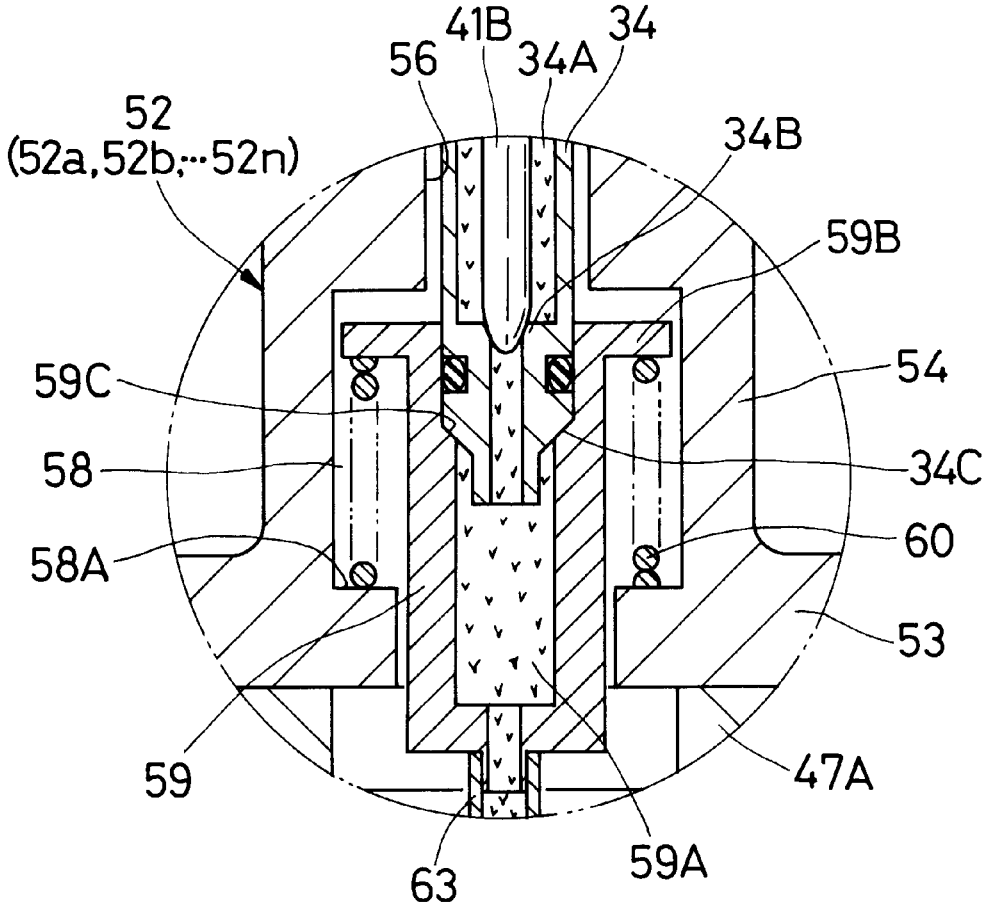
FIG. 7 is a vertical sectional view on an enlarged scale, showing a movable connector member, a coil spring and a feed tube in FIG. 6.

Indicated at 59 is a connector member which is axially movably fitted in the connector receptacle bore 58. As shown in FIG. 7, the connector member 59 is formed generally in a cylindrical shape internally having a paint passage 59A, and provided with a radially bulged spring seat 59B at its upper end. Further, the connector member 59 is provided with a conical cavity 59C in an upper end portion of the paint passage 59A as a positioning means for the feed tube. The conical cavity 59C is brought into fitting engagement with the conical projection 34C on the side of the feed tube 34 to orient a fore end of the feed tube 34 into a center position within the paint passage 59A. Further, the paint passage 59A is connected to a replenishing valve 61 through a paint hose 63, which will be described hereinafter. Upon connecting a fore end portion of the feed tube 34 to the paint passage 59A of the connector member 59, the paint passage 34A of the feed tube 34 is connected to paint circulation piping 67, which will be described later on, through the hose 63.

Indicated at 60 is a coil spring which is provided around the outer periphery of the connector member 59. This coil spring 60 is positioned between the spring seat 59B on the connector member 59 and the stepped portion 58A of the connector receptacle bore 58. Thus, by the coil spring 60, the connector member 59 is biased in the upward direction toward the feed tube passage hole 56 on the side of the replenishing stool.

In this manner, the connector member 59 is arranged to be movable in upward and downward directions, and constantly biased toward the feed tube 34 by the action of the coil spring 60. Therefore, should the feed tube 34 come to a deviated position in the vertical direction relative to the connector member 59, such a positional deviation can be absorbed by an upward or downward movement of the connector member 59. Further, by the action of the coil spring 60, the feed tube 34 can be securely brought into fitting engagement with the connector member 59.

Now, indicated at 61 is a replenishing valve which is provided in association with the connector member 59 to open and close the paint passage, for turning on and off paint circulation to a paint cartridge 31. The replenishing valve 61 is used for replenishing the afore-mentioned exclusive paint colors a, b, . . . n, and largely constituted by manifold 62, paint feed/discharge valve 64 and waste liquid discharge valve 71, which will be described hereinlater.

Denoted at 62 is a manifold which forms a casing for the replenishing valve 61, and which is constituted by a paint inlet port 62A, a paint outlet port 62B in communication with the paint inlet port 62A, a waste liquid discharge port 62C in communication with the paint outlet port 62B, and an intercommunication passage 62D which intercommunicates these ports.

Indicated at 63 is a paint hose which is connected between the replenishing valve 61 and the connector member 59 to form part of the paint passage. The paint hose 63 if formed of a flexible material, and its one end is connected to the paint outlet port 62B of the manifold 62 while the other end is connected to the paint passage 59A of the connector member 59.

Figure 12:
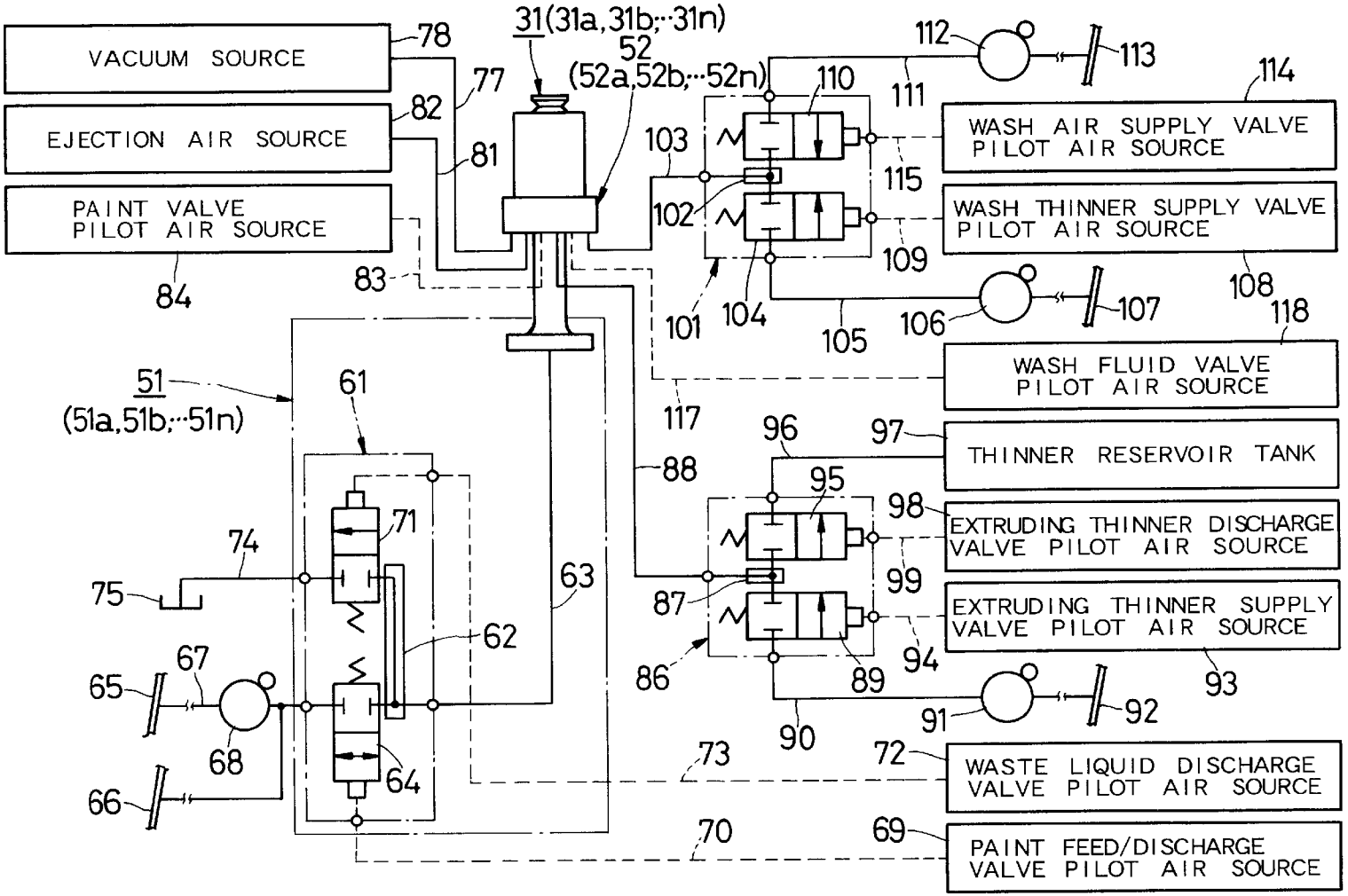
FIG. 12 is a circuit diagram of a paint replenisher for exclusive paint colors which are used at a relatively high frequency.

Denoted at 64 is the paint feed/discharge valve which is attached to the manifold 62. The paint feed/discharge valve 64 is largely constituted by a casing 64A, a paint inlet port 64B which is provided in the casing 64A and connected to the paint inlet port 62A of the manifold 62, a valve member 64C which is slidably received in the casing 64A slidably to open and close the paint inlet port 64B, and a valve spring 64D which is adapted to bias the valve member 64C constantly in a closing direction. Further, as shown in FIGS. 9 and 12, the paint inlet port 64B is connected to a paint circulating pipe 67 which intercommunicates a paint supply line 65 and a paint return line 66. Provided within the length of the paint circulating pipe 67 is a pressure regulator 68, at a position between the paint supply line 65 and the paint feed/discharge valve 64. Furthermore, the paint feed/discharge valve 64 is connected to a paint feed/discharge valve pilot air source 69 through pilot air piping 70 to open the valve member 64C against the biasing action of the valve spring 64D.

Normally, under the influence of the biasing action of the valve spring 64D, the valve member 64C of the paint feed/discharge valve 64 is retained in a closed position to block the paint inlet port 64B as shown in FIG. 9. On the other hand, when pilot air is supplied from the paint feed/discharge valve pilot air source 69 through the pilot air piping 70, the valve member 64C of the paint feed/discharge valve 64 is shifted against the biasing action of the valve spring 64D, thereby opening the paint inlet port 64B and communicating the paint hose 63 with the paint circulating pipe 67 through the paint inlet port 62A and paint outlet port 62B of the manifold 62 to permit paint circulation thereto.

In this case, the paint supply line 65, paint return line 66 and paint circulating piping 67 jointly constitute a paint supply source. Paint in a paint tank (not shown) is pumped forward through the paint supply line 65, while paint is returned to the afore-mentioned tank through the paint return line 66. Further, a paint circulation circuit to and from the paint tank is formed by the paint supply line 65, paint circulating piping 67 and paint return line 66, so that paint which is pumped out of the paint tank is circulated through the paint supply line 65, paint circulating piping 67 and paint return line 66 and then returned to the paint tank again. Therefore, when a paint cartridge is put in a respiratory standby mode which will be described hereinafter, paint is repeatedly circulated between the paint tank and a paint chamber 36 in the cartridge 31.

Indicated at 71 is the waste liquid discharge valve which is attached to the manifold 62 opposingly to the paint feed/discharge valve 64. Substantially in the same manner as the above-described paint feed/discharge valve 64, the waste liquid discharge valve 71 is largely constituted by a casing 71A, a waste liquid discharge port 71B which is provided in the casing and connected to the waste liquid discharge port 62C of the manifold 62, a valve member 71C which is slidably received in the casing 71A to open and close the waste liquid discharge port 71B, and a valve spring 71D which is adapted to bias the valve member 71C constantly in a closing direction. Normally, under the influence of the biasing action of the valve spring 71D, the valve member 71C of the waste liquid discharge valve 71 is retained in a closed position to block the waste liquid discharge port 71B. On the other hand, when pilot air is supplied from a waste liquid discharge valve pilot air source 72 through pilot air piping 73, the valve member 71C of the waste liquid discharge valve 71 is shifted to open the waste liquid discharge port 71B, thereby permitting waste liquid, containing paint and thinner resulting from a washing operation on a paint cartridge, to be discharged from the paint hose 63 to a waste liquid tank 75 through the paint outlet port 62B, intercommunication passage 62D and waste liquid discharge port 62C of the manifold 62 and a waste liquid piping 74.

Further, the waste liquid discharge valve 71 also functions as a residual pressure extracting valve, and is opened after paint replenishment into the paint chamber 36 of a paint cartridge 31 to extract residual pressure from the paint chamber 36 and the paint passage 34A of the feed tube 34 and put these parts under the atmospheric pressure by discharging paint therefrom in an amount which corresponds to the residual pressure.

Now, indicated at 76 is an air suction passage which is provided in the seat portion 55 and opened into a bottom portion 57A of a container support portion 57. This air suction passage 76 is connected to a vacuum source 78 through vacuum piping 77. Through the air suction passage 76, air is sucked out from a vacuum space 79 which is defined between a bottom surface of the container support portion 57 and the container 33 of a paint cartridge 31 which is set in the container support portion 57, thereby fixedly gripping the paint cartridge 31 on the container support portion 57 by suction force.

Further, indicated at 80 is an ejection air passage which is provided in the seat portion 55, and opened into the bottom portion 57A of the container support portion 57. This ejection air passage 80 is connected to an ejection air source 82 through air piping 81. At the time of dismantling the paint cartridge 31 from the replenishing stool 52, ejection air is supplied to the vacuum space 79 through the ejection air passage 80 to cancel the suction grip on the paint cartridge 31.

Further, designated at 83 is pilot air piping (FIG. 12) which is connected to a pilot air passage (not shown) which is provided in the seat portion 55 of the replenishing stool 52. One end of this pilot air piping 83 is connected to a paint valve pilot air source 84. Further, the pilot air passage is connected to the pilot air passage 42 of the paint valve 41 on the side of the paint cartridge. Consequently, when a paint cartridge 31 is set on the container support portion 57 of the replenishing stool 52, the pilot air piping 83 and the pilot air passage on the side of the replenishing stool are communicated with the pilot air passage 42 on the side of the paint cartridge to supply pilot air from the paint valve pilot air source 84 to the paint valve 41.

On the other hand, indicated at 85 is an extruding thinner passage on the side of the replenishing stool which is provided in the seat portion 55 of the replenishing stool 52 as an extruding liquid passage, to be connected to the extruding thinner chamber 37 in the paint cartridge 31. One end of this extruding thinner passage 85 is opened in the female coupling portion 57B of the container support portion 57, while the other end is connected to an extruding thinner feed/discharge valve 86 as described below.

The extruding thinner or extruding liquid feed/discharge valve 86 functions to suck paint into the paint chamber 36 of the cartridge 31 from the paint circulation piping 67 or to extrude paint in the paint chamber 36 toward the paint circulation piping 67. The extruding thinner feed/discharge valve 86 is largely constituted by a manifold 87, an extruding thinner supply valve 89 and an extruding thinner discharge valve 95, which will be described below.

Denoted at 87 is the manifold of the extruding thinner feed/discharge valve 86. This manifold 87 is provided with a thinner supply port 87A, a thinner discharge port 87B, and a respiratory thinner port 87C which is communicated with the thinner supply port 87A and the thinner discharge port 87B. In this instance, the respiratory thinner port 87C of the manifold 87 is connected through a thinner hose 88 to the thinner passage 85 on the side of the replenishing stool 52.

Indicated at 89 is the extruding thinner supply valve which is attached to the manifold 87. This extruding thinner supply valve 89 is largely constituted by a casing 89A, a thinner supply port 89B which is provided in the casing 89A and connected to the thinner supply port 87A of the manifold 87, a valve member 89C which is slidably received in the casing 89A to open and close the thinner supply port 89B, and a valve spring 89D which is adapted to bias the valve member 89C constantly in a closing direction. In this instance, as shown in FIG. 12, the thinner supply port 89B is connected to an extruding thinner supply line 92, i.e., an extruding liquid supply source, through thinner piping 90 and a pressure regulator 91. Further, through pilot air piping 94, the extruding thinner supply valve 89 is connected to a extruding thinner supply valve pilot air source 93, from which pilot air is supplied to open the valve member 89C against the biasing action of the valve spring 89C. The pressure of thinner supply by the extruding thinner supply line 92 is set at a higher level than the pressure of paint supply by the paint supply line 65.

Normally, under the influence of the biasing action of the valve spring 89D, the valve member 89C of the extruding thinner supply valve 89 is retained in a closed position to block the thinner supply port 89B. On the other hand, as soon as pilot air is supplied from the extruding thinner supply valve pilot air source 93 through pilot air piping 94, the valve member 89C is shifted to an open position against the biasing action of the valve spring 89D. As a result, the thinner supply port 89B is opened to communicate the extruding thinner passage 85 with the thinner supply line 92 through the thinner supply port 87A and respiratory thinner passage 87C of the manifold 87 and through the thinner hose 88.

Indicated at 95 is the thinner discharge valve which is attached to the manifold 87 opposingly to the extruding thinner supply valve 89. Similarly to the above-described extruding thinner supply valve 89, the extruding thinner discharge valve 95 is largely constituted by a casing 95A, a thinner discharge port 95B which is provided in the casing 95A and connected to the thinner discharge port 87B of the manifold 87, a valve member 95C which is slidably received in the casing 95A to open and close the thinner discharge port 95B, and a valve spring 95D which is adapted to bias the valve member 95C in a closing direction. In this instance, the thinner discharge port 95B is connected to a thinner reservoir tank 97 through thinner piping 96. Further, the thinner discharge valve 95 is connected through pilot air piping 99 to an extruding thinner discharge valve pilot air source 98, from which pilot air is supplied to open the valve member 95C against the biasing action of the valve spring 95D.

Normally, the valve member 95C of the extruding thinner discharge valve 95 is retained in a closed position, blocking the thinner discharge port 95B. On the other hand, as soon as pilot air is supplied from the extruding thinner discharge valve pilot air source 98, the valve member 95C of the thinner discharge valve 95 is shifted into an open position, uncovering the thinner discharge port 95B. As a result, the thinner passage 85 is communicated with the thinner reservoir tank 97 through the respiratory thinner port 87C and thinner discharge port 87B of the manifold 87, permitting extruding thinner in the thinner chamber 37 of the paint cartridge 31 to return to the thinner reservoir tank 97.

The extruding thinner feed/discharge valve 86 is arranged in the manner as described above. At the time of supplying paint from the paint circulation piping 67 to the paint chamber 36 in a paint cartridge 31, the extruding thinner supply valve 89 is closed, and the extruding thinner discharge valve 95 is opened. By this, the extruding thinner passage 85 and the thinner hose 88 are switched to the side of the thinner discharge port 95B and the thinner piping 96 through the respiratory thinner port 87C of the manifold 87. As a consequence, the extruding thinner chamber 37 of the paint cartridge 31 is put under the atmospheric pressure, so that paint can now be sucked into the paint chamber 36 through the paint circulation piping 67 and the paint replenishing valve 61.

On the other hand, at the time of pushing out paint in the paint chamber 36 of a cartridge 31 toward the paint circulation piping 67, the extruding thinner supply valve 89 is opened, and the extruding thinner discharge valve 95 is closed. By this, the extruding thinner passage 85 and the thinner hose 88 are switched to the side of the thinner supply port 89B and the thinner piping 90 through the respiratory port 87C. As a result, thinner is supplied to the extruding thinner chamber 37 of the paint cartridge 31 from the extruding thinner supply line 92 which is at a higher pressure level than the paint supply line 65. Therefore, by the pressure of thinner which flows into the extruding thinner chamber 37, paint in the paint chamber 36 is pushed out toward the paint circulation piping 67 through the replenishing valve 61.

Now, indicated at 100 is a wash fluid passage which is provided in the seat portion 55 of the replenishing stool 52. One end of this wash fluid passage 100 on the side of the replenishing stool is connected to a wash fluid hose 103 which will be described hereinafter. The other end of the wash fluid passage 100 is opened in a circumferential surface of the male coupling portion 57C of the container support portion 57 at a corresponding position with respect to a wash fluid passage 43 on the side of the paint cartridge 31. Therefore, when a paint cartridge 31 is set in the container support portion 57 of the replenishing stool 52, the wash fluid passage 100 is communicated with the wash fluid passage 43 on the side of the paint cartridge 31 to supply a wash fluid (thinner and air) toward the paint chamber 36 of the cartridge.

Indicated at 101 is a wash fluid supply valve which is provided for supplying a wash fluid to the paint chamber 36 of a paint cartridge 31. This wash fluid supply valve 101 is largely constituted by a manifold 102, a washing thinner supply valve 104 and a washing air supply valve 110, which will be described below.

The manifold 102 of the wash fluid supply valve 101 is provided with a thinner supply port 102A, an air supply port 102B, and a wash fluid outlet port 102C which is in communication with the thinner supply port 102A and the air supply port 102B. In this instance, the wash fluid outlet port 102C of the manifold 102 is connected, through a wash fluid hose 103, to the wash fluid passage 100 which is provided on the side of the replenishing stool 52.

Indicated at 104 is a wash thinner supply valve which is attached to the manifold 102. This wash thinner supply value 104 is largely constituted by a casting 104A, a thinner supply port 104B which is provided in the casting 104A and connected to the thinner supply port 102A of the manifold 102, a value member 104C which is sildably received in the casting 104A to open and close the thinner supply port 104B, an a value spring 104D which is adapted to bias the value member 104C constantly in a closing direction. In this instance, the thinner supply port 104B is connected to a wash thinner supply line 107 through thinner piping 105 and pressure regulator 106. Further, the wash thinner supply value 104 is connected, through pilot air piping 109, to a wash thinner supply value pilot air source 108, from which pilot air is supplied to open the value member 104C against the biasing action of the value spring 104D.

Normally, under the influence of the biasing action of the value spring 104D, the value member 104C of the thinner supply value 104 is retained in a closed position, blocking the thinner supply port 104B. On the other hand, as soon as pilot air is supplied from the wash thinner supply value pilot air source 108 through the pilot air piping 109, the valve member 104C is shifted to an open position against the biasing action of the valve spring 104D to open the thinner supply port 104C. As a result, the wash fluid passage 43 on the side of the paint cartridge is communicated with the wash thinner supply line 107 through the thinner supply port 102A and wash fluid outlet port 102C of the manifold 102 and the wash fluid hose 103.

Indicated at 110 is a wash air supply valve which is attached to the manifold 102. This wash air supply valve 110 is largely constituted by a casing 110A, an air supply port 110B which is provided in the casing 110A and connected to the air supply port 102B of the manifold 102, a valve member 110C which is slidably received in the casing 110A to open and close the air supply port 110B, and a valve spring 110D which is adapted to bias the valve member 110C constantly in a closing direction. In this instance, the air supply port 110B is connected to a wash air supply line 113 through air piping 111 and a pressure regulator 112. Further, the wash air supply valve 110 is connected, through pilot air piping 115, to a wash air supply valve pilot air source 114, from which pilot air is supplied to open the valve member 110C against the biasing action of the valve spring 110D.

Normally, under the influence of the biasing action of the valve spring 110D, the valve member 110C of the wash air supply valve 110 is retained in a closed position, blocking the air supply port 110B. On the other hand, as soon as pilot air is supplied from the wash air supply valve pilot air source 114 through the pilot air piping 115, the valve member 110C is shifted into an open position against the biasing action of the valve spring 110D to open the air supply port 110B. As a result, the wash fluid passage 43 on the side of the paint cartridge is communicated with the wash air supply line 113 through the air supply port 102B and wash fluid outlet port 102C of the manifold 102 and the wash fluid hose 103.

The wash fluid supply valve 101, with the arrangements as described above, operates to alternately open the wash thinner supply valve 104 and the wash air supply valve 110. Therefore, by the wash fluid supply valve 101, wash thinner from the wash thinner supply line 107 and wash air from the wash air supply line 113 are supplied to the paint chamber 36 of the cartridge 31 through the manifold 102, wash fluid hose 103 and wash fluid passages 100 and 43.

Indicated at 116 is a pilot air passage which is provided in the seat portion 55 of the replenishing stool 52. One end of this pilot air passage 116 on the side of the replenishing stool is connected to a wash fluid valve pilot air source 118 through pilot air piping 117. The other end of the pilot air passage 116 is opened in a circumferential surface of the male coupling portion 57C of the container support portion 57 at a corresponding position with respect to the pilot air passage 46 on the side of the paint cartridge. Therefore, when a paint cartridge 31 is set in the container support portion 57 of the replenishing stool 52, the pilot air passage 116 on the side of the replenishing stool is communicated with the pilot air passage 46 on the side of the paint cartridge to supply pilot air from the wash fluid valve pilot air source 118 toward the wash fluid valve 45.

On the other hand, indicated at 119 is another paint replenisher (FIG. 13) which is provided on the cartridge changer 47. This paint replenisher 119 is used for replenishing less frequently used paint colors r, s, . . . z into paint cartridges 31*p*.

Indicated at 120 is a replenishing valve system for the paint replenisher 119. The replenishing valve system 120 is largely constituted by a manifold 121, paint feed/discharge valves 122*r*, 122*s*, . . . 122*z*, and a waste liquid discharge valve 129, as described below.

Indicated at 121 is the manifold of the replenishing valve system 120, and the afore-mentioned paint hose 63 is attached to this manifold 121, along with the paint feed/discharge valves 122*r*, 122*s*, . . . 122*z* and the waste liquid discharge valve 129 which are described below.

The paint feed/discharge valves 122*r*, 122*s*, . . . 122*z* are attached to the manifold 121 to feed paint colors r, s, . . . z to and from a paint cartridge 31, respectively. The paint feed/discharge valve 122*r* is connected to paint circulation piping 125*r* which is in communication with a paint supply line 123*r* and a paint return line 124*r* for the paint of color r. The paint feed/discharge valve 122*s* is connected to paint circulation piping 125*s* which is in communication with a paint supply line 123*s* and a paint return line 124*s* for the paint of color s. Further, the paint feed/discharge valve 122*z* is connected to paint circulation piping 125*z* which is in communication with a paint supply line 123*z* and a paint return line 124*z* for the paint of color z.

Further, pressure regulators 126*r*, 126*s*, . . . 126*z* are provided in the course of the paint circulation pipings 125*r*, 125*s*, . . . 125*z* and between the paint supply lines 123*r*, 123*s*, . . . 123*z* and the paint feed/discharge valves 122*r*, 122*s*, . . . 122*z*, respectively. Furthermore, the paint feed/discharge valves 122*r*, 122*s*, . . . 122*z* are independently connected to respective paint feed/discharge valve pilot air sources 127 (only one of which is shown in the drawings) through pilot air piping 128.

Denoted at 129 is the waste liquid discharge valve which is attached to the manifold 121. At the time of a paint cartridge washing operation, this waste liquid discharge valve 129 is opened to discharge waste liquids, including spent thinner resulting from the cartridge washing operation, toward the waste liquid tank 75.

By selectively opening and closing the paint feed/discharge valves 122*r*, 122*s*, . . . 122*z*, one specified color is selected from a variety of paint colors r, s, . . . z at the replenishing valve system 120 and said one specified color is supplied to a common paint cartridge 31*p*. At the time of a color change, the waste liquid discharge valve 129 is opened to wash off deposited paint in the paint chamber 36 of the cartridge 31*p*, paint hose 63 and manifold 121 with thinner and air which are supplied from the wash fluid supply valve 101.

Indicated at 130 is a cartridge gripper mechanism (FIG. 1) which is provided on the cartridge changer 47. This cartridge gripper mechanism 130 is provided with a gripper 131 as described below, thereby to transfer a paint cartridge 31 between the coating machine 11 and the paint replenisher 51 or 119.

Figure 6:
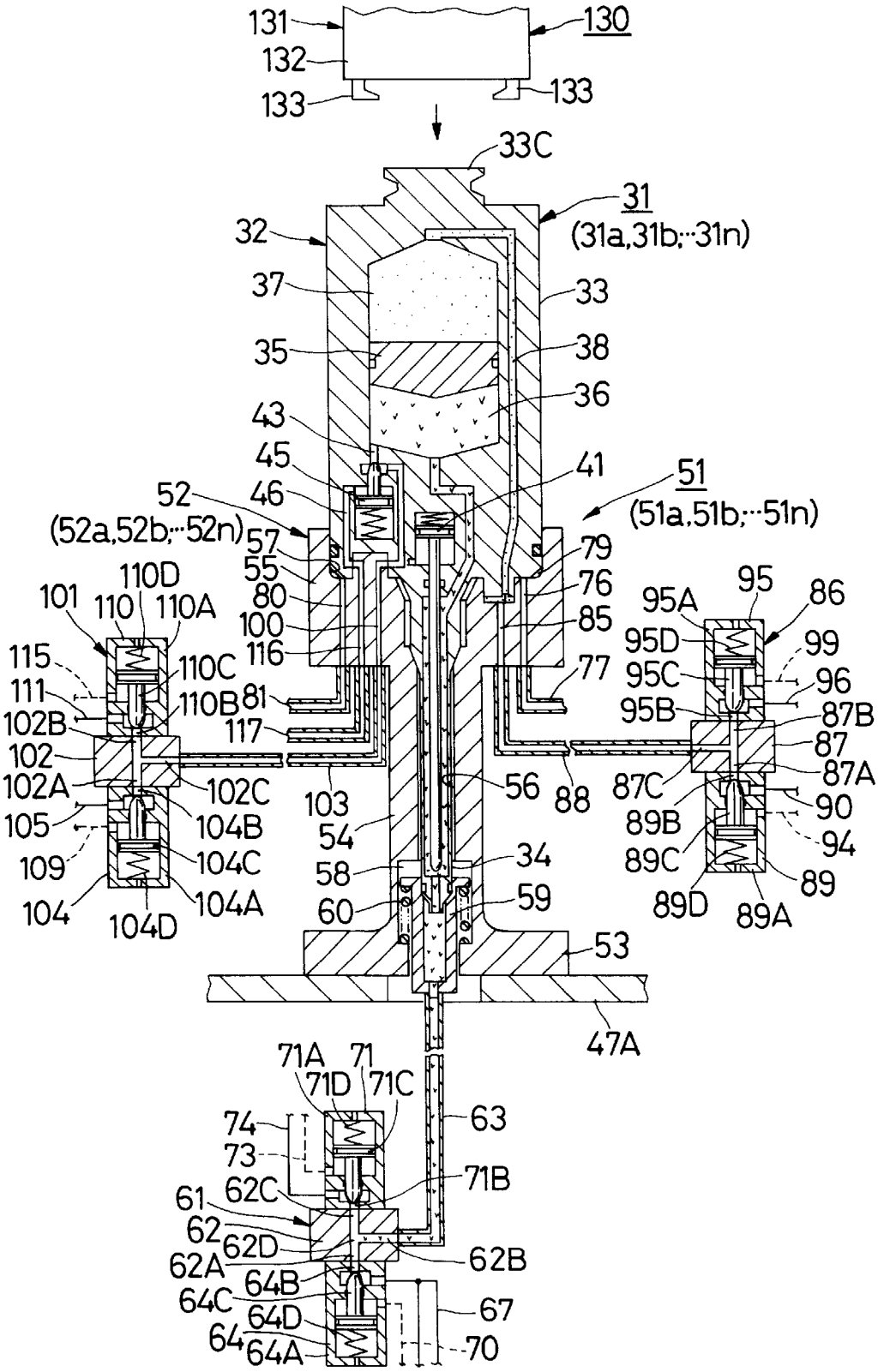
FIG. 6 is a longitudinal sectional view, showing a paint cartridge along with a paint replenisher and a cartridge gripper mechanism.

Indicated at 131 is the gripper which is provided on the cartridge gripper mechanism 130. As shown in FIG. 6, the gripper 131 is largely constituted by a casing 132, a pair of gripper pawls 133 which are supported on the casing 132 for movements toward and away from each other, and a cylinder device (not shown) which is mounted on the casing 132 to drive the gripper pawls 133 toward and away from each other. As the gripper pawls 133 of the cartridge gripper 131 are moved toward each other by the cylinder device, a paint cartridge 31 is picked up by the gripper pawls 133 at a gripping knob portion 33C which is provided on the cartridge container 33.

Figure 10:
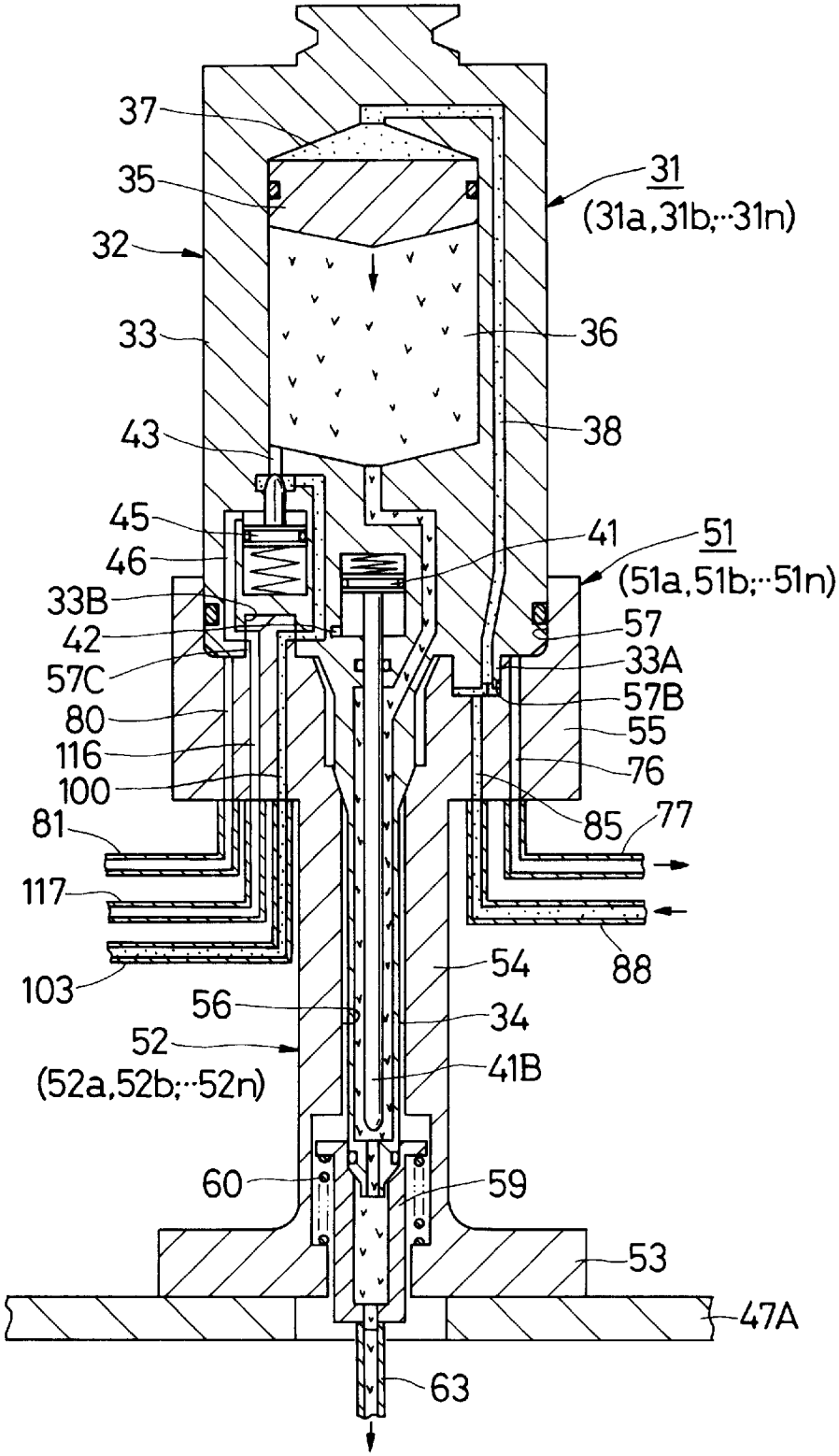
FIG. 10 is a view similar to FIG. 9, showing the paint replenisher in an operation of discharging paint from a paint cartridge.

According to the cartridge type coating system of the present embodiment, with the arrangements described above, paint is replenished into paint cartridges 31 by the paint replenishers 51 and 119 in the manner as described in greater detail below with reference to the sectional view of FIGS. 10 and 11 and the time charts of FIGS. 14 and 16.

Firstly, before replenishing paint, a paint cartridge 31 which was used in a previous coating operation is unloaded from the coating machine and transferred to and set on the paint replenisher 51 by the following operations.

More specifically, upon completing a coating operation, a paint cartridge 31 on the cartridge mount portion 14 of the housing 12 is gripped on the gripper pawls 131 of the cartridge gripper mechanism 130 and thereby unloaded from the cartridge mount portion 14 of the housing 12. Then, in a case where the unloaded paint cartridge 31 is of the color a, for example, the paint cartridge 31*a* is transferred to and set on the replenishing stool 52*a* of the paint replenisher 51*a* which is allotted to the color a.

When a paint cartridge 31 is set on the replenishing stool 52 in this manner, the cartridge container 33 is fitted in the container support portion 57 while the feed tube 34 of the paint cartridge 31 is passed into the feed tube passage hole 56 on the side of the replenishing stool.

Further, as soon as the paint cartridge 31 is set in the container support portion 57, air is sucked out of the vacuum space 79 on the inner side of the container 33 to grip the paint cartridge 31 fixedly on the replenishing stool 52 by the air suction passage 76.

Further, upon setting the container 33 in the container support portion 57, the male and female coupling portions 33A and 33B on the side of the container 33 are brought into fitting engagement with the female and male coupling portions 57B and 57C on the side of the container support portion 57, respectively, to orient the container 33 into position on the container support portion 57 in circumferential direction. At this time, the conical projection 33D of the container 33 is also brought into fitting engagement with the conical bore portion 56A of the feed tube passage hole 56 on the side of the replenishing stool to orient the container 33 into position on the container support portion 57 in both axial and radial directions.

Furthermore, as the feed tube 34 is passed into the feed tube passage hole 56 on the side of the replenishing stool, its fore end portion is brought into fitting engagement with the paint passage 59A of the connector member 59. At this time, the conical surface 34C at the fore end of the feed tube 34 is engaged with the conical cavity 59C of the connector member 59. Thus, the fore open end of the feed tube 34 is located at a center position within the paint passage 59A of the connector member 59.

Besides, when a fore end portion of the feed tube 34 is fitted into the connector member 59, the connector member 59 is moved vertically depending upon vertical position of the feed tube 34 to absorb vertical positional deviations of the latter if any. At this time, by the biasing action of the coil spring 60, the connector member 59 is held in liquid-tight fitting engagement with the feed tube 34.

Figure 14:
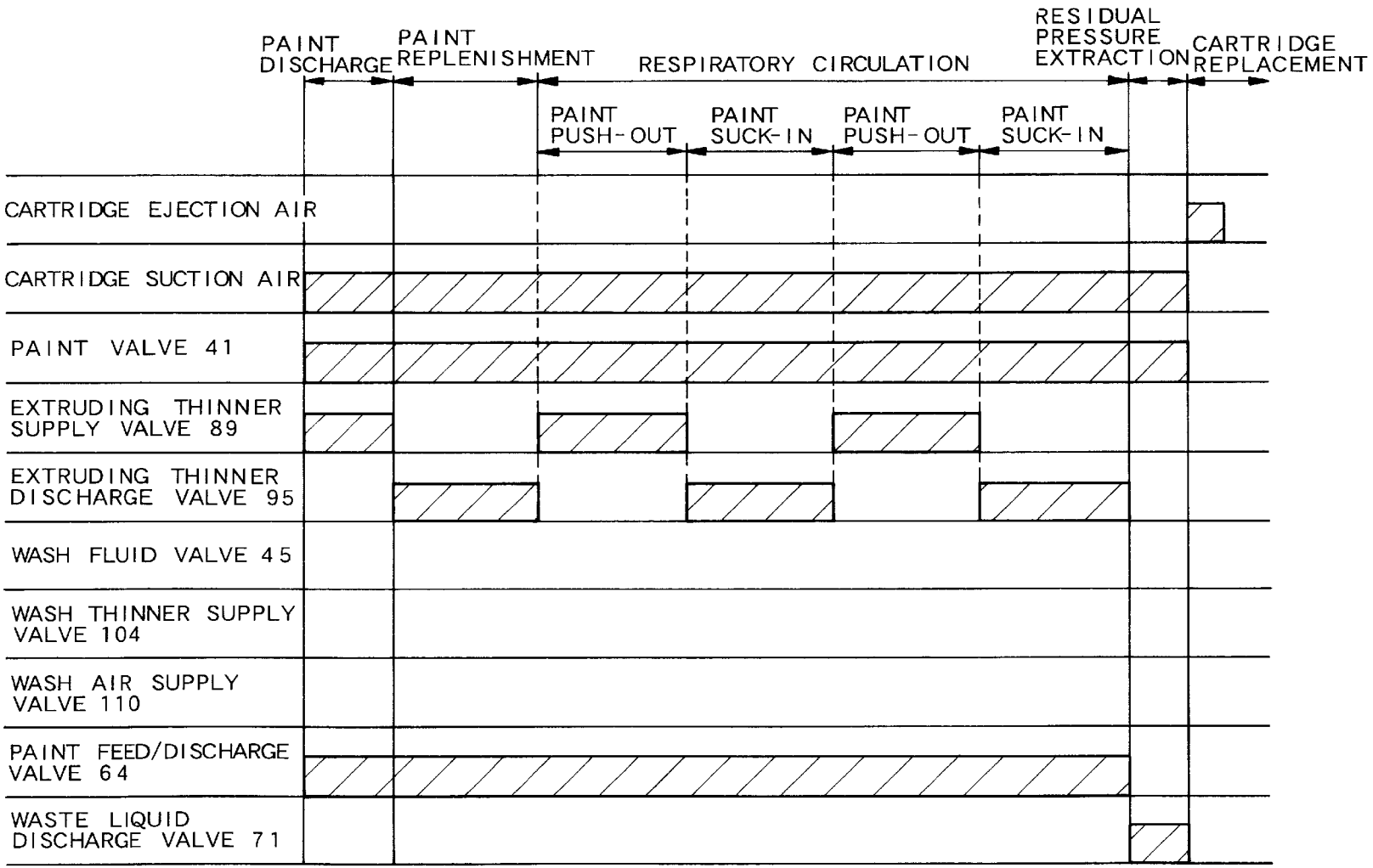
FIG. 14 is a time chart regarding operation of replenishing paint into a paint cartridge by the paint replenisher which is allotted to frequently used exclusive colors.

Now, described below with reference to FIG. 14 is a paint replenishing operation by the paint replenisher 51 which handles exclusive colors which are used at a relatively high frequency.

In the first place, prior to starting paint replenishment, residual paint in the paint cartridge 31*a*, which was used in a previous coating operation, needs to be discharged from the cartridge 31*a*. Therefore, as shown in FIG. 10, the paint valve 41 is opened to discharge paint from the paint cartridge 31*a*, followed by opening of the paint feed/discharge valve 64 and the extruding thinner supply valve 89.

As a result, the paint chamber 36 of the cartridge 31*a* is communicated with the paint circulation piping 67 through the paint hose 63, the paint outlet port 62B of the manifold 62 and the paint inlet port 64B of the paint feed/discharge valve 64. On the other hand, the extruding thinner chamber 37 in the paint cartridge 31*a* is communicated with the extruding thinner supply line 92 through the extruding thinner passage 85, thinner hose 88, the respiratory thinner port 87C and thinner supply port 87A of the manifold 87, and the thinner piping 90. In this instance, since the thinner supply pressure by the extruding thinner supply line 92 is set at a higher level than the pressure of paint supply by the paint supply line 65 (or by the paint circulation piping 67), paint in the paint chamber 36 of the cartridge 31*a* is pushed out toward the paint circulation piping 67 by the pressure of extruding thinner which is supplied to the thinner chamber 37, and returned to the paint tank from the paint return line 66.

In the next place, as soon as the paint chamber 36 is evacuated substantially to an empty state, paint of the color is replenished afresh into the paint chamber 36.

For replenishing paint afresh, the extruding thinner supply valve 89 is closed, and the extruding thinner discharge valve 95 is opened. Whereupon, the extruding thinner passage 85 and the thinner hose 88 are communicated with the thinner reservoir tank 97 through the thinner discharge port 95B of the extruding thinner discharge valve 95 and the thinner piping 96 to put the extruding thinner chamber 37 substantially under the atmospheric pressure. As a result, the pressure of paint which is supplied through the paint circulation piping 67 becomes higher than the pressure of thinner in the extruding thinner chamber 37, and paint which is supplied from the paint circulation piping 67 is sent into the paint chamber 36 of the cartridge through the paint feed/discharge valve 64 and the paint valve 41.

In this instance, if there is some time before the replenished paint cartridge 31*a* is used in a next coating operation, it is retained in a standby state or put in a respiratory standby mode. In the respiratory standby mode, the paint cartridge is put in a respiratory paint circulations for the purpose of preventing separation and sedimentation of pigments or other components of the paint.

In the respiratory paint circulation mode, paint inhaling and exhaling actions similar to the above-described paint suck-in and push-out actions are alternately repeated. More particularly, the respiratory paint circulation is maintained by alternately repeating a paint exhaling action by which paint in the paint chamber 36 of the cartridge 31*a* is pushed out toward the paint circulation piping 67 and returned to the paint tank through the paint return line 66, and a paint inhaling action by which paint is sucked into the paint chamber 36 from the paint supply line 65 through the paint circulation piping 67. By the repeated respiratory paint circulating actions, paint in the paint chamber 36 of the cartridge 31*a* is constantly exhaled and inhaled (or circulated) to or from the paint supply line 65 or the paint return line 66 to prevent separation and sedimentation of pigments or other solid components of the paint.

In case the paint cartridge 31*a* in the standby state is going to be used for a coating operation, the respiratory paint circulation is stopped at a time point when paint has been sucked into the paint chamber 36 of the cartridge by the inhaling action, namely, at a time point when the paint chamber 36 is fully filled with paint. Upon stopping the respiratory paint circulation, it is necessary to extract residual pressures which remain in the paint chamber 36 of the cartridge as a result of the last inhaling action.

In a residual pressure extraction stage, the waste liquid discharge valve 71 is opened to discharge to the waste liquid tank 75 an amount of paint which corresponds to pressures (residual pressures) in the paint chamber 36, feed tube 34 and paint hose 63 for restoring the atmospheric pressure there. Finally, the paint valve 41 is closed to have the paint chamber 36 in a replenished state.

After preparing the paint cartridge 31*a* for a new coating operation in the manner as described above, the paint cartridge 31*a* is released from the suction grip by sending ejection air into the vacuum space 79, and then dismantled from the replenishing stool 52.

On the other hand, in case the coating line is going to be put at rest for a long period of time, each paint cartridge 31, replenishing stool 52, paint hose 63 and manifold 62 are connected to the washing line to wash off paint which might otherwise deposit in a solidified state on liquid-contacting surfaces of these parts. A washing operation is carried out on a paint cartridge 31 and its associated parts in the manner as described below with reference to FIG. 15.

In the first place, paint which remains in the cartridge 31 needs to be discharged before starting a washing operation. For this purpose, the paint valve 41 of the cartridge 31, the paint feed/discharge valve 64 of the replenishing valve 61, the extruding thinner supply valve 89 of the extruding thinner feed/discharge valve 86 are opened, letting extruding thinner flow into the thinner chamber 37 to displace the piston 35 toward the feed tube 34 and thereby pushing out paint in the paint chamber 36 toward the paint circulation piping 67 to reduce the inner volume of the paint chamber 36 to a minimum, that is, to minimize its inner surface areas to be washed. When the piston 35 is displaced toward the feed tube 34, it is stopped as soon as its end face 35A reaches a position which is at a predetermined distance from the bottom surface 36B of the paint chamber 36 to leave a gap space for circulation of a wash fluid between the end face 35A and the bottom surface 36B.

The residual paint discharging operation is followed by a washing operation to wash off paint from interior surfaces of the paint chamber 36 of the cartridge 31, the paint passage 34A of the feed tube 34 and the paint hose 63.

Figure 11:
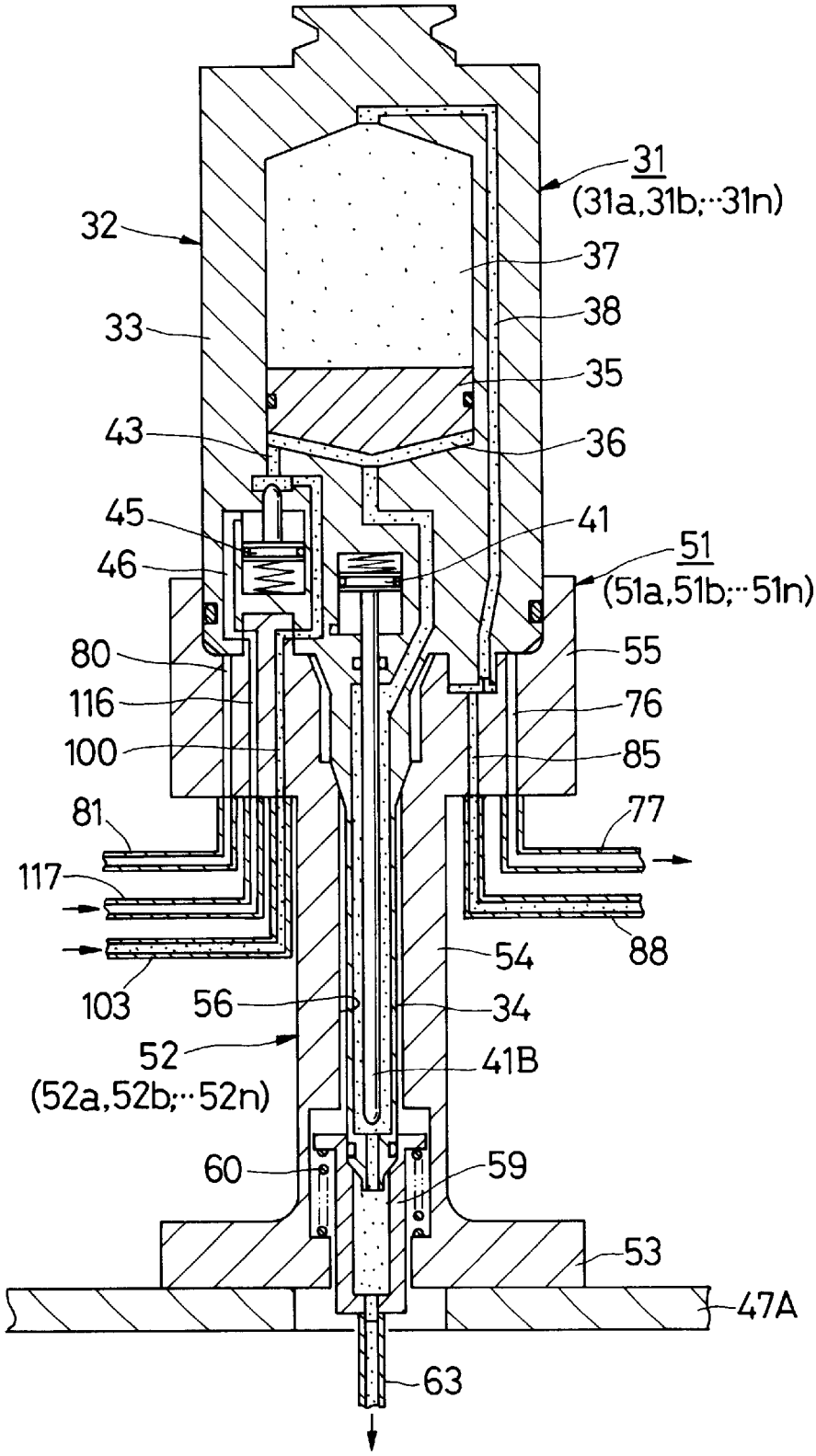
FIG. 11 is a view similar to FIG. 9, showing the paint replenisher in an operation of washing a paint chamber in the paint cartridge.
Figure 15:
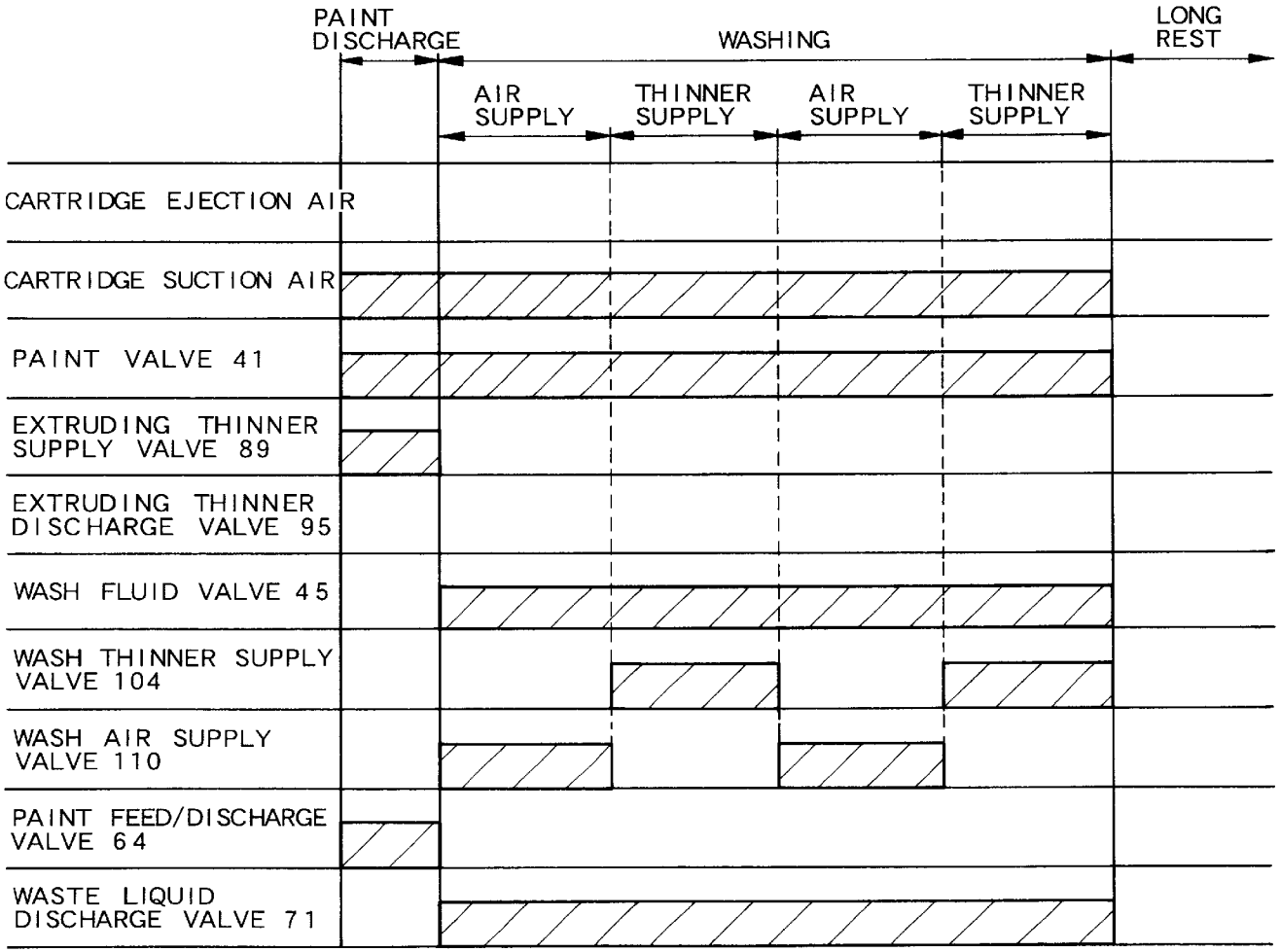
FIG. 15 is a time chart of an operation of washing a paint cartridge with thinner and air by the use of the paint replenisher which is allotted to frequently used colors.

In the stage of a washing operation, as shown in FIGS. 11 and 15, the paint feed/discharge valve 64 of the replenishing valve 61 is closed while the wash fluid valve 45 and the waste liquid discharge valve 71 are opened. As a consequence, the wash fluid supply valve 101 is communicated with the paint chamber 36 through the wash fluid hose 103 and the wash fluid passages 100 and 43 to release the paint chamber 36 to the waste liquid tank 75 through the feed tube 34, paint hose 63 and replenishing valve 61. In this state, the wash air supply valve 110 of the wash fluid supply valve 101 is opened to supply wash air from the wash air supply line 113 to the paint chamber 36 through the wash fluid hose 103 and the wash fluid passages 100 and 43. As a result, residual paint in the paint chamber 36 is pushed out by wash air and discharged toward the waste liquid tank 75 through the paint hose 63 and the replenishing valve 61.

Succeedingly, the wash air supply valve 110 of the wash fluid supply valve 101 is closed, and the wash thinner supply valve 104 is opened. Whereupon, wash thinner is supplied from the wash thinner supply line 107 to the paint chamber 36, and the supplied wash thinner is discharged from the paint chamber 36 to the waste liquid tank 75 through the feed tube 34, paint hose 63 and replenishing valve 61 to wash away deposited paint from interior surfaces of these parts.

After repeating the above-described wash air and wash thinner supply for a number of times, finally thinner is filled in the paint chamber 36, followed by closure of the paint valve 41, wash fluid valve 45, wash thinner supply valve 104 and waste liquid discharge valve 71. Thus, the paint cartridge, which is cleaned and filled with thinner, can be put at rest over a long period of time.

Figure 13:
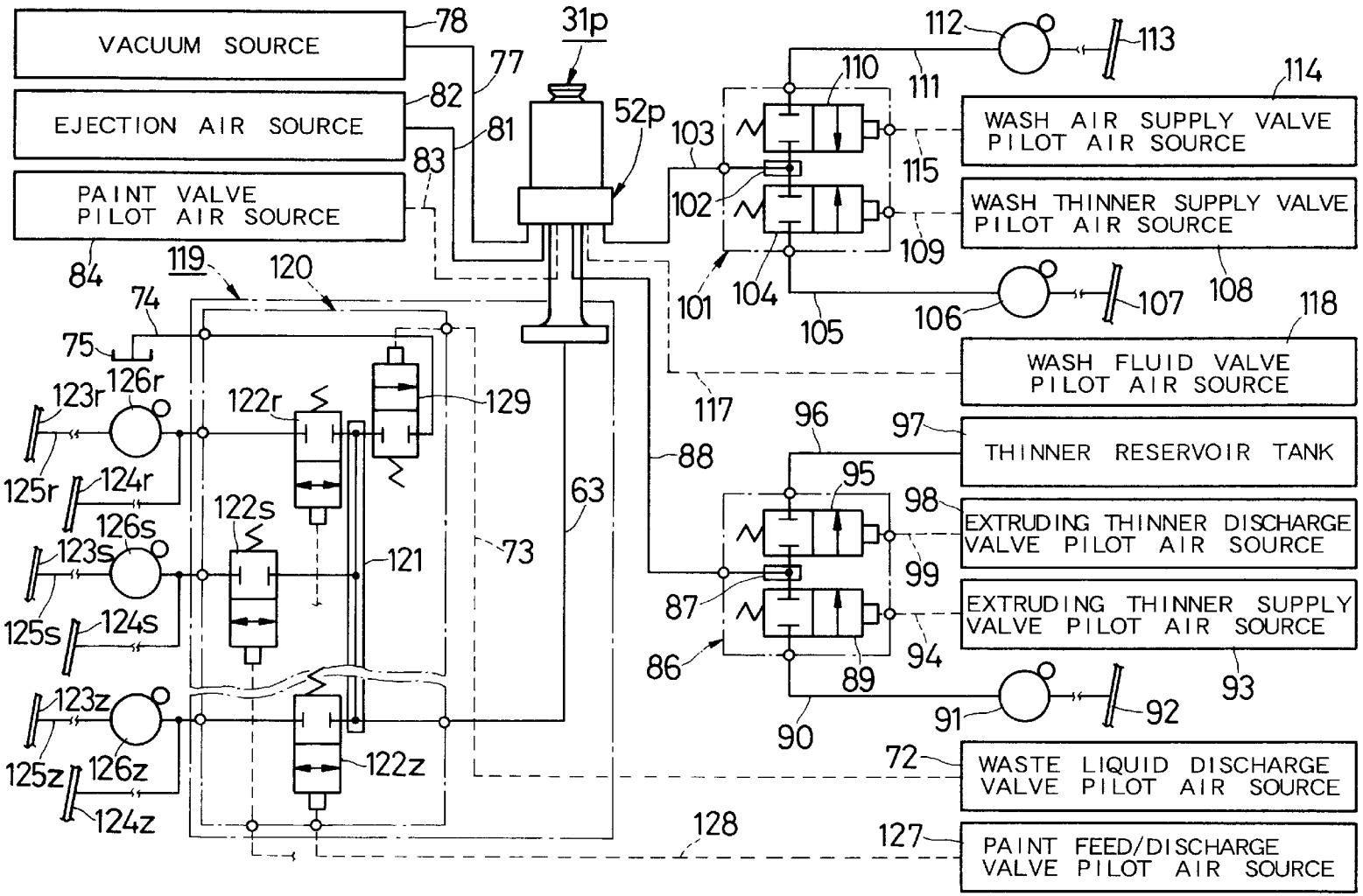
FIG. 13 is a circuit diagram of a paint replenisher for paint colors which are used at a relatively low frequency or less frequently.
Figure 16:
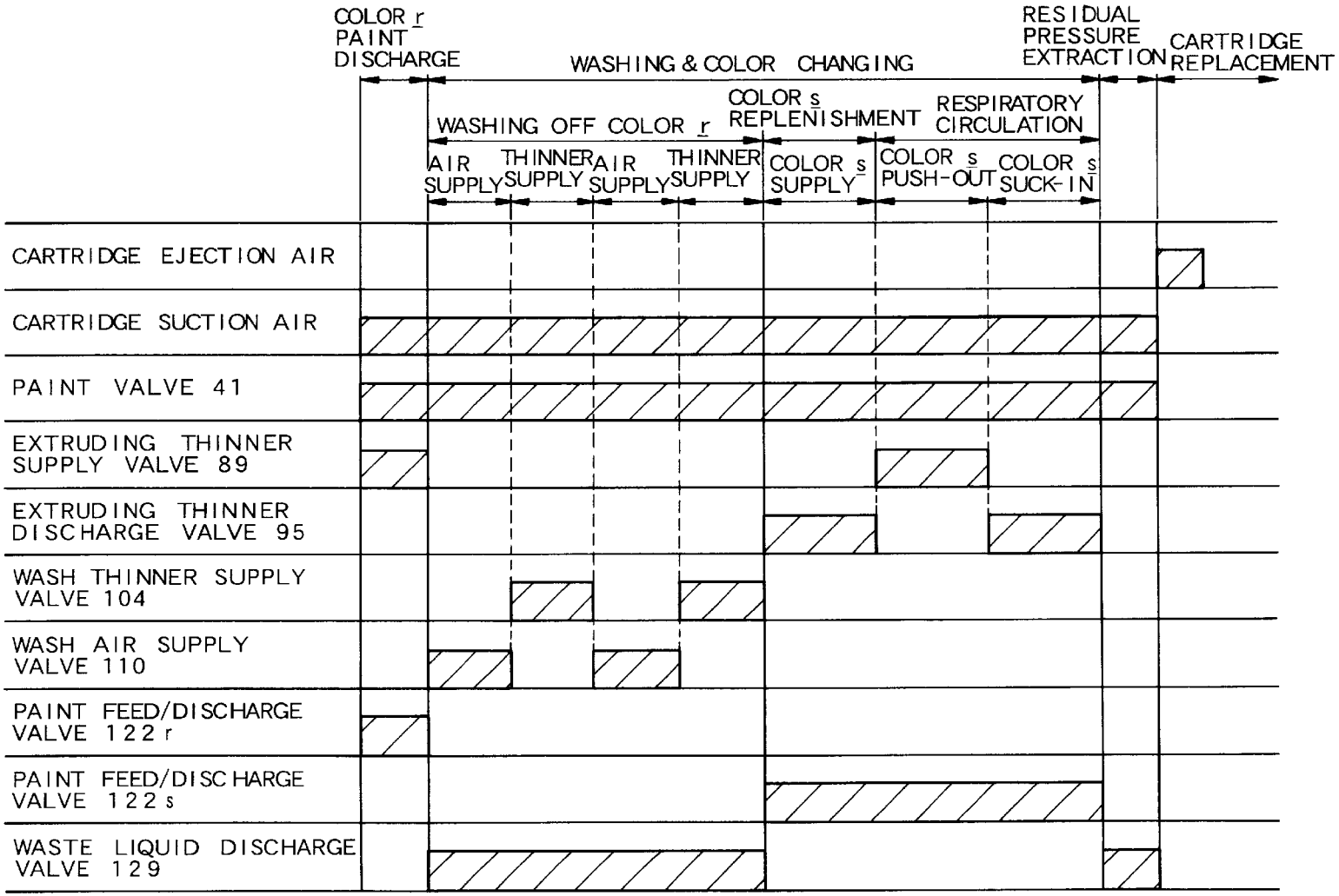
FIG. 16 is a time chart of color changing and paint replenishing operations by a paint replenisher which is allotted to less frequently used colors.
Figure 17:
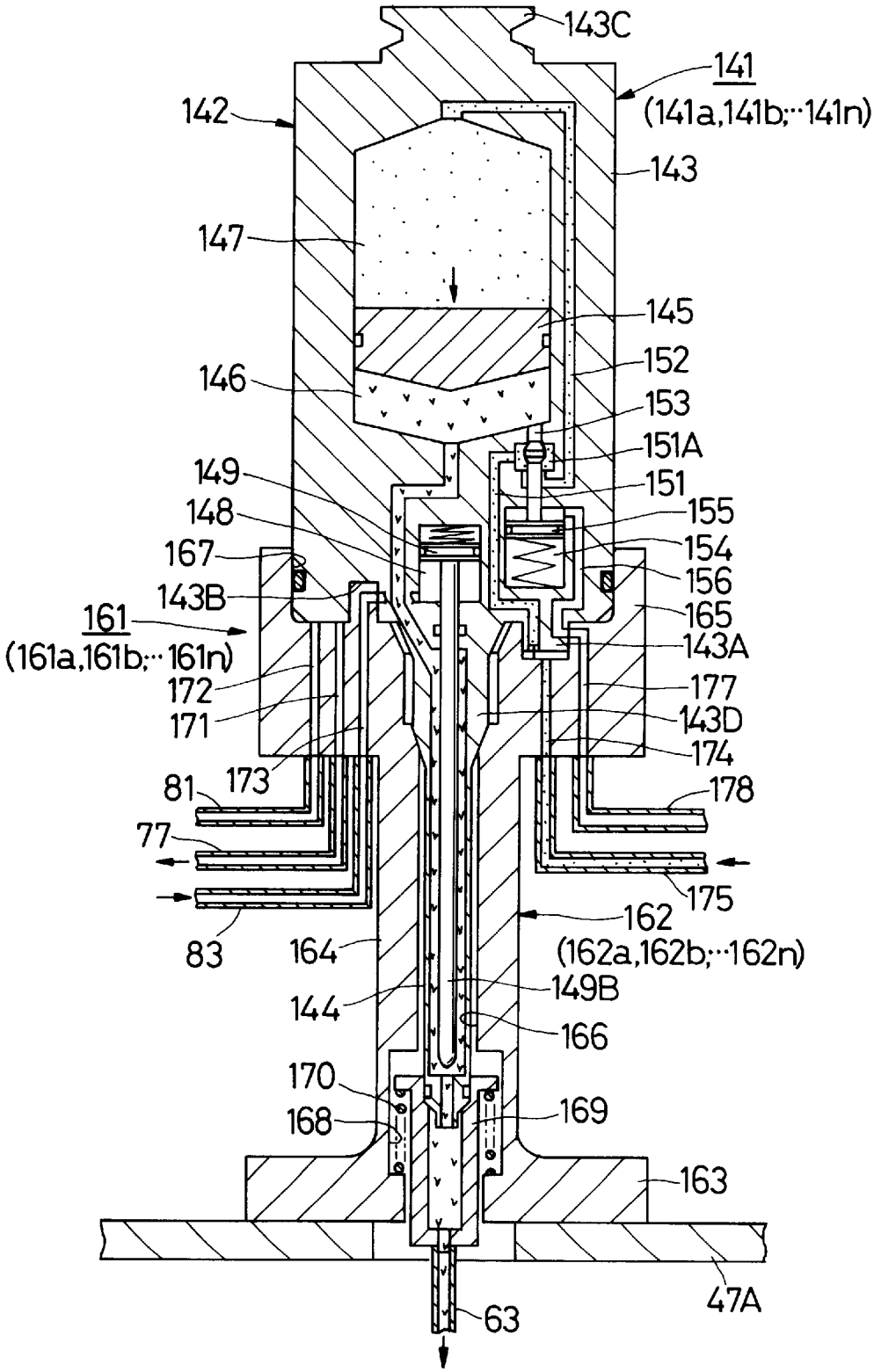
FIG. 17 is a vertical sectional view of a paint cartridge and a paint replenisher adopted in a second embodiment of the present invention, in a stage of discharging paint from the cartridge.

Described below with reference to FIGS. 13 and 16 are operational steps taken by the other paint replenisher 119 in changing and washing off less frequently used colors, for example, in washing off paint of the color r and replenishing paint of the color s.

In that case, it is necessary to discharge and wash away paint of a previous paint color r from a paint cartridge 31*p*. For this purpose, in the first place, the paint cartridge 31*p* is set on the replenishing stool 52*p* to discharge the paint color r. Then, the paint valve 41 of the cartridge 31*p*, the paint feed/discharge valve 122*r* of the replenishing valve 120 and the extruding thinner supply valve 89 of the thinner feed valve 86 are opened to push out residual paint in the paint cartridge 31*p*, a remainder from a previous coating operation, toward the paint circulation piping 125*r*.

In the next place, in order to wash away the previous paint color r from the feed tube 34, paint chamber 36 and paint hose 63, the paint feed/discharge valve 122*r* of the replenishing valve 120 is closed and the wash fluid valve 45 and the waste liquid discharge valve 129 are opened.

Nextly, the wash air supply valve 110 and the wash thinner supply valve 104 of the wash fluid supply valve 101 are opened and closed alternately to supply wash air and wash thinner to the paint chamber 36. The supplied wash air and thinner are discharged from the paint chamber 36 to the waste liquid tank 75 through the feed tube 34, paint hose 63 and waste liquid discharge valve 129 of the replenishing valve 120 to wash away the previous color r from interior surfaces of these parts together with the wash air and thinner.

After repeating the above-described wash air and wash thinner supply for a number of times, finally the paint chamber 36 is filled with thinner, and the wash fluid valve 45, wash air supply valve 110, wash thinner supply valve 104 and waste liquid discharge valve 129 are closed to end the washing operation for the removal of the color r from the paint cartridge 31*p*.

Then, upon completion of the washing operation, a filling operation is started to replenish the paint cartridge 31*p* afresh with the paint color s. In this case, the paint feed/discharge valve 122*s* as well as the extruding thinner discharge valve 95 of the extruding thinner feed/discharge valve 86 is opened. Whereupon, from the paint circulation piping 125*s*, paint of the color sis sucked and filled into the paint chamber 36 through the paint hose 63. As soon as the paint cartridge 31*p* is filled with the color s, it is kept in a respiratory paint circulation mode. In this respiratory circulation mode, in the same manner as the respiratory paint circulation described hereinbefore, a paint inhaling action by the paint valve 41, paint feed/discharge valve 122*s* and extruding thinner discharge valve 95 is repeated alternately with a paint exhaling action which pushes out the paint in the paint chamber 36 toward the paint circulation piping 125*s* by opening the extruding thinner supply valve 89.

At the end of the above-described washing operation for the removal of the previous color r, a small amount of wash thinner still remains in the paint chamber 36 of the cartridge 31*p*, in the paint passage 34A of the feed tube 34 and in the paint hose 63. Therefore, when the next color s is sucked into the paint chamber 36 after the washing operation, that residual wash thinner can also be sucked into the paint chamber 36 to more or less thin down the fresh color s.

However, after refilling the fresh color into the paint chamber 36, the paint cartridge 31*p* is kept in the respiratory paint circulating action as described above. Therefore, the residual wash thinner which has mixed into the paint can be absorbed as part of a solvent while the paint is repeatedly circulated between the paint chamber 36 and the paint circulation piping 67. Thus, the quality of coatings cannot be affected by the residual wash thinner which remains in a paint cartridge at the end of a washing operation.

As described in detail hereinbefore, according to the first embodiment of the present invention, paint cartridge 31 is provided with the wash fluid passage 43 which is in communication with the paint chamber 36 and the wash fluid valve 45 which is adapted to open and close the wash fluid passage 43. On the other hand, the wash fluid supply valve 101 is provided on the side of the paint replenishers 51 and 119 to supply wash air and wash thinner to the paint chamber 36 of the cartridge 31. Therefore, upon opening the wash fluid valve 45 to bring the wash fluid passage 43 into communication, wash air and wash thinner are alternately supplied to the paint chamber 36 from the wash fluid supply valve 101 through the wash fluid hose 103 and the wash fluid passage 100 on the side of the replenishing stool to wash away residual paint from the paint chamber 36 and resulting waste liquid is discharged to the waste liquid tank 75 through the feed tube 34, paint hose 63 and replenishing valve 61. By alternately supplying wash air and wash thinner to a paint cartridge in this manner, residual paint can be washed off within a shortened period of time and in an assured manner which will contribute to improvements in reliability and efficiency of the operation.

Besides, the replenishing valve 61 is provided with the paint feed/discharge valve 64 which is opened at the time of supplying paint to the paint chamber 36 or at the time of returning paint from the paint chamber 36 to the side of the paint supply line, along with the waste liquid discharge valve 71 which is opened at the time of washing the paint chamber 36 of the cartridge 31. Accordingly, when the paint feed/discharge valve 64 is opened, it is possible to refill paint into the paint chamber 36 or to keep the respiratory paint circulating action (the alternate paint supplying and discharging actions). On the other hand, when the waste liquid discharge valve 71 is opened, a wash fluid which has been supplied to the paint chamber 36 can be discharged through the feed tube 34, and gushed through a flushing route in such a way as to enhance washing efficiency and effects.

Further, the extruding thinner feed/discharge valve 86 is provided with the extruding thinner supply valve 89 and the extruding thinner discharge valve 95 thereby to feed or discharge extruding thinner to or from the extruding thinner chamber 37 of the cartridge. Accordingly, by feeding or discharging extruding thinner to or from the extruding thinner chamber 37 through the extruding thinner valve 86, paint can be pushed out toward the paint circulation piping 67 or 125 from the paint chamber 36 and then sucked into the paint chamber 36 from the paint circulation piping 67 or 125. It follows that paint can be constantly circulated to and from a paint cartridge 31 which stands by on a replenishing stool 52 for a next coating operation.

As a consequence, pigments or other solid components of the paint in the paint chamber 36 and the paint hose 63 are maintained in a uniformly dispersed state to prevent separation and sedimentation of solid components, which may result in clogging of the paint passage 34A of the feed tube 34. Further, quality of coatings can be improved to a significant degree because pigments are also kept in a uniformly dispersed state when paint is supplied to the sprayer unit during a coating operation.

Furthermore, each replenishing stool 52 of the paint replenishers 51 and 119 is provided with the wash fluid passage 100 to be communicated with the wash fluid passage 43 on the side of the paint cartridge, along with the pilot air passage 116 to be communicated with the pilot air passage 46 of the wash fluid valve 45 on the side of the paint cartridge. The respective passages on the side of the paint cartridge are brought into communication with the corresponding passages on the side of the replenishing stool simply by setting a paint cartridge 31 on the replenishing stool 52. Needless to say, this also contributes to improve the operational efficiency to a significant degree.

Further, aside from or in addition to the normal function of the feed tube 34 which supplies paint through an opening at its fore distal end, the paint replenishers 51 and 119 are arranged to utilize the opening at the distal end of the feed tube 34 as a replenishing port in refilling paint into the paint cartridge 31. Therefore, there is no need for providing a paint replenishing port on each paint cartridge exclusively for refilling purposes, permitting to make each paint cartridge 31 simpler in construction, to improve efficiency of cartridge assembly work and to realize reductions in production cost. In addition, the abolishment of an exclusive refilling port also contributes to reduce the number of points which might be a cause of paint leaks, thus enhancing the reliability of paint cartridges in this regard. Further, it becomes possible to shorten the time duration of each paint replenishing operation.

On the other hand, the coating machine 11 is provided with an extruding thinner feeder thereby to supply extruding thinner toward the thinner chamber 37 of a paint cartridge 31 which is loaded in the housing 12. Therefore, in a coating operation by the coating machine 11, extruding thinner is supplied to the thinner chamber 37 from the extruding thinner feeder to push paint in the paint chamber 36 forward through the piston 35. Consequently, paint is spurted toward the rotary atomizing head 18 through the feed tube 34 and sprayed forward by the rotary atomizing head 18.

Referring now to FIGS. 17 through 24, there is shown a second embodiment of the present invention, which has features in that the extruding liquid passage and the wash fluid passage on the side of the paint cartridge are connected to a common inlet port which is opened to the outer periphery of the casing, and that the wash fluid valve is arranged as a change-over valve which switches the common inlet port either to the extruding liquid passage or to the wash fluid passage. In the following description of the second embodiment, those component parts which are identical or common with the counterparts in the foregoing first embodiment are simply designated by the same reference numerals or characters to avoid repetitions of same explanations.

Figure 18:
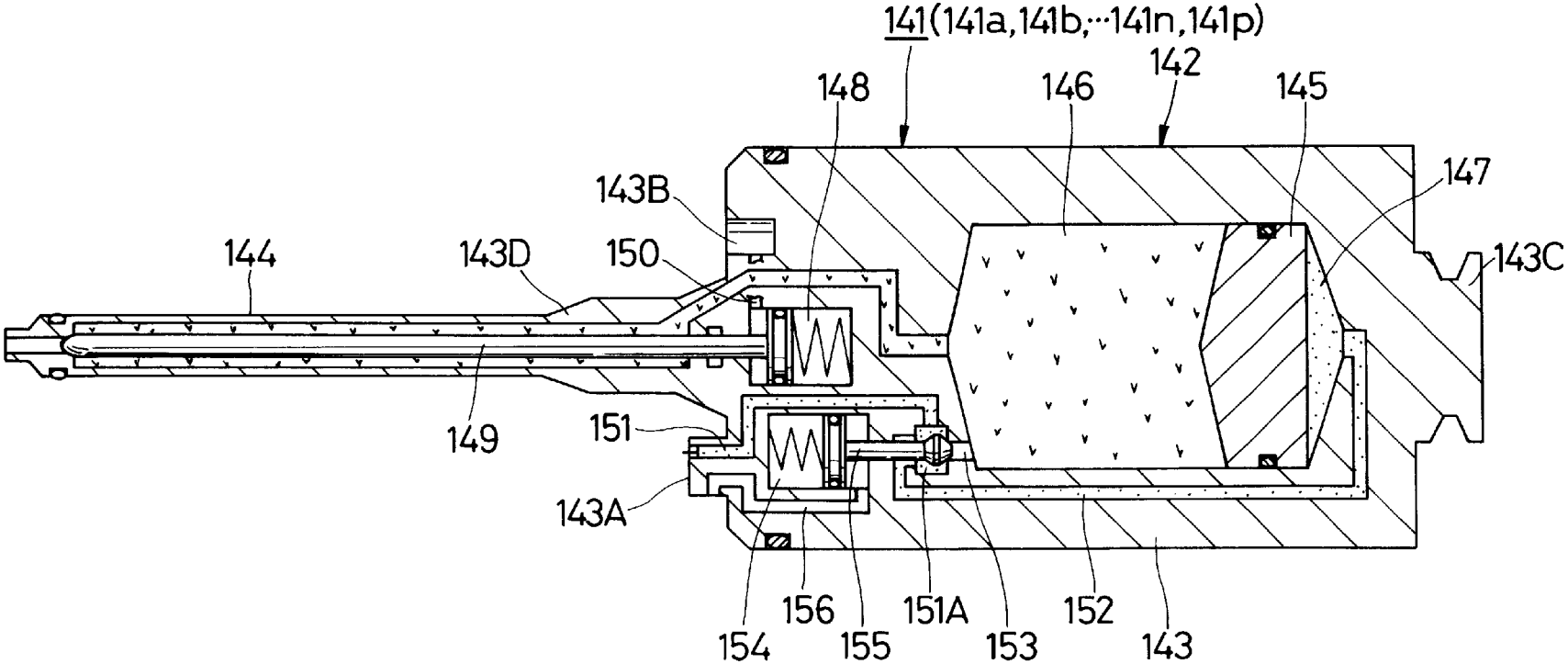
FIG. 18 is a vertical sectional view, showing the paint cartridge in FIG. 17 as a separate unit.

Indicated at 141*a*, 141*b*, . . . 141*n* and 141*p* are paint cartridges (hereinafter collectively referred to as "paint cartridges 141" for brevity) which are employed in the present embodiment in place of the cartridges 31 in the foregoing first embodiment. As shown in FIG. 18, the paint cartridges 141 are each largely constituted by a casing 142, a piston 145, a paint valve 149, a common inlet port 151, a branched extruding thinner passage 152, a branched wash fluid passage 153 and a change-over valve 155, which will be described below.

Figure 19:
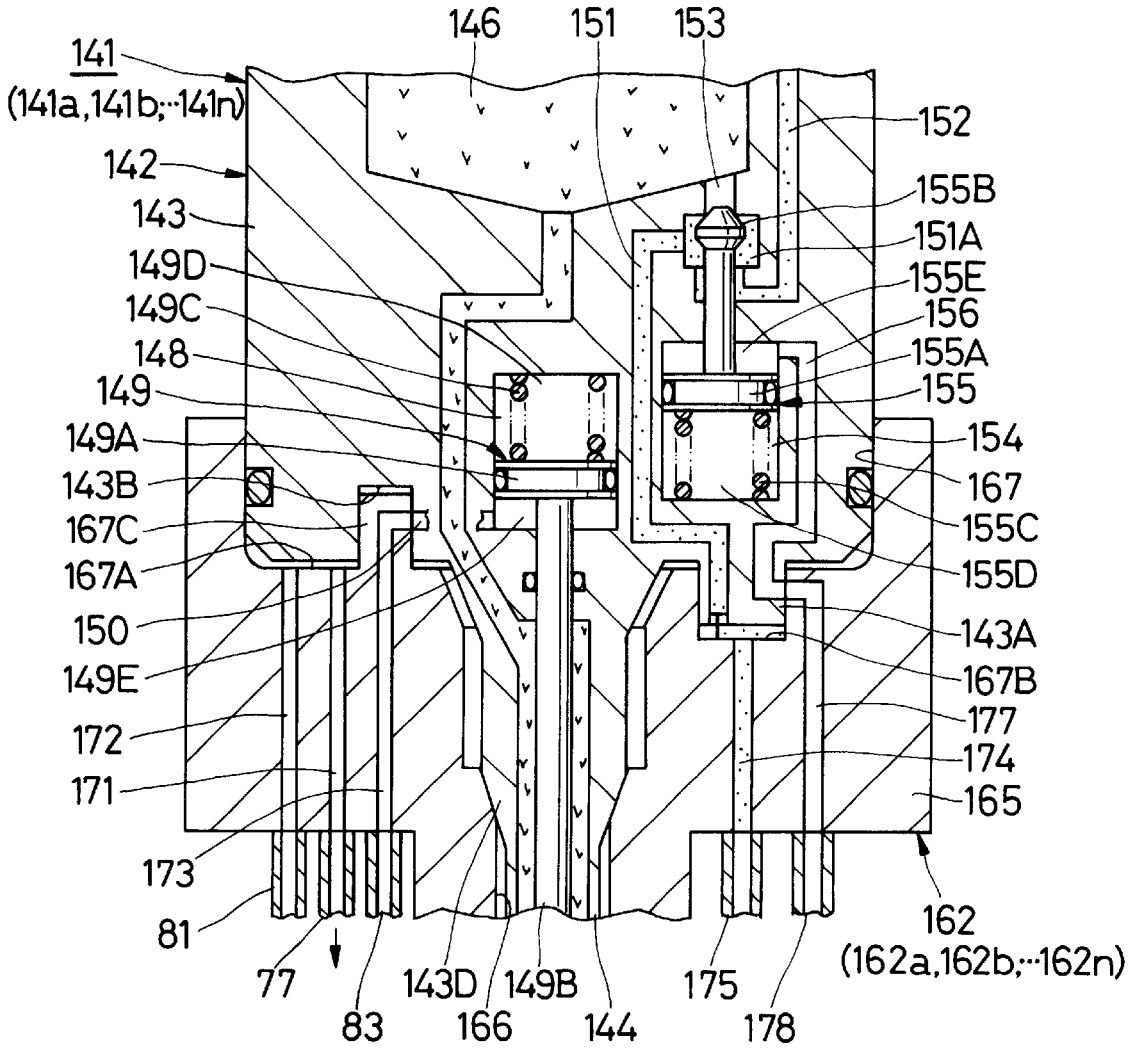
FIG. 19 is a fragmentary vertical sectional view, showing on an enlarged scale the paint cartridge and the paint replenisher of FIG. 17, in a stage of extruding paint.
Figure 20:
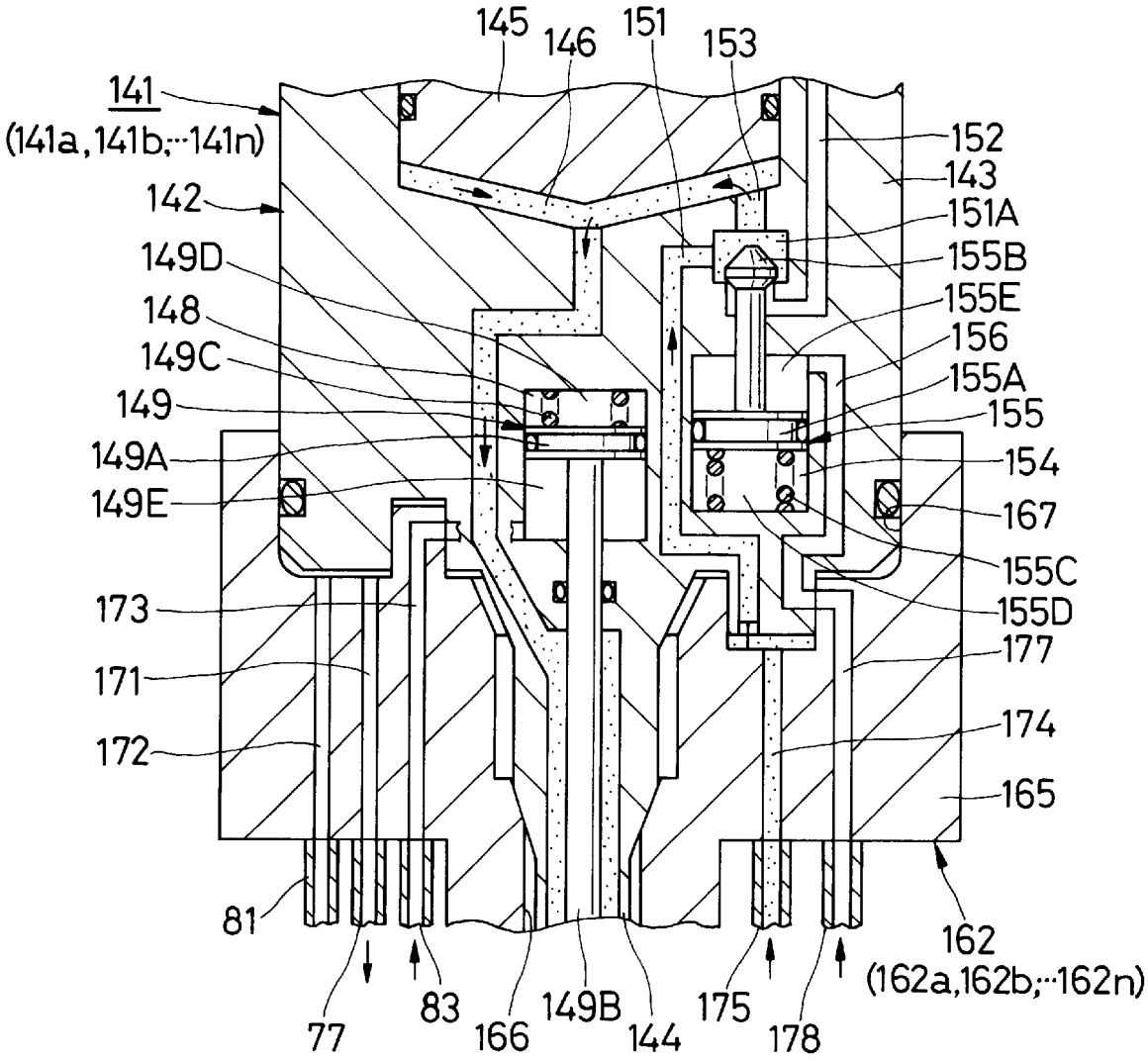
FIG. 20 is a fragmentary vertical sectional view, showing on an enlarged scale the paint cartridge and the paint replenisher of FIG. 17, in a washing stage.
Figure 21:
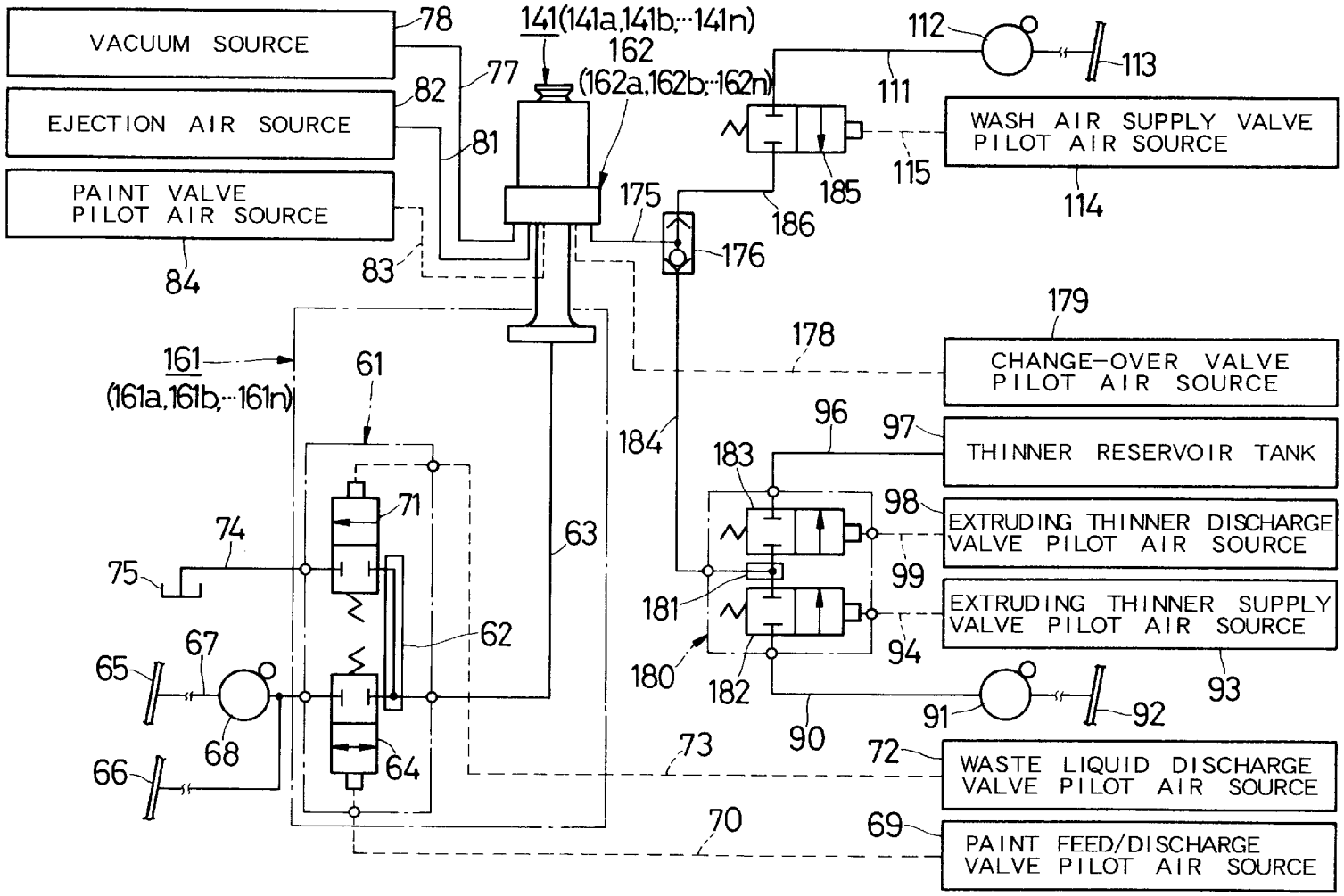
FIG. 21 is a circuit diagram of a paint replenisher which is allotted to frequently used exclusive colors.

The casing 142, which determines the outer configuration of the paint cartridge 141, is largely composed of a container 143 and a feed tube 144. In this instance, as shown in FIGS. 19 and 20, the container 143 is provided with a male coupling portion 143A and a female connector 143B at corresponding positions with respect to female and male coupling portions 167B and 167C on a container support portion 167 which will be described hereinafter. The container 143 is provided with a knob portion 143C at its rear end. Further, the container 143 is provided with a conical projection 143D at the center of its front end.

Denoted at 145 is the piston which is axially slidably received in an inner cylindrical cavity of the container 143. By the piston 145, the inner cavity of the container 143 is divided into a paint chamber 146 which is in communication with the feed tube 144 and a branched wash fluid passage 153, which will be described later on, and a-paint-extruding thinner chamber 147 which is in communication with a branched extruding thinner passage 152 which will also be described hereinlater.

Indicated at 148 is a paint valve receptacle cavity portion which is provided in the container 143. This paint valve receptacle portion 148 is located in a position on the center axis of the container 143 and between the feed tube 144 and the paint chamber 146.

Indicated at 149 is a paint valve which is provided in the above-mentioned paint valve receptacle portion 148. Similarly to the paint valve 41 in the foregoing first embodiment, the paint valve 149 is constituted by a piston member 149A, a valve member 149B and a valve spring 149C. The paint valve receptacle portion 148 is divided by piston member 149A into a spring chamber 149D and a pressure receiving chamber 149E. In this instance, one end of a pilot air passage 150 on the side of the paint cartridge is connected to the pressure receiving chamber 149E, and the other end of the pilot air passage 150 is opened in an inner peripheral surface of the female coupling portion 143B of the cartridge container 143.

Indicated at 151 is a common inlet port which is opened in a fore end face of the male coupling portion 143A of the container 143. The common inlet port 151 is extended internally of the container 143 toward the paint chamber 146 and its inner end is formed into a switching chamber 151A. In this instance, the common inlet port 151 provides a common circulation passage for extruding thinner (wash thinner) and for wash air which are fed from branched extruding thinner passage 152 and branched wash fluid passage 153, which will be described hereinafter. The common inlet port 151 is connectable to a common passage 174 on the side of the replenishing stool which will be described later on.

Indicated at 152 is the branched extruding thinner passage which is extended axially through outer peripheral portions of the cartridge container 143, for circulation of extruding thinner. One end of this branched extruding thinner passage 152 is connected to the switching chamber 151A of the common inlet port 151, while the other end is connected to the extruding thinner chamber 147.

Indicated at 153 is the branched wash fluid passage which is provided for circulation of wash thinner and wash air. One end of this branched wash fluid passage 153 is connected to the switching chamber 151A of the common inlet port 151, while the other end is connected to the paint chamber 146 at a position to the outer periphery of the latter separately from the feed tube 144.

In this instance, the branched extruding thinner passage 152 and the branched wash fluid passage 153 are opened at confronting positions in the axial direction of the cartridge container 143, in which the valve member 155B of the change-over valve 155 is displaced as described hereinafter. Accordingly, by means of the valve member 155B, either one of the passages 152 and 153 is selected and communicated with the common inlet port 151.

Denoted at 154 is a change-over valve receptacle cavity portion which is provided in the container 143 and located on an outer peripheral side of the paint valve receptacle portion 148.

Indicated at 155 is a change-over valve which is provided in the change-over valve receptacle portion 154 as a wash fluid valve. The change-over valve 155 is constituted by a piston 155A which is slidably fitted in the change-over valve receptacle portion 154, a valve member 155B which is attached to the piston 155A at its base end and extended into the switching chamber 151A at its fore end for selectively opening or closing the branched extruding thinner passage 152 and the branched wash fluid passage 153, a valve spring 155C which is adapted to exert a biasing force on the valve member 155B through the piston 155A in a direction of closing the branched wash fluid passage 153. Further, by the piston 155A, the change-over valve receptacle portion 154 is divided into a spring chamber 155D and a pressure receiving chamber 155E.

Normally, under the influence of the biasing action of the valve spring 155C, the valve member 155B of the change-over valve 155 is retained in a close position to block the branched wash fluid passage 153 as shown in FIG. 19, circulating extruding thinner from the common inlet port 151 to the branched extruding thinner passage 152. On the other hand, as soon as pilot air is supplied to the pressure receiving chamber 155E from a change-over valve pilot air source 179, which will be described after, through a pilot air passage 156 on the side of the paint cartridge, the valve member 155B is shifted against the biasing action of the valve spring 155C to close the branched extruding thinner passage 152 as shown in FIG. 20. Whereupon, extruding thinner is supplied as a wash fluid to the branched wash fluid passage 153 through the common inlet port 151, along with wash air.

In this instance, one end of the pilot air passage 156 on the side of the paint cartridge is opened in a circumferential surface of the male coupling portion 143A of the container 143 at a corresponding position with respect to the pilot air passage 177 on the side of the replenishing stool, while the other end of the pilot air passage 156 is communicated with the pressure receiving chamber 155E of the change-over valve 155.

According to the present embodiment, the paint replenishers are arranged as described below with reference to FIGS. 17 to 22.

Indicated at 161*a*, 161*b*, . . . 161*n* are paint replenisher (hereinafter collectively referred to as "paint replenisher 161") which are employed in the present embodiment in place of the paint replenishers 51 in the foregoing first embodiment. The paint replenisher 161 are provided for replenishing paint cartridges 141 of exclusive colors a, b, . . . n, which are used at a relatively high frequency. Each paint replenisher 161 is largely constituted by a replenishing stool 162, a feed tube passage hole 166 on the side of the replenishing stool, and a connector member 169.

Designated at 162*a*, 162*b*, . . . 162*n* are replenishing stools (hereinafter collectively referred to as "replenishing stools 162" for brevity) of the paint replenisher 161*a*, 161*b*, . . . 161*n*, respectively. Substantially similarly to the replenishing stools 52 in the above-described first embodiment, the replenishing stools 162 are each largely constituted by a foot portion 163, a column portion 164 and a seat portion 165. In addition to the replenishing stools 162*a*, 162*b*, . . . 162*n* which are allotted to exclusive colors, the paint replenisher 187 further include a replenishing stool 162*p* (see FIG. 22) which is allotted to less frequently used colors.

Indicated at 166 is a feed tube passage on the side of the replenishing stool, which is formed vertically through the column portion 164 of the replenishing stool 162, and at 167 is a container support portion which is provided at one axial end (on the upper side) of the seat portion 165. In this instance, as shown particularly in FIG. 19, a female coupling portion 167B and a male coupling portion 167C are separately provided at the bottom portion 167A of the container support portion 167 for fitting engagement with the male and female coupling portions 143A and 143B on the side of the cartridge container 143, respectively.

Indicated at 168 is a connector receptacle bore which is formed axially in a lower end portion of the replenishing stool 162 at a deeper position than the feed tube passage hole 166 on the side of the replenishing stool, and at 169 is a connector member which is vertically movably received in the connector receptacle bore 168. In this instance, the connector member 169, which is formed similarly to the connector member 59 of the first embodiment in construction, is constantly urged in an upward direction by a coil spring 170.

Denoted at 171 is a suction air passage which is provided in the seat portion 165 and opened to the bottom portion 167A of the container support portion 167. This suction air passage 171 is connected to a vacuum source 78 through vacuum piping 77. Further, indicated at 172 is an ejection air passage which is also opened to the bottom portion 167A of the container support portion 167. This ejection air passage 172 is connected to an ejection air source 82 through air piping 81.

Denoted at 173 is a pilot air passage which is formed in the seat portion 165 of the replenishing stool. One end of this pilot air passage 173 on the side of the replenishing stool is connected to the paint valve pilot air source 84 through pilot air piping 83, while the other end of the pilot air passage 173 is opened in a circumferential surface of the male coupling portion 167C of the container support portion 167 at a corresponding position with respect to the pilot air passage 150 on the side of the paint cartridge.

On the other hand, indicated at 174 is a common passage which is provided in the seat portion 165 of the replenishing stool 162, for circulation of wash thinner which is supplied at the time of extruding paint in the paint chamber 146 or at the time of washing away deposited paint from the paint chamber 146 and feed tube 144, and for circulation of wash air which is supplied at the time of washing away paint from the paint chamber 146. One end of the common passage 174 is connected through a fluid hose 175 to a shuttle valve 176 which will be described hereinafter, while the other end is opened in a bottom surface of the female coupling portion 167B of the container support portion 167 at a corresponding position with respect to the common inlet port 151.

Indicated at 176 is the shuttle valve which is as a selector valve. This shuttle valve 176 has its inlet side connected to an extruding thinner feed/discharge valve 180 and a wash air supply valve 185, which will be described hereinafter, and has its outlet side connected to the replenishing stool 162 through a fluid hose 175. In this instance, by way of the shuttle valve 176, either extruding thinner, which is supplied from the extruding thinner feed/discharge valve 180 through a thinner hose 184, or wash air, which is supplied from the wash air supply valve 185 through an air hose 186, is selectively supplied to the side of the paint cartridge 141 through the fluid hose 175. Further, the shuttle valve 176 also functions to prevent thinner from flowing toward the wash air supply valve 185 from the side of the extruding thinner feed/discharge valve 180, and at the same time to prevent wash air from flowing toward the extruding thinner feed/discharge valve 180 from the side of the wash air supply valve 185.

Indicated at 177 is a pilot air passage which is provided in the seat portion 165 of the replenishing stool 162, for supply of pilot air for switching the change-over valve 155. One end of this pilot air passage 177 on the side of the replenishing stool is connected to a change-over valve pilot air source 179 through pilot air piping 178. The other end of the pilot air passage 177 is opened in an inner peripheral surface of the female coupling portion 167B of the container support portion 167 at a corresponding position with respect to the pilot air passage 156 on the side of the paint cartridge.

Denoted at 180 is the extruding thinner feed/discharge valve which is provided as an extruding liquid feed valve. Similarly to the extruding thinner feed/discharge valve 86 in the first embodiment, this extruding thinner feed/discharge valve 180 is constituted by a manifold 181, an extruding thinner supply valve 182, and an extruding thinner discharge valve 183. Through a thinner hose 184, the extruding thinner feed/discharge valve 180 is connected to the shuttle valve 176.

According to the present embodiment, thinner which is supplied from the extruding thinner supply valve 182 of the extruding thinner feed/discharge valve 180 is sent either to the extruding thinner chamber 147 of the paint cartridge 141 as paint-extruding thinner which pushes paint forward, or to the paint chamber 146 as wash thinner which washes paint off.

Indicated at 185 is a wash air supply valve which supplies wash air to the paint chamber 146 of the cartridge 141. Similarly to the wash air supply valve 110 in the first embodiment, this wash air supply valve 185 is connected to a wash air supply line 113 through a pilot air piping 111 and a pressure regulator 112. Further, the wash air supply valve 185 is connected to the shuttle valve 176 through an air hose 186.

Figure 22:
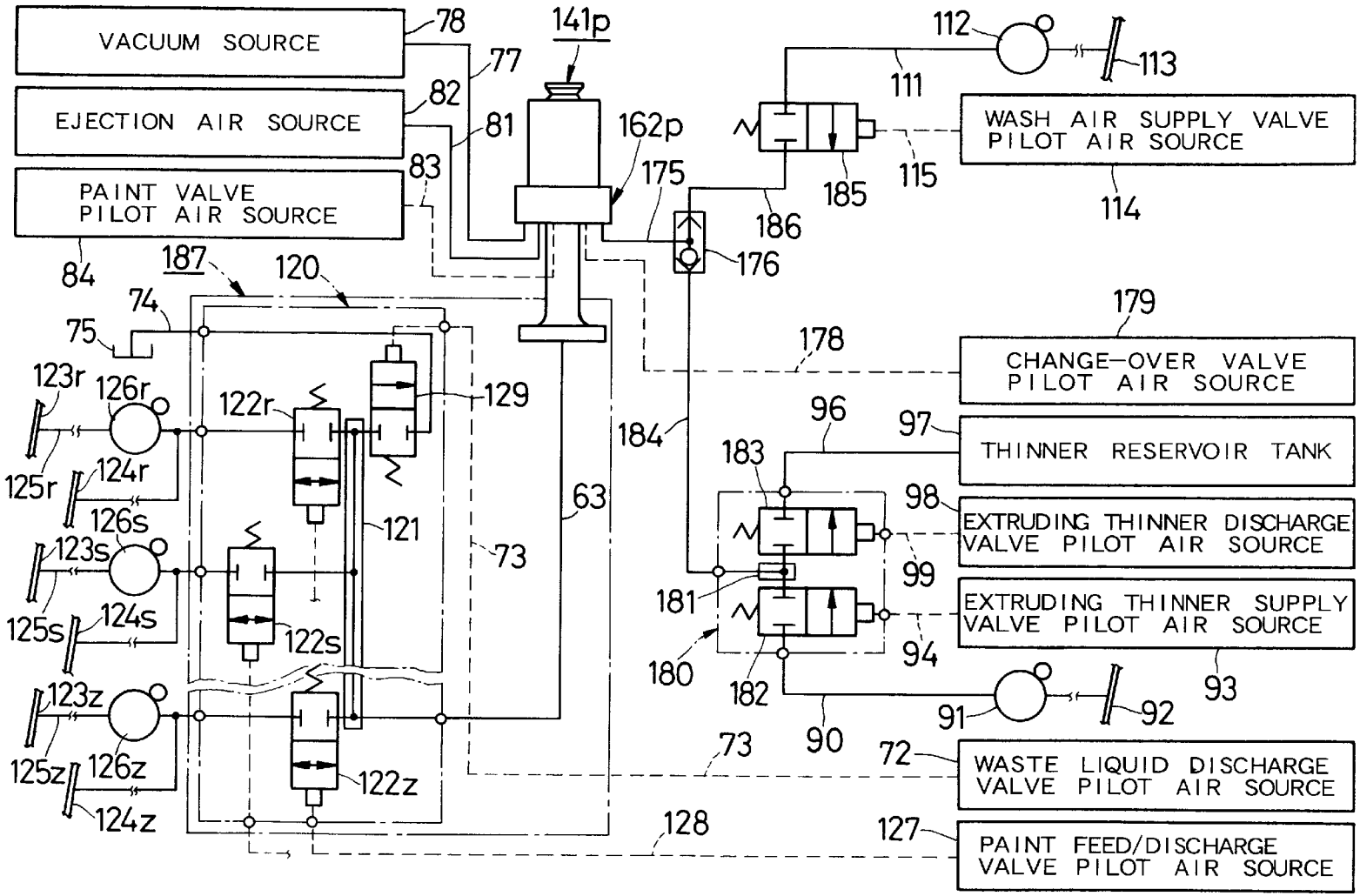
FIG. 22 is a circuit diagram of a paint replenisher which is allotted to less frequently used colors.

Indicated at 187 in FIG. 22 is another paint replenisher which is allotted to less frequently used paint colors. This paint replenisher 187 is provided with a replenishing valve 120 for refilling, for example, less frequently used colors r, s, . . . z as described hereinbefore in connection with the first embodiment.

In the case of the cartridge type coating system according to the present embodiment, paint is replenished into the paint cartridges 141 by the use of the paint replenishers 161 and 187 in the manner as described below with reference to FIGS. 20 to 24.

Figure 23:
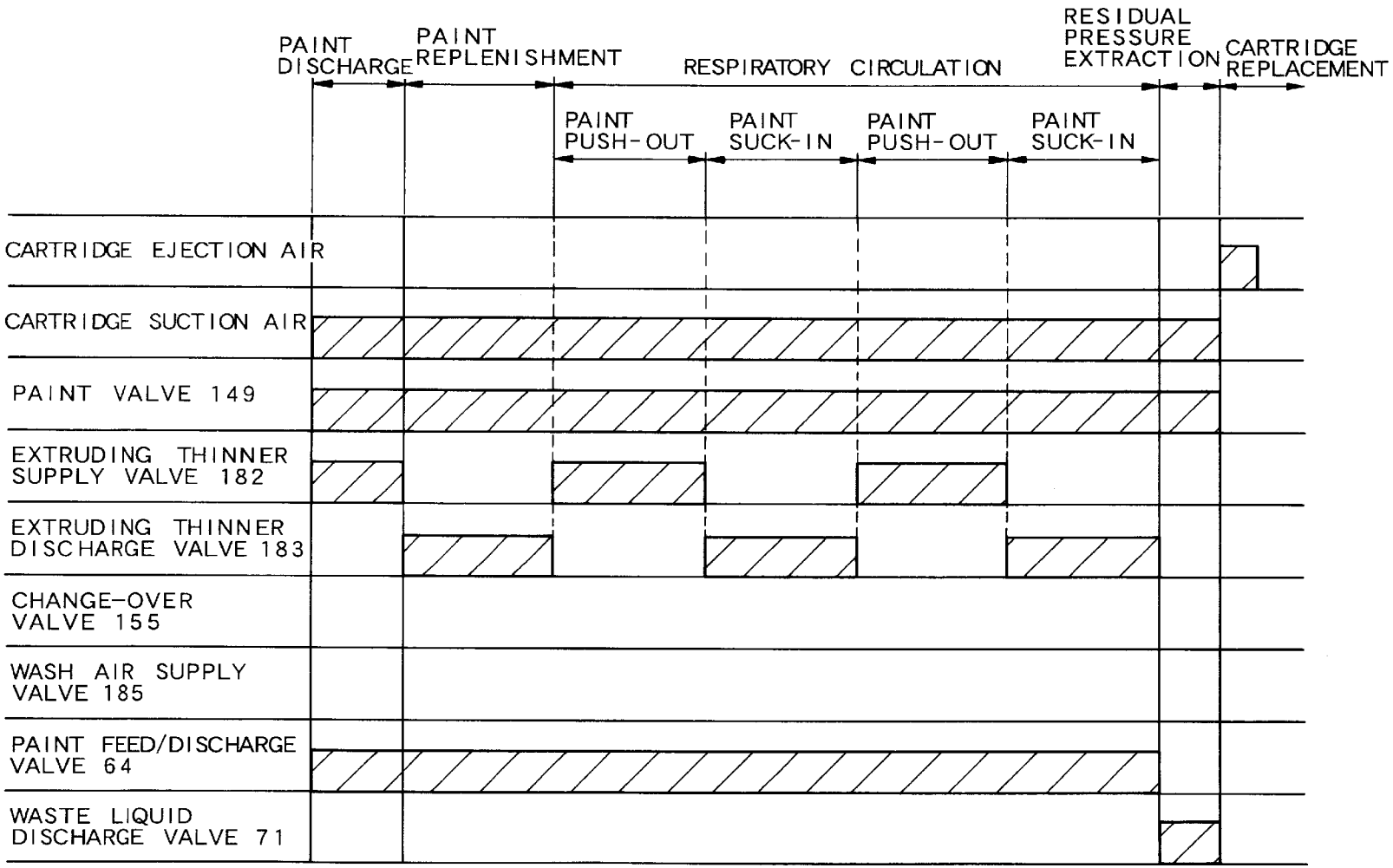
FIG. 23 is a time chart of a paint replenishing operation by a paint replenisher which is allotted to frequently used exclusive colors.

Firstly, described below with reference to the time chart of FIG. 23 is an operation for replenishing a paint cartridge with an exclusive color which is used at a relatively high frequency, for example, an operation of replenishing a paint color a by the use of the paint replenisher 161.

Firstly, prior to starting a replenishing operation, it is necessary to discharge from a paint cartridge 141*a* residues of the paint color a which still remain in the cartridge after use in a previous coating operation. In order to discharge paint residues from the cartridge 141*a*, the change-over valve 155 is held in the position of FIG. 19 to block the branched wash fluid passage 153 while connecting the common inlet port 151 to the branched extruding thinner passage 152. Then, the paint valve 149, the paint feed/discharge valve 64 and the extruding thinner supply valve 182 are opened.

Whereupon, the extruding thinner chamber 147 of the paint cartridge 141*a* is communicated with the extruding thinner feed/discharge valve 180 through the branched extruding thinner passage 152, common inlet port 151, common passage 174, fluid hose 175, shuttle valve 176 and thinner hose 184. Accordingly, upon opening the thinner supply valve 182 of the extruding thinner feed/discharge valve 180, extruding thinner from the thinner supply valve 182 is allowed to flow into the extruding thinner chamber 147 through the above-mentioned passages. Further, the paint chamber 146 of the cartridge 141*a* is communicated with the paint circulation piping 67 through the paint valve 149 and paint hose 63. As a consequence, by the pressure of extruding thinner which is supplied to the extruding thinner chamber 147, paint in the paint chamber 146 is pushed out toward the paint circulation piping 67 and returned to the paint tank via the paint return line 66.

Nextly, as soon as the paint chamber 146 of the cartridge 141*a* is evacuated almost completely, paint of the color a is replenished into the paint chamber 146 afresh.

To start paint replenishment, the extruding thinner valve 182 is closed and the extruding thinner discharge valve 183 is opened to put the extruding thinner chamber 147 substantially under the atmospheric pressure. Whereupon, paint from the paint circulation piping 67 is sent into the paint chamber 146 through the paint feed/discharge valve 64 and the paint valve 149.

In this instance, in case there is some time before the replenished paint cartridge 141*a* is used for a next coating operation, it is retained in a standby state. In the standby state, paint in the cartridge is put in respiratory circulation by alternately repeating the above-described paint push-out and suck-in actions. By this respiratory circulation, paint is constantly inhaled and exhaled between the paint chamber 146 and the paint supply line 65 or the paint return line 66 to prevent separation and sedimentation of pigment components.

When the paint cartridge 141*a* in the standby state is to be used for a coating operation, the respiratory paint circulation is stopped at a time point when paint is filled into the paint chamber 146 by the above-described inhaling action. Then, the waste liquid discharge valve 71 is opened to discharge paint to the waste liquid tank 75 in an offset amount to residual pressures in the paint chamber 146, feed tube 144 and paint hose 63 to restore the atmospheric pressure there. Finally, the paint valve 149 is closed to finish the paint replenishment to the paint cartridge 141*a*.

After preparing the paint cartridge 141*a* for a coating operation in the manner as described above, suction air is cut off to cancel the suction grip on the paint cartridge, permitting to remove the paint cartridge 141*a* from the replenishing stool 162*a*.

Figure 24:
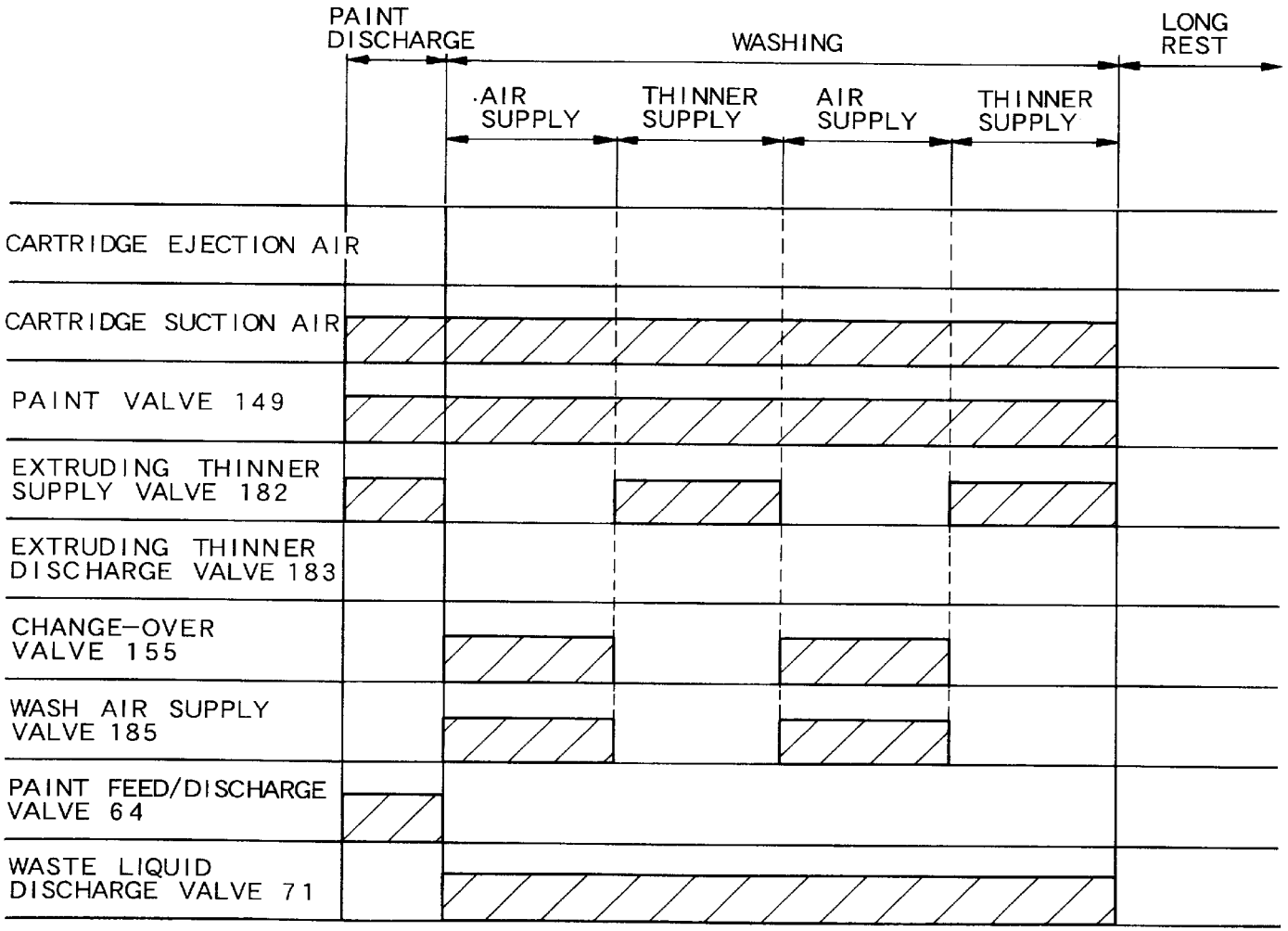
FIG. 24 is a time chart of an operation of washing a paint cartridge with air and thinner by the use of a paint replenisher which is allotted to frequently used exclusive colors.

Described below with reference to the time chart of FIG. 24 is a case in which a coating line is going to be put at rest for a long period of time.

In this case, in order to discharge residual paint from the paint cartridge 141*a*, the paint valve 149, the paint feed/discharge valve 64 and the extruding thinner supply valve 182 are opened, while the branched wash fluid passage 153 is held in a closed state by the change-over valve. Whereupon, extruding thinner which is supplied from the extruding thinner supply valve 182 is allowed to flow into the thinner chamber 147 to push paint in the paint chamber 146 toward the paint circulation piping 67 by the piston 145. At this time, a gap space is formed between the piston 145 and the paint chamber 146 for circulation of wash air and wash thinner.

Upon finishing the above-described residual paint discharging operation, the interior of the paint cartridge 141 is cleaned by a washing operation. A washing operation is started by supplying pilot air to the change-over valve 155 from the change-over valve pilot air source 179. Whereupon, the valve member 155B of the change-over valve 155 is shifted to block the branched extruding thinner passage 152 and instead open the branched wash fluid passage 153 as shown in FIG. 20. At the same time, the paint valve 149 and the waste fluid discharge valve 71 are opened.

In this state, the wash air supply valve 185 is opened to supply wash air to the paint chamber 146 from the wash air supply line 113 through the air hose 186, shuttle valve 176, fluid hose 175, common passage 174, common inlet port 151 and branched wash fluid passage 153. By introduction of wash air, paint residues in the paint chamber 146 are blown off and discharged through the feed tube 144 and paint hose 63.

In the next place, the wash air supply valve 185 is closed, and the extruding thinner supply valve 182 is opened. Whereupon, extruding thinner from the extruding thinner supply line 92 is supplied to the paint chamber 146 as wash thinner to wash away therewith deposited paint from the paint chamber 146, feed tube 144 and paint hose 63.

Then, the above-described supply of wash air as well the supply of wash thinner by means of the extruding thinner is repeated until the paint chamber 146 is finally filled with thinner. Thus, the paint cartridge is filled with thinner before it is put at rest for a long period of time.

Substantially the same operations as in the first embodiment are performed by the other paint replenisher 187 in changing and replenishing less frequently used colors, therefore descriptions in this regard are omitted here to avoid repetitions.

As clear from the foregoing description, according to the present embodiment, upon switching the change-over valve 155 in the paint cartridge 141 to connect the common inlet port 151 to the branched extruding thinner passage 152, paint in the paint chamber 146 can be returned to the side of the paint circulation piping 67 by the pressure of extruding thinner which is supplied from the extruding thinner feed/discharge valve 180. On the other hand, upon switching the change-over valve 155 to connect the common inlet port 151 to the branched wash fluid passage 153, extruding thinner from the extruding thinner feed/discharge valve 180 can be supplied into the paint chamber 146 as wash thinner. At the same time, wash air from the wash air supply valve 185 can be supplied into the paint chamber 146.

Accordingly, deposited paint within the paint chamber 146 can be washed away by the use of extruding thinner which is primarily used for extruding paint out of the paint chamber 146. Therefore, the above arrangements make it possible to omit a wash thinner supply valve and a circuit or passages to be used exclusively for wash thinner. It follows that the paint replenisher 161 can be simplified to a significant degree in construction to permit reductions in production cost as well as borader freedom in designing.

Figure 25:
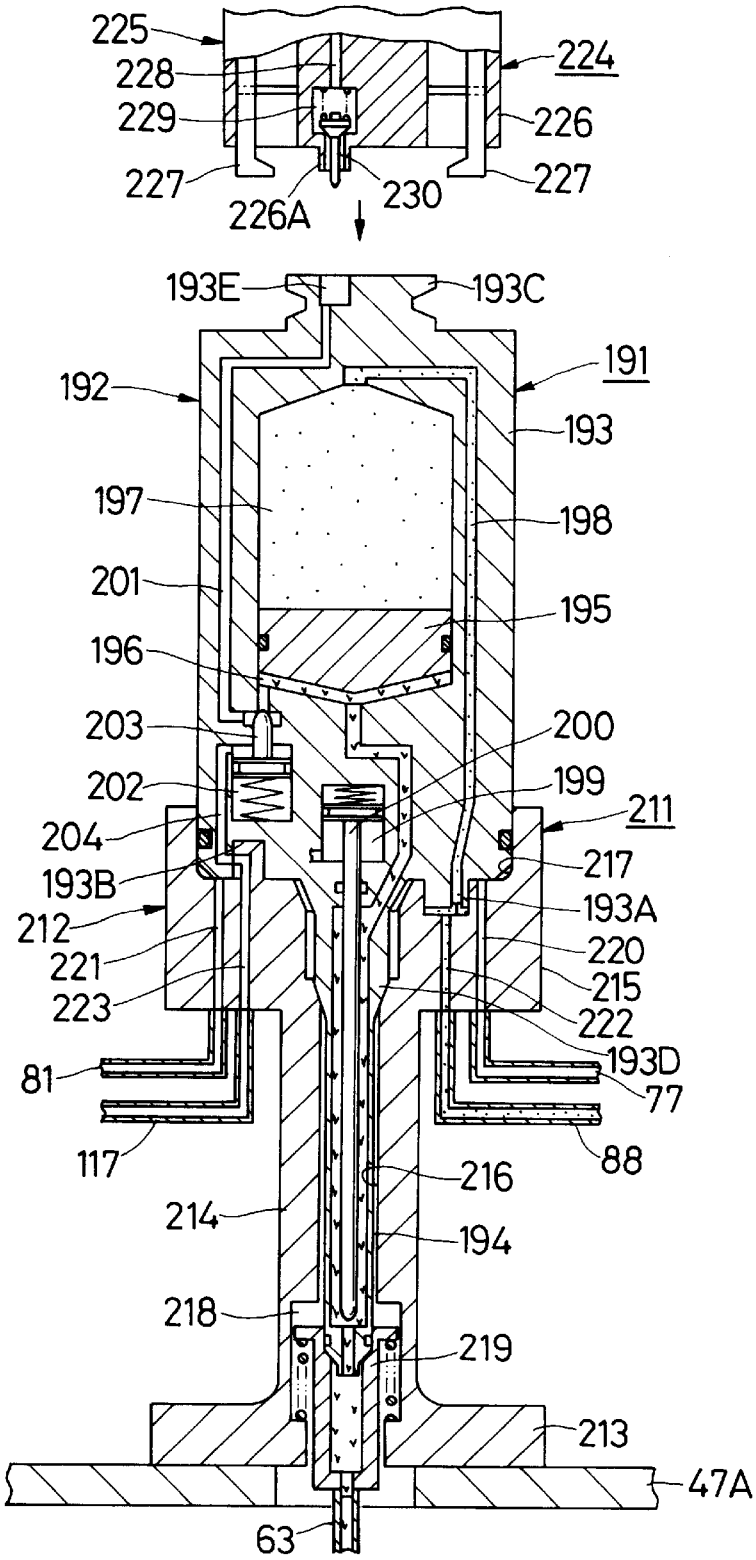
FIG. 25 is a vertical sectional view, showing a paint cartridge, a paint replenisher and cartridge gripper mechanism adopted in a third embodiment of the present invention, in a stage of discharging paint from the paint cartridge.
Figure 26:
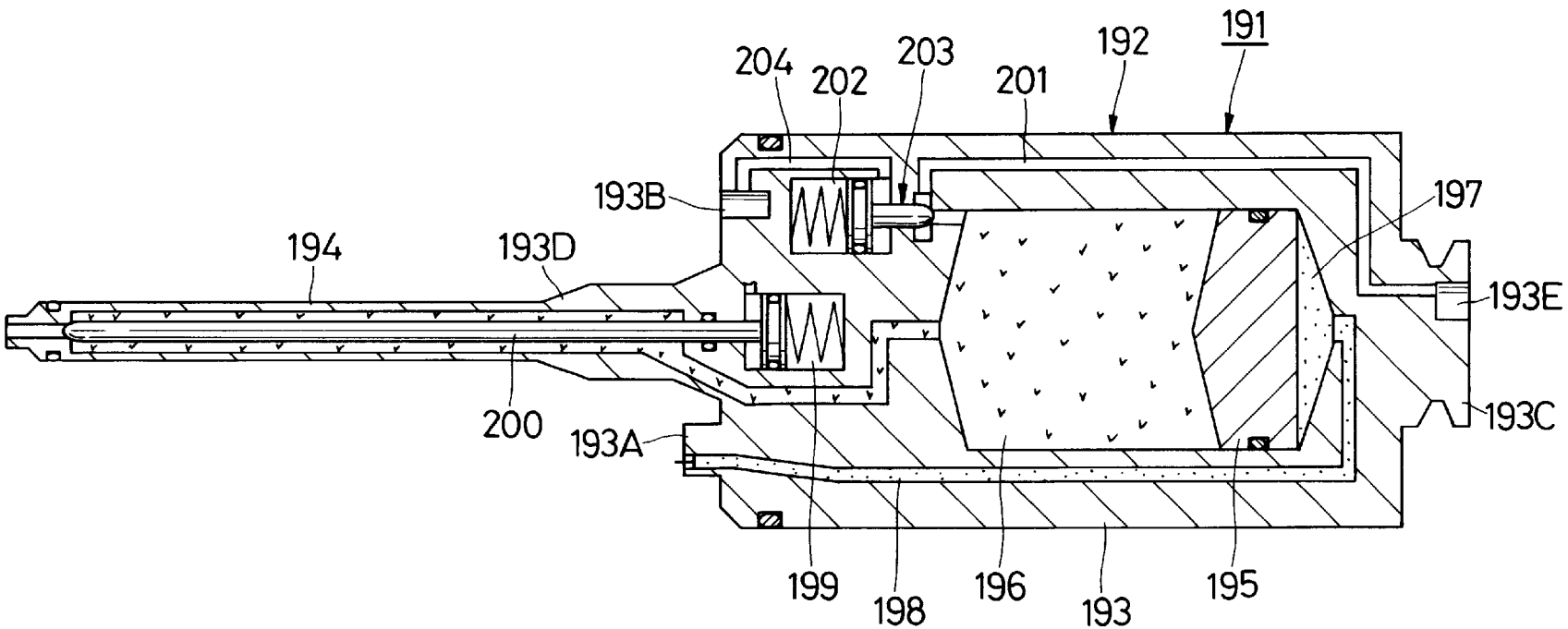
FIG. 26 is a vertical sectional view, showing the paint cartridge of FIG. 25 as one separate unit.
Figure 27:
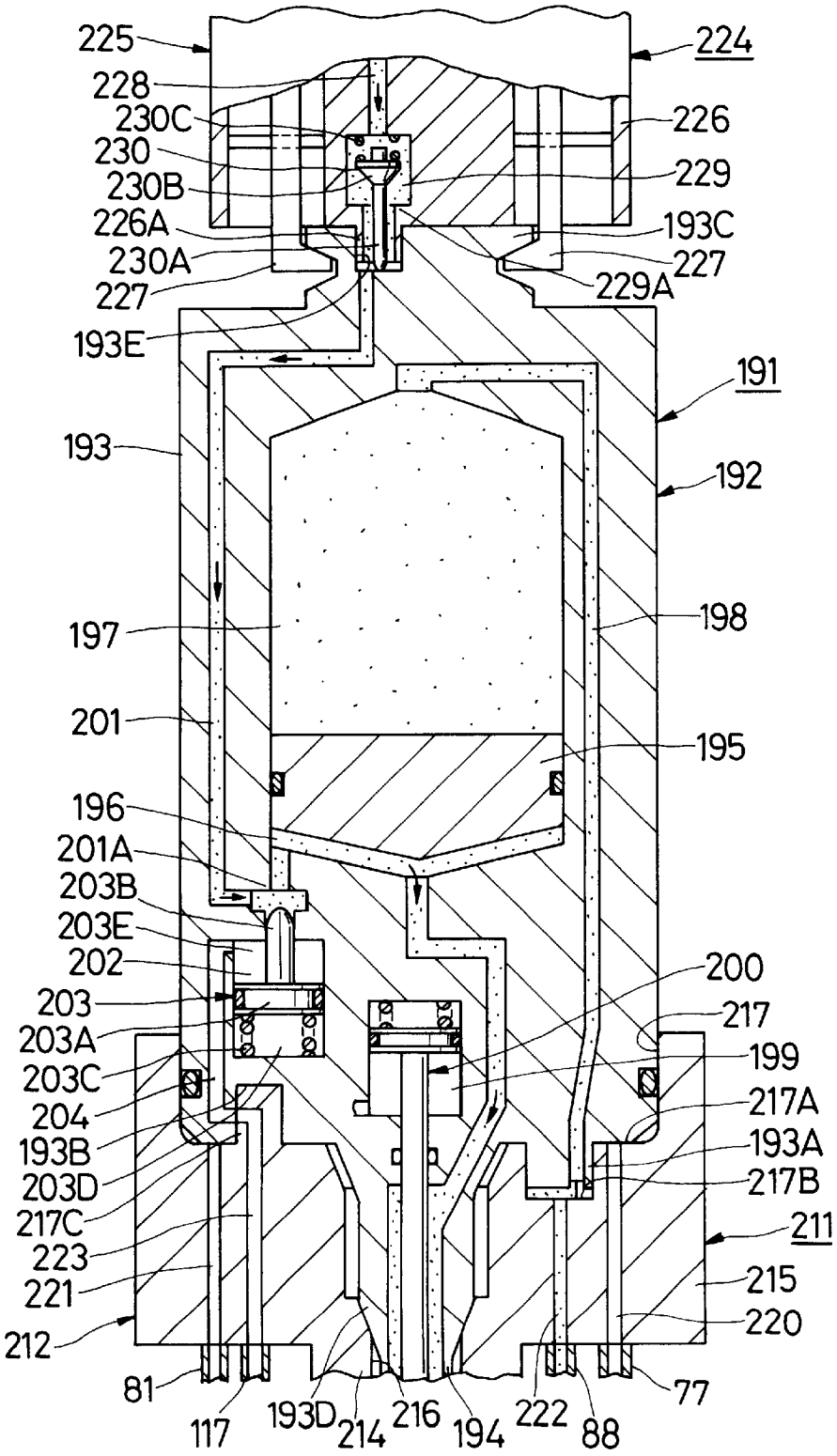
FIG. 27 is a fragmentary vertical section, showing on an enlarged scale a paint cartridge which is gripped by the cartridge gripper mechanism for washing a paint chamber in the cartridge.

Now, turning to FIGS. 25 to 27, there is shown a third embodiment of the present invention, with features in that a cartridge gripper mechanism is provided for transferring a paint cartridge between a paint replenisher and a sprayer unit and in that the cartridge gripper mechanism is constituted by a gripper and a wash fluid passage provided on the side of the gripper and connected to the wash fluid passage on the side of a paint cartridge when the latter is gripped by the gripper. The wash fluid passage on the side of the gripper is connected to a wash fluid supply valve which supplies a wash fluid to the paint chamber of the cartridge. In this case, it becomes possible to abolish the wash fluid passage on the side of the replenishing stool as in the above-described first embodiment. In the following description of the third embodiment, those component parts which are common or identical with the counterparts in the first embodiment are simply designated by the same or common reference numerals or characters to avoid repetitions of same explanations.

Indicated at 191 is a paint cartridge which is adopted by the present embodiment in place of the paint cartridge 31 of the first embodiment. Similarly to the cartridge 31 in the first embodiment, as shown in FIG. 26, the paint cartridge 191 is largely constituted by a casing 192, a piston 195, an extruding thinner passage 198, a paint valve 200, a wash fluid passage 201 and a wash fluid valve 203, which will be described hereinafter.

The casing 192, which determines the outer configuration of the paint cartridge 191, is largely constituted by a container 193, and a feed tube 194 which is projected axially forward from a conical projection 193D at the fore end of the container 193.

Similarly to the container 33 in the first embodiment, the container 193 constitutes a main part of the casing 192, and is provided with a male coupling portion 193A, a female coupling portion 193B, a knob portion 193C and a conical projection 193D. However, the container 193 of the present embodiment differs from the container 33 of the first embodiment in that it is provided with another female coupling portion 193E on an end face of the knob portion 193C at a corresponding position with respect to a male coupling portion 226A of the casing 226, which will be described hereinafter. The inside of the container 193 is divided into a paint chamber 196 and a paint-extruding thinner chamber 197, by the piston 195 which is fitted in the container 193.

Indicated at 198 is an extruding thinner passage which is provided in the container 193 of the paint cartridge for circulation of extruding thinner to and from the extruding thinner chamber 197. One end of the extruding thinner passage 198 on the side of the paint cartridge is opened in a fore end face of the male coupling portion 193A of the cartridge container 193, while the other end of the thinner passage 198 is communicated with the extruding thinner chamber 197 of the cartridge.

Denoted at 199 is a paint valve receptacle cavity portion which is provided on the front side of the cartridge container 193, and at 200 a paint valve which is provided in the paint valve receptacle portion 199. The paint valve 200 of this embodiment is arranged in the same manner as the paint valve 41 in the foregoing first embodiment.

Indicated at 201 is a wash fluid passage of the present embodiment, which is formed in the container 193 of the paint cartridge 191. More specifically, this wash fluid passage 201 on the side of the paint cartridge is formed axially through outer peripheral portions of the container shell. One end of the wash fluid passage 201 is opened in a bottom surface of the female coupling portion 193E which is provided in the knob portion 193C of the container 193, while the other end of the wash fluid passage 201 is communicated with the paint chamber 196 at an outer peripheral position on the bottom surface of the latter. In this instance, valve seat portion 201A is provided at the other end of the wash fluid passage 201 on the side of the paint cartridge for seating and unseating a valve member 203B of a wash fluid valve 203 which will be described below.

Designated at 202 is a valve receptacle cavity portion which is provided in the cartridge container 193 and which is located on the outer side of and parallel with the paint valve receptacle portion 199.

Indicated at 203 is the wash fluid valve which is provided in the valve receptacle portion 202. Similarly to the wash fluid valve 45 in the above-described first embodiment, the wash fluid valve 203 of this embodiment is provided with a piston member 203A, a valve member 203B and a valve spring 203C as shown in FIG. 27. By the piston member 203A, the valve receptacle portion 202 is divided into a spring chamber 203D and a pressure receiving chamber 203E. Further, a fore end portion of the valve member 203B is extended into the wash fluid passage 201 on the side of the paint cartridge for seating on and off the valve seat portion 201A.

Further, indicated at 204 is a pilot air passage on the side of the paint cartridge, which is connected to the wash fluid valve 203. One end of this pilot air passage 204 is opened in an inner surface of the female coupling portion 193B of the container 193 at a corresponding position with respect to a pilot air passage 223 on the side of the replenishing stool. The other end of the pilot air passage 204 is communicated with the pressure receiving chamber 203E of the wash fluid valve 203.

Now, indicated at 211 is a paint replenisher which is adopted by the present embodiment in place of the paint replenisher 51 of the foregoing first embodiment. The paint replenisher 211 according to the present embodiment differs from the paint replenisher 51 of the first embodiment in that it is not provided with a wash fluid passage in its replenishing stool 212. The replenishing stool 212 which is employed in the present embodiment is constituted by a foot portion 213, a column portion 214 and a seat portion 215. Further, a feed tube passage hole 216 is axially through the replenishing stool 212, and a container support portion 217 is formed on the seat portion 215.

In this instance, similarly to the container support portion 57 of the first embodiment, the above-mentioned container support portion 217 is formed with a bottom portion 217A, a female coupling portion 217B and a male coupling portion 217C. Further, the replenishing stool 212 is internally provided with a connector member receptacle bore 218 to accommodate a connector member 219 therein. Furthermore, an air suction passage 220, an ejection air supply passage 221, an extruding thinner passage 222 and a pilot air passage 223 for the wash fluid valve 203 are provided in the seat portion 215 of the replenishing stool 212.

Now, indicated at 224 is a cartridge gripper mechanism which is adopted by the present embodiment in place of the cartridge gripper mechanism 130 of the first embodiment. This cartridge gripper mechanism 224 is provided with a gripper 225. In this instance, the gripper 225 is largely constituted by a casing 226, a pair of gripper pawls 227 which are movable toward and away from each other for gripping a knob portion 193C of a paint cartridge 191, and a cylinder device (not shown) which is provided in the casing 226 to move the gripper pawls toward and away from each other, substantially in the same manner as the gripper 131 in the foregoing first embodiment.

The gripper 225 of the present invention, however, differs from the gripper 131 of the first embodiment in that a male coupling portion 226A is provided on the casing 226 for fitting engagement with the female coupling portion 193E on the side of the cartridge container 193, and in that it is provided with a wash fluid passage 228 and a quick joint 230 as will be described hereinafter.

Indicated at 228 is the wash fluid passage which is provided in the casing 226 of the gripper. One end (the upstream end) of this wash fluid passage 228 on the side of the gripper is connected through a fluid hose (not shown) to a wash fluid supply valve (not shown) which supplies wash air in the same manner as the wash fluid supply valve 101 in the above-described first embodiment. On the other hand, the other end (the downstream end) of the wash fluid passage 228 is opened in a fore distal end face of the male coupling portion 226A of the casing 226.

Denoted at 229 is a valve receptacle cavity portion which is formed within the length of the wash fluid passage 228 and in the vicinity of the male coupling portion 226A of the casing 226. The valve receptacle portion 229 is so shaped as to provide a valve seat portion 229A at an end on the side of the male coupling portion 226A, for seating and unseating a valve member 230B of a quick joint 230 which will be described below.

Designated at 230 is the quick joint which is provided in the valve receptacle portion 229 of the casing 226. The quick joint 230 is largely constituted by a rod member 230A having a fore end portion thereof projected forward through the male coupling portion 226A, a valve member 230B located within the valve receptacle portion 229 and integrally connected to a base end portion of the rod member 230A, and a coil spring 230C adapted to constantly bias the valve member 230B in a seating direction or toward the valve seat portion 229A.

When the casing 226 of the gripper 225 is abutted against the knob portion 193C of the container 193 in order to grip the paint cartridge 191 as shown in FIG. 27, the fore end of the rod portion 230A of the quick joint 230 is abutted against a bottom portion of the female coupling portion 193E to open the valve member 230B. Whereupon, the wash fluid passage 228 is brought into communication with the wash fluid passage 201 on the side of the paint cartridge to permit circulation of wash thinner and air.

On the other hand, as soon as the cartridge gripper mechanism 224 is moved upward, releasing the paint cartridge 191 as shown in FIG. 25, the valve member 230B of the quick joint 230 is seated on the valve seat portion 229A by the biasing action of the coil spring 230C, closing the wash fluid passage 228 to prevent leaks of thinner from the wash fluid passage 228.

As clear from the foregoing detailed description, according to the present embodiment, a connecting port of the wash fluid passage 201 on the side of the paint cartridge 191 is located in the female coupling portion 193E which is in turn provided in the knob portion 193C of the cartridge container 193. In addition, the wash fluid passage 228 on the side of the gripper is provided in the casing 226 of the gripper 225 to supply wash thinner and air to the wash fluid passage 201 on the side of the paint cartridge. This arrangement permits to reduce the number of passages to be connected between the paint cartridge 191 and the paint replenisher 211 by abolishment of a number of fluid passages. Therefore, it becomes possible to simplify the construction of passage connecting portions, to permit broader freedom in designing and to improve the efficiency of assembling work.

Figure 28:
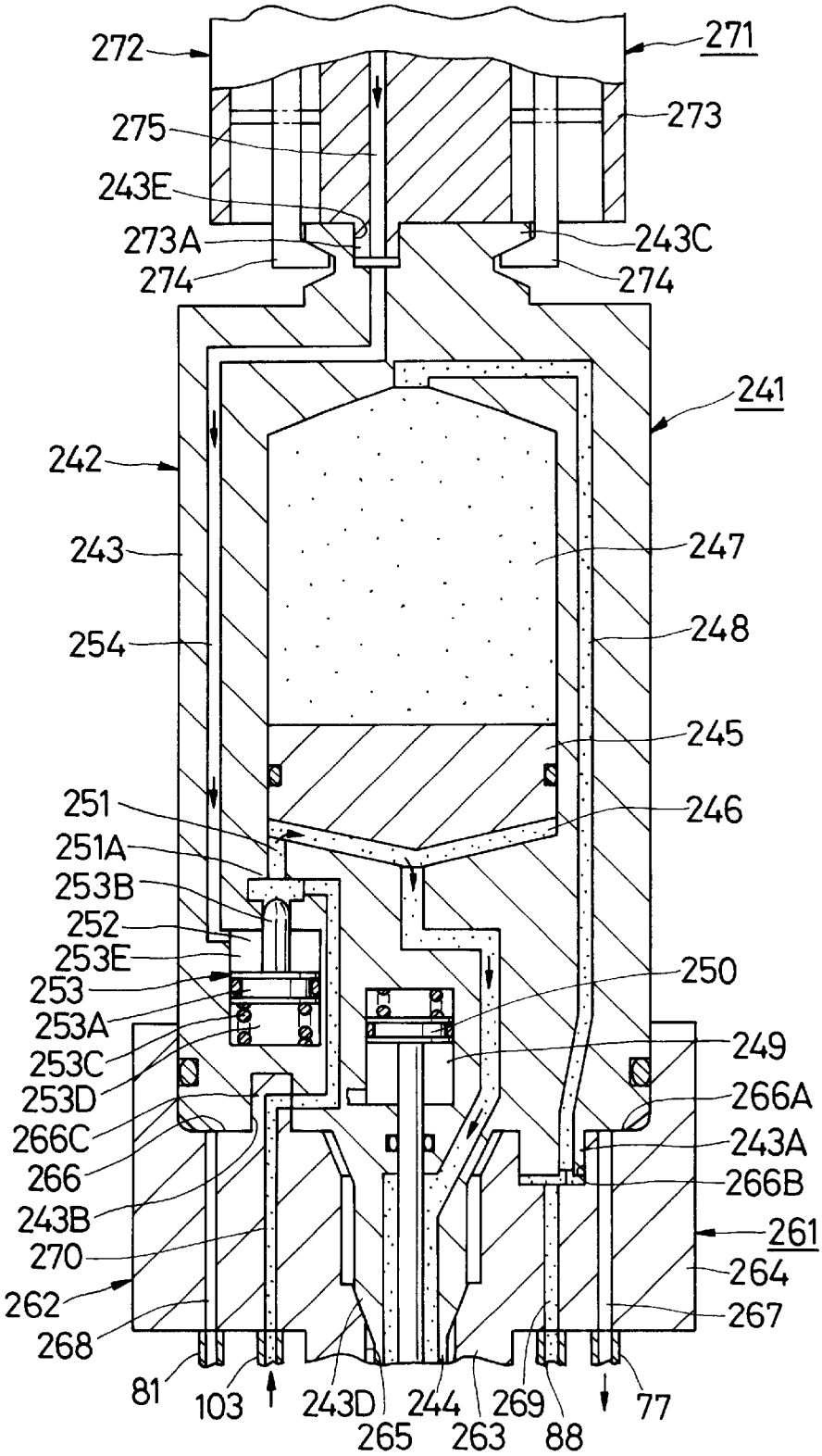
FIG. 28 is a vertical sectional view, showing a paint cartridge, a paint replenisher and a cartridge gripper mechanism adopted in a fourth embodiment of the present invention, in a stage of washing a paint chamber in the cartridge.
Figure 29:
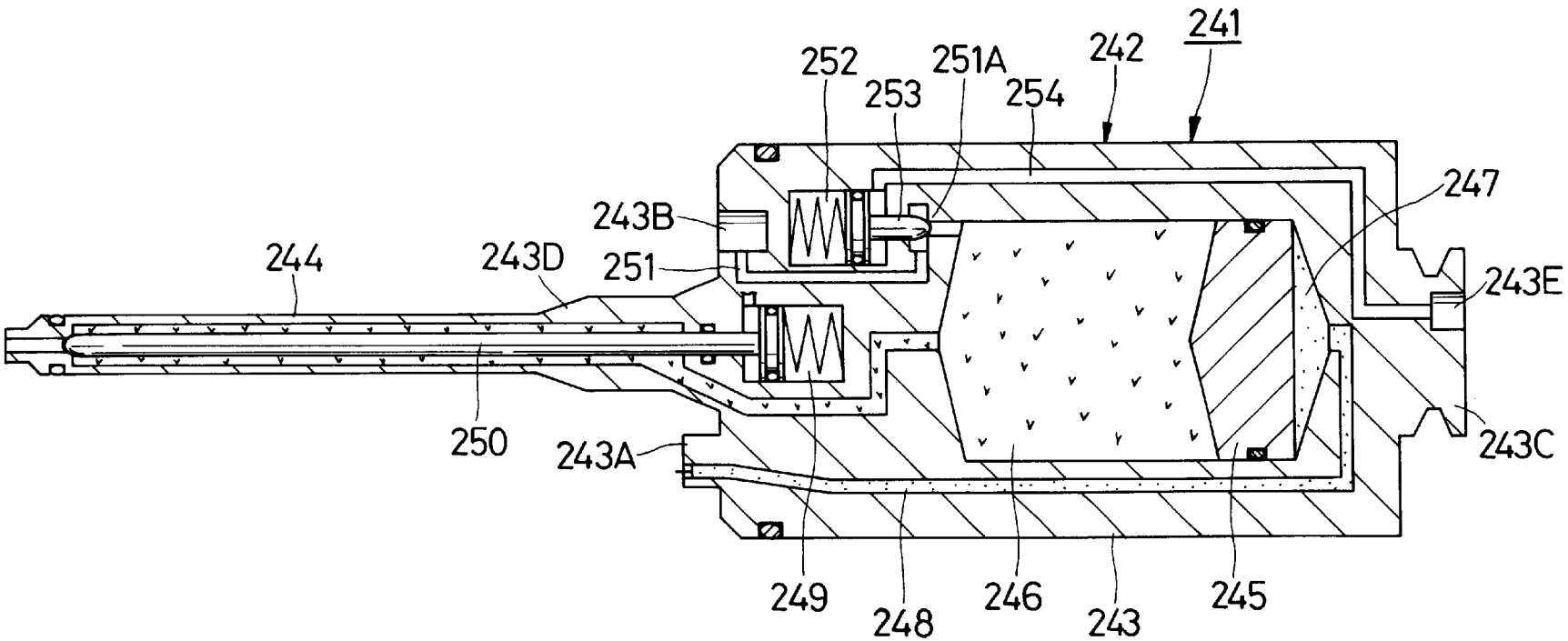
FIG. 29 is a vertical sectional view, showing the paint cartridge in FIG. 28 as a separate unit.

Turning now to FIGS. 28 and 29, there is shown a fourth embodiment of the present invention. This embodiment has features in that a cartridge gripper mechanism is provided for gripping and transferring a paint cartridge between the paint replenisher and the sprayer unit, and in that the cartridge gripper mechanism is constituted by a gripper to grip a paint cartridge and a pilot air passage to be connected to a wash fluid valve on the side of the paint cartridge when the latter is gripped by the gripper. The pilot air passage on the side of the gripper is connected to a pilot air source which supplies pilot air to the wash fluid valve on the side of the paint cartridge. This arrangement permit to abolish the pilot air passage which is provided in the replenishing stool in the foregoing first embodiment for supplying pilot air to the wash fluid valve. In the following description of the fourth embodiment, those component parts which are common or identical with the counterparts in the first embodiment are simply designated by common or same reference numerals or characters to avoid repetitions of same explanations.

Indicated at 241 is a paint cartridge which is adopted by the present embodiment in place of the paint cartridge 31 in the first embodiment. Similarly to the paint cartridge 31 of the first embodiment, the paint cartridge 241 is largely constituted by a casing 242, a piston 245, an extruding thinner passage 248, a paint valve 250, a wash fluid passage 251, and a wash fluid valve 253, which will be described below.

The casing 242, which determines the outer configuration of the paint cartridge 241, is largely constituted by a container 243, and a feed tube 244 which is projected axially forward from a conical projection 243D at the fore end of the cartridge container 243.

Similarly to the container 33 in the foregoing first embodiment, the container, which constitutes a main part of the casing 242, is provided with a male coupling portion 243A, a female coupling portion 243B, a knob portion 243C and a conical projection 243D. However, the container 243 of this embodiment differs from the container 33 of the first embodiment in that another female coupling portion 243E is provided in the end face of the knob portion 243C at a corresponding position with respect to a male coupling portion 273A on the side of the casing 273, which will be described later on. The internal space of the cartridge container 243 is divided into a paint chamber 246 and a paint-extruding thinner chamber 247, by the piston 245 which is slidably received in the container 243.

Indicated at 248 is an extruding thinner passage which is provided in the container 243 to circulate extruding thinner to and from the extruding thinner chamber 247. One end of this extruding thinner passage 248 on the side of the paint cartridge is opened in a fore distal end face of the male coupling portion 243A of the container 243, while the other end of the extruding thinner passage 248 is communicated with the extruding thinner chamber 247.

Denoted at 249 is a paint valve receptacle cavity portion which is provided in a fore end portion of the container 243, and at 250 is a paint valve which is provided in the paint valve receptacle portion 249. In this instance, the paint valve 250 is arranged in the same way as the paint valve 41 in the foregoing first embodiment.

Indicated at 251 is a wash fluid passage which is provided in the cartridge container 243. One end of this wash fluid passage 251 on the side of the paint cartridge is opened in an inner peripheral surface of the female coupling portion 243B, while the other end of the wash fluid passage 251 is communicated with the bottom portion of the paint chamber 246 at an outer peripheral position of the latter. In this instance, the wash fluid passage 251 on the side of the paint cartridge is provided with a valve seat portion 251A at the other end for seating and unseating a valve member 253B of the wash fluid valve 253, which will be described hereinafter.

Indicated at 252 is a valve receptacle cavity portion which is provided in the cartridge container 243. This valve receptacle portion 252 is located on the outer side of and substantially in parallel relation with the paint valve receptacle portion 249.

Designated at 253 is the wash fluid valve which is provided in the valve receptacle portion 252. Similarly to the wash fluid valve 45 in the foregoing first embodiment, the wash fluid valve 253 is provided with a piston member 253A, a valve member 253B and a valve spring 253C. By the piston member 253A, the valve receptacle portion 252 is divided into a spring chamber 253D and a pressure receiving chamber 253E. Further, a fore end portion of the valve member 253B is extended into the wash fluid passage 251 on the side of the paint cartridge for seating on and off the valve seat portion 251A.

Indicated at 254 is a pilot air passage according to the present embodiment, which is connected to the wash fluid valve 253. One end of this pilot air passage on the side of the paint cartridge is opened in a bottom surface of the female coupling portion 243E of the knob portion 243C of the container 243. The other end of the pilot air passage 254 is communicated with the pressure receiving chamber 253E of the wash fluid valve 253.

Next, designated at 261 is a paint replenisher which is adopted by the present embodiment in place of the paint replenisher 51 in the first embodiment. The paint replenisher 261 according to the present embodiment differs from the paint replenisher 51 of the first embodiment in that no pilot air passage is provided in its replenishing stool 262. The replenishing stool 262 of this embodiment is likewise constituted by a foot portion (not shown), a column portion 263 and a seat portion 264. Further, a feed tube passage hole 265 on the side of the replenishing stool is formed axially through the replenishing stool 262, and a container support portion 266 is formed on the seat portion 264.

In this instance, the container support portion 266 is provided with a bottom portion 266A, a female coupling portion 266B and a male coupling portion 266C, in a manner similar to the container support portion 57 in the first embodiment. Further, an air suction passage 267, an ejection air supply passage 268, an extruding thinner passage 269 and a wash fluid passage 270 are provided in the seat portion 264 of the replenishing stool 262.

Next, indicated at 271 is a cartridge gripper mechanism which is adopted by the present embodiment in place of the cartridge gripper mechanism 130 in the foregoing first embodiment. The cartridge gripper mechanism 271 is provided with a gripper 272 which is, similarly to the gripper 131 of the first embodiment, largely constituted by casing 273 and a pair of gripper pawls 274, which are supported on the casing 273 and movable toward and away from each other for gripping a knob portion 243C of a paint cartridge 241 therebetween.

However, the gripper 272 of the present embodiment differs from the gripper 131 of the first embodiment in that a male coupling portion 273A is provided on the casing 273 for fitting engagement with the female coupling portion 243E on the side of the cartridge container 243, along with a pilot air passage 275 on the side of the gripper as described below.

Namely, the pilot air passage 275 on the side of the gripper is formed in the casing 273, and its one end (the upstream end) is connected to a pilot air source (not shown), similar to the wash fluid valve pilot air source 118 in the first embodiment, through pilot air piping (not shown). The other end (the downstream end) of the pilot air passage 275 is opened in a fore distal end face of the male coupling portion 273A of the casing 273.

As the casing 273 of the gripper 272 is abutted against the knob portion 243C of the container 243 in order to grip a paint cartridge 241, the pilot air passage 275 on the side of the gripper is brought into communication with the pilot air passage 254 on the side of the paint cartridge to supply pilot air to the wash fluid valve 253 from the pilot air passage 275 on the side of the gripper.

As clear from the foregoing detailed description, according to the present embodiment, the connecting end of the pilot air passage 254 on the side of the paint cartridge 241 is located in the female coupling portion 243E of the knob portion 243C of the container 243. On the side of the gripper, the pilot air passage 275 is provided in the casing 273 to supply pilot air to the pilot air passage 254 on the side of the paint cartridge. Therefore, the arrangements of the present embodiment permit one to reduce the number of passages to be connected between the paint cartridge 241 and the paint replenisher 261 by abolishment of a pilot air passage. Namely, according to the arrangements of this embodiment, it becomes possible to simplify the construction of connecting portions, to give broader freedom in designing and to improve the efficiency of assembling work.

Figure 30:
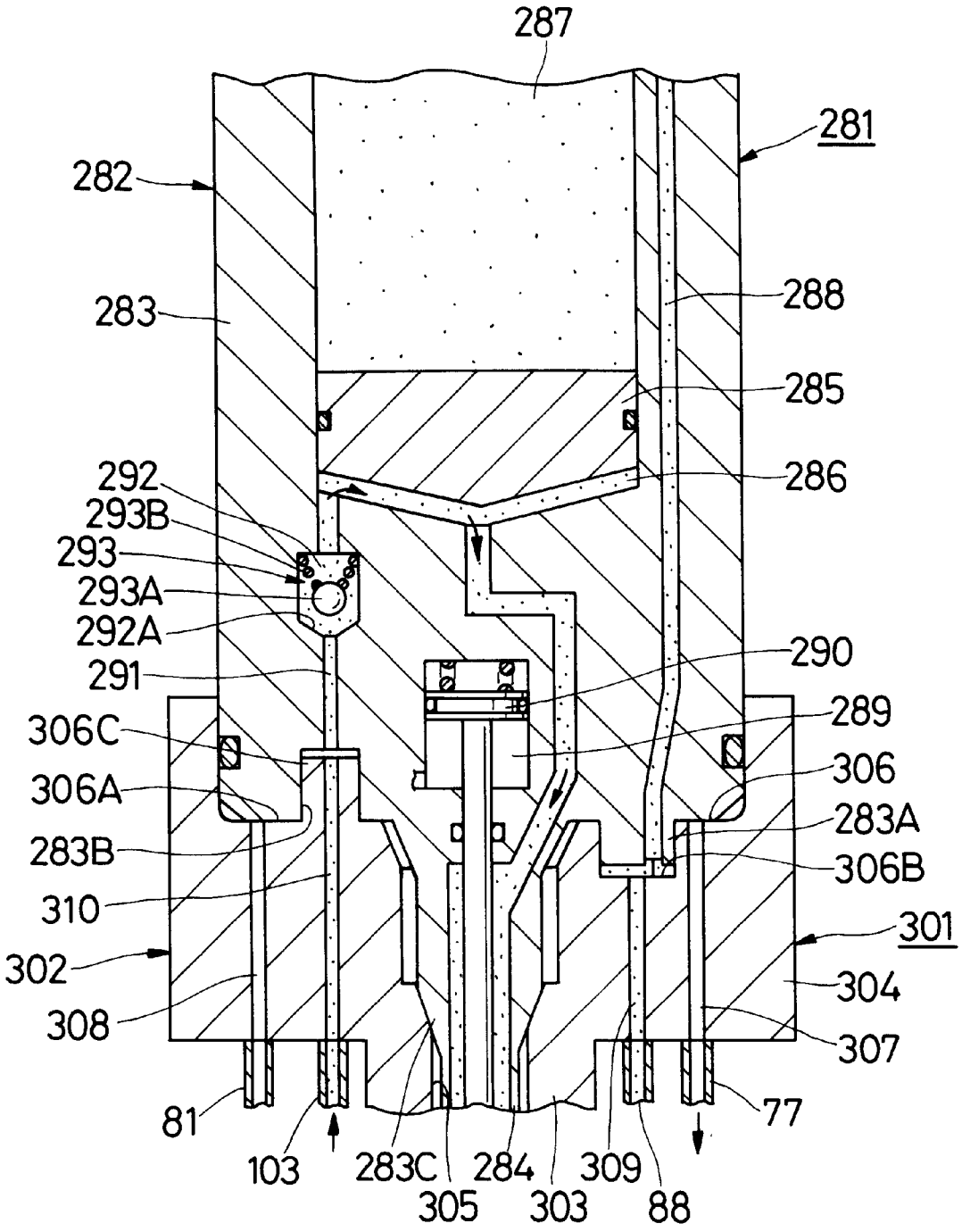
FIG. 30 is a vertical sectional view, showing a paint cartridge and a paint replenisher adopted in a fifth embodiment of the present invention, in a stage of washing a paint chamber in the cartridge.

Referring now to FIG. 30, there is shown a fifth embodiment of the present invention, with features in that the wash fluid valve on the paint cartridge is arranged as a check valve which is opened at the time when a wash fluid is flowing through a wash fluid passage in a direction toward the paint chamber of the cartridge and closed at the time when the wash fluid is flowing in a reverse direction. This arrangement permits to abolish a wash fluid valve pilot air passage which is required to be provided on the side of the replenishing stool in the above-described first embodiment. In the following description of the fifth embodiment, those component parts which are common or identical with the counterparts in the foregoing first embodiment are simply designated by same or common reference numerals or characters to avoid repetitions of same explanations.

Indicated at 281 is a paint cartridge which is adopted in the present embodiment in place of the paint cartridge 31 of the first embodiment. Substantially in the same way as the paint cartridge 31 of the first embodiment, the paint cartridge 281 is largely constituted by a casing 282, a piston 285, an extruding thinner passage 288, a paint valve 290, a wash fluid passage 291, and a check valve 293.

The casing 282, which defines the outer configuration of the paint cartridge 281, is constituted by a container 283 and a feed tube 284. The container 283 is provided with a male coupling portion 283A, a female coupling portion 283B, and a conical projection 283C. Further, the inner space of the container 283 is divided into a paint chamber 286 and an extruding thinner chamber 287 by the piston 285 which is slidably fitted in the container 283. Further, an extruding thinner passage 288 is formed through the shell of the container 283. One end of the extruding thinner passage 288 is opened in a fore distal end face of the male coupling portion 283A, while the other end of the extruding thinner passage 288 is communicated with the extruding thinner chamber 287 of the cartridge.

Indicated at 289 is a paint valve receptacle cavity portion which is provided in a fore end portion of the container 283, and at 290 is a paint valve which is provided in the paint valve receptacle portion 289. In this instance, the paint valve 290 is arranged in the same way as the paint valve 41 in the foregoing first embodiment.

Indicated at 291 is a wash fluid passage which is provided in the container 283 of the paint cartridge 281. One end of this wash fluid passage 291 on the side of the paint cartridge is opened into the female coupling portion 283B, while the other end of the wash fluid passage 291 is communicated with a bottom portion of the paint chamber 286 at a position in an outer peripheral portion of the latter.

Denoted at 292 is a valve receptacle cavity portion which is provided in the course of the wash fluid passage 291 on the side of the paint cartridge to accommodate a check valve 293, which will be described hereinlater. The wash fluid passage 291 is provided with a valve seat surface 292A at its upstream end.

The check valve 293, which is provided in the valve receptacle portion 292 as a wash fluid valve, is constituted by a ball valve member 293A which is movably received in the valve receptacle portion 292, and a valve spring 293B which is adapted to bias the ball valve member 293A toward the valve seat surface 292A.

Normally, under the influence of the biasing action of the valve spring 293B, the ball valve member 293A of the check valve 293 is pressed against and closed on the valve seat surface 292A to block reverse flow of paint from the paint chamber 286 to the wash fluid passage 291. On the other hand, when wash air and thinner are supplied to the paint chamber 286 through the wash fluid passage 291, the ball valve member 293A is opened against the biasing action of the valve spring 293B to permit circulation of wash air and thinner therethrough.

Indicated at 301 is a paint replenisher which is adopted in the present embodiment in place of the paint replenisher 51 of the above-described first embodiment. The paint replenisher 301 according to the present embodiment differs from the paint replenisher 51 of the first embodiment in that no pilot air passage is provided in its replenishing stool 302. The replenishing stool 302 is largely constituted by a foot portion (not shown), a column portion 303 and a seat portion 304. Further, a feed tube passage hole 305 is formed axially through the replenishing stool 302, and a container support portion 306 is formed on the top side of the seat portion 304.

Further, in a manner similar to the container support portion 57 of the first embodiment, the container support portion 306 of this embodiment is formed with a bottom portion 306A, a female coupling portion 306B and a male coupling portion 306C. Furthermore, a suction air passage 307, an ejection air supply passage 308, an extruding thinner passage 309 and a wash fluid passage 310 on the side of the replenishing stool are provided in the seat portion 304 of the replenishing stool 302.

As clear from the foregoing detailed description, the valve construction can be simplified in the case of the present embodiment which employs the check valve 293 in place of the wash fluid valve 45 of the first embodiment. In addition, the abolishment of a pilot air passage, which is normally required to be provided on the side of the replenishing stool for supplying pilot air to the wash fluid valve, makes it possible to provide the paint cartridges 281 in a more compact form in size and weight and to cut their production cost.

Figure 31:
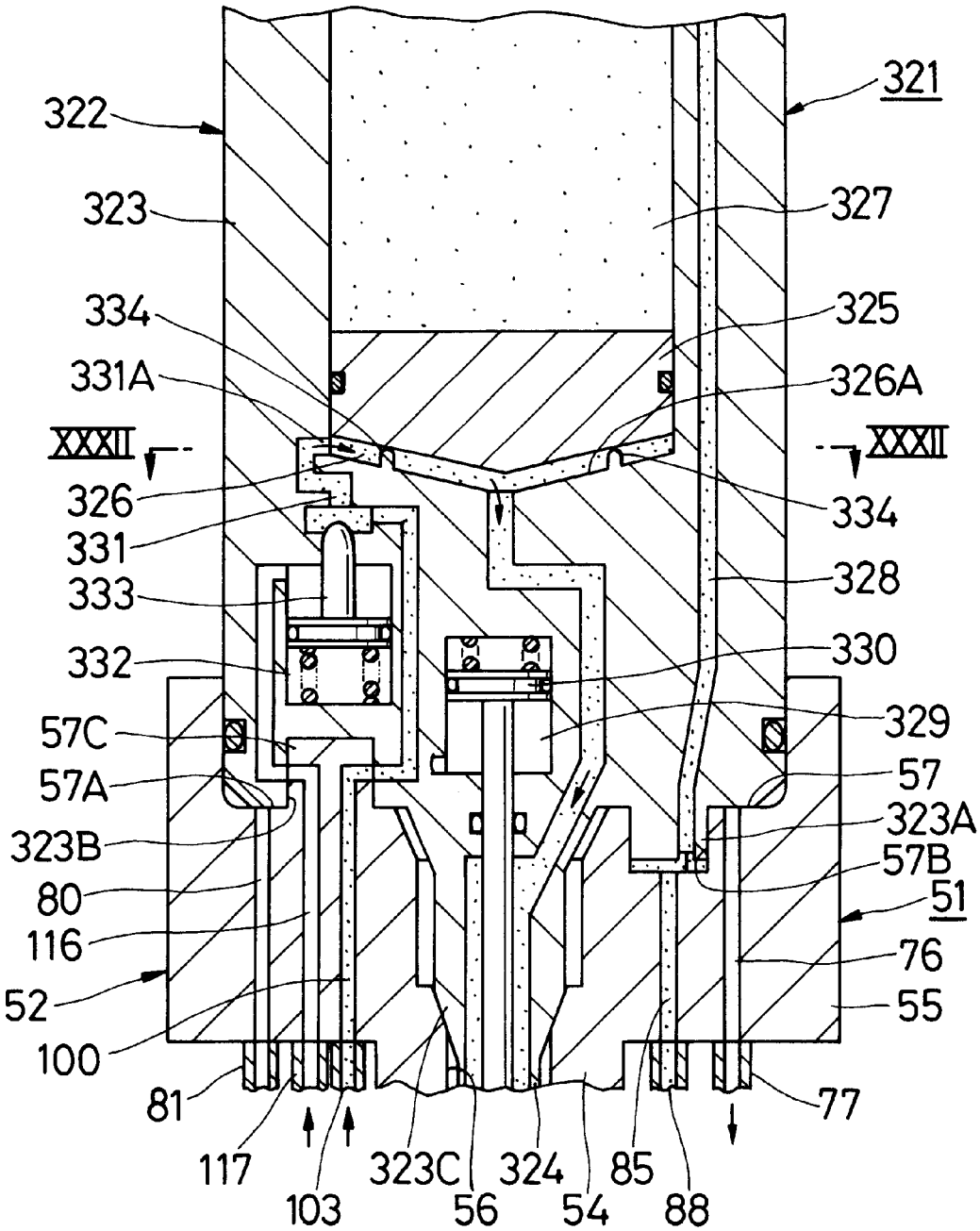
FIG. 31 is a vertical sectional view, showing a paint cartridge and a paint replenisher adopted in a sixth embodiment of the present invention, in a stage of washing a paint chamber in the cartridge.
Figure 32:
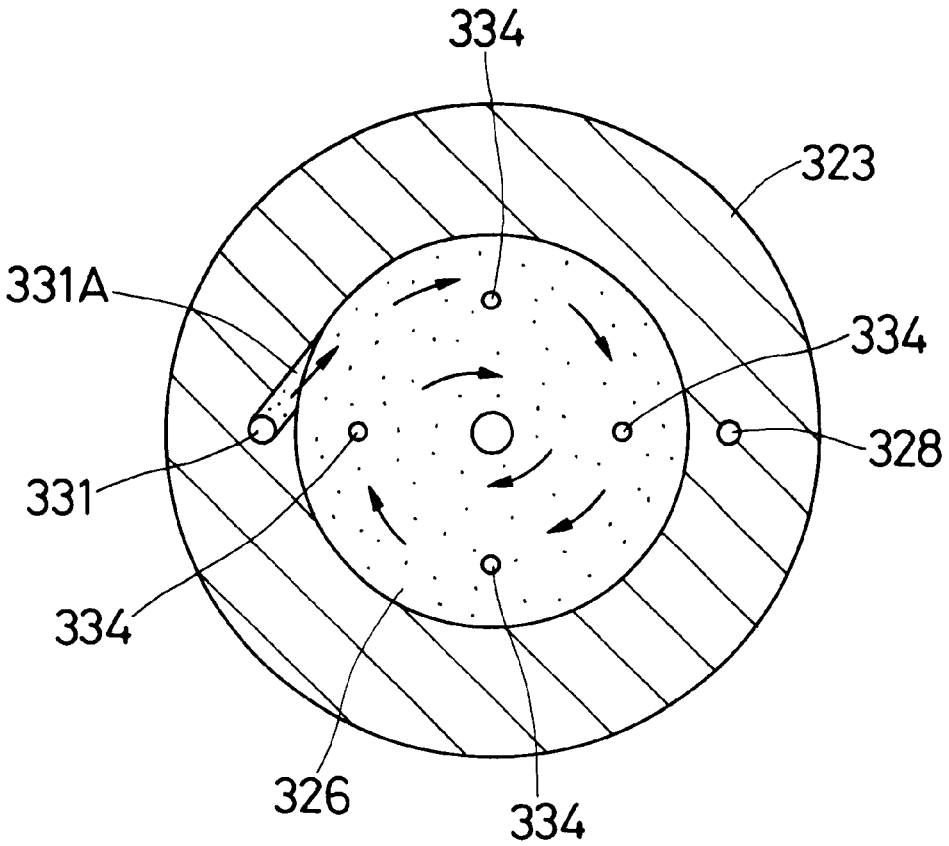
FIG. 32 is a cross-sectional view taken in the direction of arrows XXXII—XXXII in FIG. 31, showing conditions of a paint chamber which is being washed.

Turning now to FIGS. 31 and 32, there is shown a sixth embodiment of the present invention. This embodiment has features in that the paint chamber is formed as a space of substantially circular shape, and a wash fluid passage on the side of the paint cartridge is opened in an inner peripheral surface of the paint chamber in a tangential direction. Further, a spacer is provided either on the side of a bottom surface of the paint chamber or on the side of a movable partition wall to leave a gap space between the bottom surface of the paint chamber and the movable partition wall for circulation of a wash fluid when the movable wall is displaced toward the feed tube of the paint cartridge. In the following description of the sixth embodiment, those component parts which are common or identical with the counterparts in the foregoing first embodiment are simply designated by common or same reference numerals or characters to avoid repetitions of same explanations.

Indicated at 321 is a paint cartridge which is adopted by the present embodiment in place of the paint cartridge 31 of the first embodiment. In a manner substantially similar to the paint cartridge 31 in the first embodiment, the paint cartridge 321 of the present embodiment is largely constituted by a casing 322, a piston 325, an extruding thinner passage 328, paint valve 330, wash fluid passage 331, wash fluid valve 333, and a stopper projection or projections 334.

The casing 322, which determines the outer configuration of the paint cartridge 321, is constituted by a container 323 and a feed tube 324. The container 323 is provided with a male coupling portion 323A, a female coupling portion 323B, and a conical projection 323C.

Indicated at 325 is the piston which is axially slidably fitted in the container 323, dividing the container 323 into a paint chamber 326 and an extruding thinner chamber 327. Particularly in this instance, the paint chamber 326 is formed as a space of substantially circular shape in cross-section and provided with axial stopper projections 334 on its bottom surface 326A, as will be described hereinlafter.

Denoted at 328 is an extruding thinner passage which is formed in the container 323 of the paint cartridge to circulate extruding thinner to and from the extruding thinner chamber of the cartridge. One end of the extruding thinner passage 328 on the side of the cartridge is opened in a fore distal end face of the male coupling portion 323A of the container 323, while the other end of the extruding thinner passage 328 is communicated with the extruding thinner chamber 327.

Indicated at 329 is a paint valve receptacle cavity portion which is provided in a fore end portion of the container 323, and at 330 is a paint valve which is provided in the paint valve receptacle portion 329. This paint valve 330 is arranged in the same manner as the paint valve 41 in the above-described first embodiment.

Indicated at 331 is a wash fluid passage according to the present embodiment, which is formed in the container 323 of the paint cartridge 321. One end of this wash fluid passage 331 on the side of the paint cartridge is opened into the female coupling portion 323B, while the other end is communicated with a bottom portion of the paint chamber 326.

In this instance, as shown in FIG. 32, the wash fluid passage 331 on the side of the paint cartridge is opened into the paint chamber 326 tangentially through an inlet port 331A which is formed and located in a tangential position with respect to the paint chamber 326. Therefore, wash thinner and air which are introduced into the paint chamber 326 from the is wash fluid passage 331 through the tangential inlet port 331A form vortices in the paint chamber 326.

Indicated at 332 is a valve receptacle cavity portion which is formed in the container 323, and at 333 is a wash fluid valve which is provided in the valve receptacle portion 332. In this instance, the wash fluid valve 333 is arranged in the same manner as the wash fluid valve 45 in the foregoing first embodiment.

Denoted at 334 are a plural number of axial stopper projections which are formed on the bottom surface 326A of the paint chamber 326. In the particular embodiment shown, four stopper projections 334 are provided at uniform intervals in the circumferential direction. Each one of these axial stopper projections 334 is abutted against the piston 325 when the latter is displaced toward the feed tube 324, thereby stopping the piston 325 at a predetermined distance from the bottom surface 326A of the paint chamber 326 and maintaining a gap space of a predetermined width therebetween for circulation of a wash fluid.

As clear from the foregoing detailed description, according to the present embodiment, by means of the axial stopper projections 334 which are provided on the bottom surface 326A of the paint chamber 326, a gap space for circulation of a wash fluid can be formed between the piston 325 and the bottom surface 326A of the paint chamber 326 easily in a secure manner.

Besides, since wash air and thinner from the wash fluid passage 326 are introduced into the paint chamber 326 through the tangential inlet port 331A of the wash fluid passage 331, vortices of wash fluids are formed within the paint chamber 326 to wash away paint therefrom in a shortened period of time and with higher efficiency.

In each one of the foregoing embodiments, the rotary atomizing head type coating machine 11 is shown as being mounted on the horizontal arm 4 of the coating robot 1. However, if desired, the coating machine 11 may be mounted on other coating action mechanisms, for example, on a reciprocator type coating action mechanism or the like.

Further, in the above-described first embodiment, the piston 35 is used as a movable partition wall within the cartridge container. However, there may be employed other forms of movable partition wall in place of a piston, for example, a movable partition wall in the form of bellows or a flexible bag the inside of which is communicated with the feed tube. The same can be similarly applied to other embodiments of the invention.

Further, in the first embodiment, the replenishing valve 61 is composed of the paint feed/discharge valve 64 and a waste liquid discharge valve 71 which are each in the form of a 2-port 2-position control valve. However, in this regard, it is to be understood that the present invention is not limited to the particular arrangements shown. For example, the replenishing valve 61 may be arranged as a single 3-port 3-position change-over valve. This alternative arrangement can be similarly applied to the extruding thinner feed/discharge valve 86 or the wash fluid supply valve 101 or to other embodiments of the invention.

On the other hand, in the first embodiment, the wash fluid supply valve 101 is composed of the wash thinner supply valve 104 and the wash air supply valve 110 thereby to supply thinner and air as wash fluids. However, the present invention is not limited to this particular arrangement shown. For example, if desired, there may be employed a wash fluid supply valve which is constituted by a wash thinner supply valve alone. The same similarly applies to other embodiments of the invention.

Furthermore, thinner is used as a paint-extruding liquid in each one of the foregoing embodiments. However, depending upon the nature of paint and the type of the high voltage application system, it is possible to apply other extruding liquids such as water in a similar manner.

What is claimed is:

1. A cartridge type coating system, including a sprayer unit, a plural number of paint cartridges each detachably connectible to said sprayer unit to supply paint thereto from an internal paint source, and a paint replenisher detachably connectible to an empty paint cartridge for replenishing said paint thereinto, characterized in that:

said paint cartridges are each constituted by a casing having a container and a feed tube extended forward from a fore end portion of said container, a movable partition wall provided in said container and dividing said container into a paint chamber in communication with said feed tube and a paint-extruding liquid chamber, a normally closed paint valve provided in said casing and adapted to be opened at the time of supplying said paint from said paint chamber to said sprayer unit through a paint passage in said feed tube or at the time of replenishing said paint into said paint chamber, an extruding liquid passage for circulating an extruding liquid to and from said extruding liquid chamber, a wash fluid passage for supplying a wash fluid to said paint chamber, and a normally closed wash fluid valve provided in said wash fluid passage and adapted to be opened at the time of supplying said wash fluid to said paint chamber; and said paint replenisher is constituted by a replenishing stool on which said paint cartridge is set at the time of replenishing said paint into said paint chamber, a replenishing valve connected to said replenishing stool and adapted to replenish said paint into said paint chamber of said paint cartridge through said paint passage in said feed tube while said paint valve is in an open state, an extruding liquid feed/discharge valve connected to said replenishing stool and adapted to feed or discharge said extruding liquid to or from said extruding liquid chamber of said paint cartridge through said extruding liquid passage while said paint valve is in said open state, and a wash fluid supply valve connected to said replenishing stool and adapted to supply said wash fluid to said paint chamber through said wash fluid passage while said wash fluid valve is in an open state.

2. A cartridge type coating system as defined in claim 1, wherein said replenishing valve of said paint replenisher is constituted by a paint feed/discharge valve adapted to be opened at the time of supplying said paint from a paint supply source to said paint chamber of said cartridge or at the time of returning said paint in said paint chamber to said paint supply source, and a waste liquid discharge valve adapted to be opened at the time of supplying said wash fluid to said paint chamber of said cartridge.

3. A cartridge type coating system as defined in claim 1, wherein said extruding liquid feed/discharge valve of said paint replenisher is constituted by an extruding liquid supply valve adapted to be opened at the time of supplying said extruding liquid to said extruding liquid chamber of said cartridge, and an extruding liquid discharge valve adapted to be opened at the time of discharging said extruding liquid from said extruding liquid chamber of said cartridge.

4. A cartridge type coating system as defined in claim 1, wherein said wash fluid supply valve of said paint replenisher is constituted at least by a wash thinner supply valve adapted to supply wash thinner to said paint chamber of said cartridge or a wash air supply valve adapted to supply wash air to said paint chamber of said cartridge.

5. A cartridge type coating system as defined in claim 1, wherein said extruding liquid passage and said wash fluid passage of said paint cartridge are separately provided in said casing.

6. A cartridge type coating system as defined in claim 1, wherein said extruding liquid passage and said wash fluid passage of said paint cartridge are provided with a common inlet port, and said wash fluid valve is arranged in the form of a change-over valve adapted to switch said common inlet port either to said extruding liquid passage or said wash fluid passage.

7. A cartridge type coating system as defined in claim 1, wherein said wash fluid valve of said cartridge is arranged in the form of a check valve adapted to be opened when said wash fluid is circulated toward said paint chamber through said wash fluid passage and closed when said paint is flowing toward said feed tube from said paint chamber.

8. A cartridge type coating system as defined in claim 1, wherein said paint chamber of said cartridge is formed as a space of substantially circular shape in cross-section, and said wash fluid passage of said cartridge is opened tangentially toward an inner periphery of said paint chamber.

9. A cartridge type coating system as defined in claim 1, further comprising a spacer member or members provided on a bottom surface of said paint chamber or on said movable partition wall to leave a gap space for circulation of said wash fluid between said bottom surface of said paint chamber and said movable partition wall when the latter is moved toward said feed tube.

10. A cartridge type coating system as defined in claim 1, wherein said sprayer unit is mounted on a coating action mechanism at the time of performing a coating operation, and an extruding liquid passage is provided in said coating action mechanism for communication with said extruding liquid passage on a side of said paint cartridge, said extruding liquid passage on a side of said coating action mechanism being connected to an extruding liquid feeder to send said extruding liquid to said paint cartridge attached to said sprayer unit.

11. A cartridge type coating system as defined in claim 1, further comprising a cartridge gripper mechanism for gripping and transferring a paint cartridge to and from said sprayer unit and said paint replenisher, said cartridge gripper mechanism being provided with a pilot air passage for supply pilot air to said wash fluid valve when said cartridge is gripped on said cartridge gripper mechanism.

12. A cartridge type coating system, including a sprayer unit, a plural number of paint cartridges each detachably connectible to said sprayer unit to supply paint thereto from an internal paint source, and a paint replenisher detachably connectible to an empty paint cartridge for replenishing said paint thereinto, characterized in that:

said paint cartridges are each constituted by a casing having a container and a feed tube extended forward from a fore end portion of said container, a movable partition wall provided in said container and dividing said container into a paint chamber in communication with said feed tube and a paint-extruding liquid chamber, a normally closed paint valve provided in said casing and adapted to be opened at the time of supplying said paint from said paint chamber to said sprayer unit through a paint passage in said feed tube or at the time of replenishing said paint into said paint chamber, a common inlet port opened in an outer peripheral portion of said container, an extruding liquid passage connecting said common inlet port with said extruding liquid chamber, a wash fluid passage connecting said common inlet port with said paint chamber, and a change-over valve adapted to switch said common inlet port either to said extruding liquid passage or to said wash fluid passage; and said paint replenisher is constituted by are plenishing t stool on which said paint cartridge is set at the time of replenishing said paint into said paint chamber, a replenishing valve connected to said replenishing stool and adapted to replenish said paint into said paint chamber of said paint cartridge through said paint passage in said feed tube while said paint valve is in an open state, an extruding liquid feed/discharge valve connected to said replenishing stool and adapted to feed or discharge an extruding liquid to or from said extruding liquid chamber of said paint cartridge or to supply said extruding liquid to said paint chamber of said cartridge as a wash liquid, a wash air supply valve adapted to supply wash air to said paint chamber of said cartridge, and a selector valve having an inlet side thereof connected to said extruding liquid feed/discharge valve and wash air supply valve and an outlet side thereof connected to said replenishing stool and adapted to connect either said extruding liquid feed/discharge valve or said wash air supply valve selectively to said common inlet port of said cartridge.

13. A cartridge type coating system, including a sprayer unit, a plural number of paint cartridges each detachably connectible to said sprayer unit to supply paint thereto from an internal paint source, a paint replenisher detachably connectible to an empty paint cartridge for replenishing said paint thereinto, and a cartridge gripper mechanism for gripping and transferring a paint cartridge to and from said paint replenishes and said sprayer unit, characterized in that:

said taint cartridges are each constituted by a casing having a container and a feed tube extended forward from a fore end portion of said container, a movable partition wall provided in said container and dividing said container into a paint chamber in communication with said feed tube and a paint-extruding liquid chamber, a normally closed paint valve provided in said casing and adapted to be opened at the time of supplying said paint from said paint chamber to said sprayer unit through a paint passage in said feed tube and at the time of replenishing paint into said paint chamber, an extruding liquid passage for circulating an extruding liquid to and from said extruding liquid chamber, a wash fluid passage for supplying a wash fluid to said paint chamber, and a normally closed wash fluid valve provided in said wash fluid passage and adapted to be opened at the time of supplying said wash fluid to said paint chamber; and said paint replenisher is constituted by a replenishing stool on which said paint cartridge is set at the time of replenishing paint into said paint chamber, a replenishing valve connected to said replenishing stool and adapted to replenish said paint into said paint chamber of said paint cartridge through said paint passage in said feed tube while said paint valve is in an open state, an extruding liquid feed/discharge valve connected to said replenishing stool and adapted to feed or discharge said extruding liquid to or from said extruding liquid chamber of said paint cartridge through said extruding liquid passage while said paint valve is in said open state; and said cartridge gripper mechanism is provided with a gripper for gripping said paint cartridge, and a wash fluid passage formed in said gripper and adapted to be connected to said wash fluid passage on a side of said cartridge when the latter is gripped on said gripper, an upstream end of said wash fluid passage in said gripper being connected to a wash fluid supply valve which supplies a wash fluid to said paint chamber of said cartridge.

* * * * *